US008454325B2

(12) United States Patent
Fisher et al.

(10) Patent No.: US 8,454,325 B2
(45) Date of Patent: Jun. 4, 2013

(54) COAXIAL PUMPING APPARATUS WITH INTERNAL POWER FLUID COLUMN

(75) Inventors: Norm Fisher, Courtenay (CA); Richard Frederick McNichol, Surrey (CA)

(73) Assignee: Richard F. McNichol, Surrey, BC (CA)

( * ) Notice: Subject to any disclaimer, the term of this patent is extended or adjusted under 35 U.S.C. 154(b) by 1519 days.

(21) Appl. No.: 12/023,016

(22) Filed: Jan. 30, 2008

(65) Prior Publication Data

US 2008/0219869 A1 Sep. 11, 2008

Related U.S. Application Data

(60) Provisional application No. 60/898,377, filed on Jan. 30, 2007.

(51) Int. Cl.
*F04B 35/02* (2006.01)
*F04B 9/107* (2006.01)

(52) U.S. Cl.
USPC ..... 417/401

(58) Field of Classification Search
USPC ..... 417/401, 374, 399
See application file for complete search history.

(56) References Cited

U.S. PATENT DOCUMENTS

| | | | | |
|---|---|---|---|---|
| 1,532,231 | A | | 4/1925 | Corey |
| 2,014,613 | A | | 9/1935 | Ceverha |
| 2,174,114 | A | | 9/1939 | Will |
| 2,376,538 | A | | 5/1945 | Hardey |
| 2,490,118 | A | | 12/1949 | Dickinson |
| 3,135,210 | A | | 6/1964 | English |
| 4,026,661 | A | * | 5/1977 | Roeder ..... 417/53 |
| 4,219,311 | A | | 8/1980 | Simon |
| 4,421,463 | A | | 12/1983 | Lee |
| 4,551,075 | A | | 11/1985 | Canalizo |
| 5,188,517 | A | | 2/1993 | Koster |
| 5,337,565 | A | | 8/1994 | Meixner |
| 1,616,744 | A | | 8/1997 | Warren |
| 6,193,476 | B1 | | 2/2001 | Sweeney |
| 7,967,578 | B2 | | 6/2011 | McNichol |

(Continued)

FOREIGN PATENT DOCUMENTS

| | | |
|---|---|---|
| CA | 1041371 | 10/1978 |
| CA | 1057121 | 6/1979 |

(Continued)

OTHER PUBLICATIONS

Supplementary European Search Report for EP 05706422.2 dated Mar. 15, 2007.

(Continued)

*Primary Examiner* — Charles Freay
*Assistant Examiner* — Philip Stimpert
(74) *Attorney, Agent, or Firm* — Knobbe Martens Olson & Bear, LLP

(57) ABSTRACT

A pump having an increased energy efficiency is provided. The pump has an internal power fluid column and a transfer piston which is reciprocatingly mounted about the power fluid column. The transfer piston defines a product fluid chamber, located above the transfer piston valve, and a transfer chamber, located below the transfer piston valve. The power fluid column has at least one passageway, which allows the fluid inside the power fluid column to be in communication with a power fluid chamber. The power fluid chamber, the transfer chamber, and the product chamber are situated coaxially about the power fluid column.

21 Claims, 21 Drawing Sheets

U.S. PATENT DOCUMENTS

| | | | | |
|---|---|---|---|---|
| 2005/0169776 | A1 | 8/2005 | McNichol | |
| 2005/0249613 | A1* | 11/2005 | Jordan et al. | 417/390 |
| 2006/0000616 | A1* | 1/2006 | Crawford | 166/369 |
| 2007/0172364 | A1 | 7/2007 | McNichol | |
| 2011/0255997 | A1 | 10/2011 | McNichol | |

FOREIGN PATENT DOCUMENTS

| | | |
|---|---|---|
| CA | 1198315 | 12/1985 |
| FR | 2 545 886 | 11/1984 |
| GB | 631 521 | 11/1949 |
| WO | WO 84/01002 | 3/1984 |
| WO | WO 2005/073555 | 11/2005 |
| WO | WO 2008/092266 A1 | 7/2008 |

OTHER PUBLICATIONS

PCT International Search Report and the Written Opinion in PCT/CA2008/000206 issued Apr. 30, 2008.

PCT International Preliminary Report on Patentability in PCT/CA2008/000206 issued Aug. 4, 2009.

* cited by examiner

COAXIAL PUMPING APPARATUS WITH INTERNAL POWER FLUID COLUMN

CROSS-REFERENCE TO RELATED APPLICATIONS

This application claims the benefit under 35 U.S.C. §119 (e) of U.S. provisional application Ser. No. 60/898,377, filed Jan. 30, 2007, the disclosure of which is hereby expressly incorporated by reference in its entirety and is hereby expressly made a portion of this application.

FIELD OF THE INVENTION

The present application relates generally to pumps, and more particularly to piston type pumps having increased energy efficiency, systems incorporating such piston type pumps, and methods of operating piston type pumps.

BACKGROUND OF THE INVENTION

It has been estimated that approximately 85% of the total cost of operating a conventional pump is attributable to energy consumption. Moreover, pumping systems account for nearly 20% of the world's electrical energy demand and range from 25% to 50% of the energy required by industrial plant operations.

Similarly, maintenance costs account for approximately 10% of the total cost of operating a conventional pump.

SUMMARY OF THE INVENTION

Numerous industries, and in particular the oil and gas industry, have long been interested in pumps having increased energy efficiency. Pump designs which reduce maintenance costs by reducing the number of moving parts and/or reducing the damage caused by suspended particles are also highly desirable. Piston type pumping apparatus having increased energy efficiency and/or reduced maintenance costs and methods of using same are provided.

In various embodiments, the pump comprises a pump having an inlet, an inlet valve, and an outlet. The pump further comprises an internal power fluid column having an inlet, and a transfer piston which is reciprocatingly mounted about the power fluid column. The transfer piston comprises a channel therethrough, which can be sealed by a transfer piston valve. The transfer piston defines a product fluid chamber, located above the transfer piston valve, and a transfer chamber, located below the transfer piston valve. The power fluid column comprises at least one passageway, which allows the fluid inside the power fluid column to be in communication with a power fluid chamber. The pressurized fluid in the power fluid chamber acts against at least a portion of the transfer piston in the direction of transfer piston movement. The surface area of the transfer piston upon which the fluid in the product chamber acts is preferably greater than the surface area of the transfer piston upon which the fluid in the power fluid chamber acts.

When the power fluid is provided to the power fluid chamber under pressure, the power fluid acts against the transfer piston and lifts the transfer piston. The transfer piston valve closes and the fluid in the product chamber is forced through the pump outlet. As the transfer piston rises, the pressure in the transfer chamber decreases. The inlet valve opens and fluid is drawn into the transfer chamber. When the pressure of the power fluid is decreased, the transfer piston lowers. The pressure inside the transfer chamber increases and the inlet valve closes. The transfer piston valve opens, allowing fluid to flow through the transfer piston channel from the transfer chamber to the product chamber. The operation of the pump is maintained by providing oscillating pressure to the power fluid.

In several embodiments, the inlet valve and transfer piston valve are one-way valves. In some embodiments, the one-way valves are self-actuating one-way valves.

In some embodiments, the power fluid acts upon the bottom surface of the piston portion of the transfer piston. In other embodiments, the power fluid acts on the rod portion of the transfer piston.

In some embodiments, the oscillating pressure to the power fluid is provided by a piston and cylinder system, wherein the piston is moved by a motor or engine with a crank mechanism, or a pneumatic or hydraulic device.

In certain embodiments, the oscillating pressure to the power fluid is provided by a column of power fluid extending to an elevation that is higher that the elevation at which the product fluid is being recovered. The pressure head created by this column of power fluid is sufficient to lift the transfer piston. A valve to the power fluid source can be closed and a release valve opened, at an elevation lower than the elevation at which the product fluid was recovered, in order to reduce the power fluid pressure and allow the transfer piston to lower.

In some embodiments, a filter or screen to filter particles from the fluid entering the pump is provided.

In several embodiments, the pump comprises valve stops that prevent the one-way inlet valve and the one-way transfer piston valve from closing. In various embodiments, the stop for the inlet valve comprises an extended portion on the rod portion of the transfer piston. In some embodiments, the stop for the transfer piston valve comprises a v-shaped member that prevents the transfer piston valve from closing when the member contacts an activator.

In some embodiments, the power fluid column is internal and the power fluid chamber, transfer chamber, and product chamber are located coaxially about the power fluid column. These embodiments are useful where the power fluid is to be supplied at substantial pressures, such as in deep well applications.

In a first aspect, a pumping apparatus is provided, comprising: a first inlet having an inlet valve; an outlet; and an internal power fluid column having a second inlet and a transfer piston reciprocatingly mounted about a power fluid column, wherein the transfer piston has a sealable channel therethrough, wherein the sealable channel has a transfer piston valve, wherein the transfer piston defines a product fluid chamber and a transfer chamber, wherein the product fluid chamber is situated above the transfer piston valve and the transfer chamber is situated below the transfer piston valve, and wherein the power fluid column comprises at least one passageway configured to allow a fluid inside the power fluid column to be in communication with a power fluid chamber.

In an embodiment of the first aspect, the apparatus is configured to pressurize fluid inside the power fluid column and the power fluid chamber.

In an embodiment of the first aspect, the transfer piston is configured such that the fluid acts against a first area comprising at least a portion of the transfer piston in a direction of transfer piston movement.

In an embodiment of the first aspect, the first area is greater than a second area comprising at least a portion of the transfer piston in the power fluid chamber, and wherein the transfer piston is configured such that the fluid in the power fluid chamber acts against the second area in a direction of movement of the transfer piston.

In an embodiment of the first aspect, wherein the pumping apparatus further comprises a first valve stop configured to prevent closing of the one-way inlet valve and a second valve stop configured to prevent closing of the one-way transfer piston valve.

In an embodiment of the first aspect, at least one of the first valve stop and the second valve stop comprises an extended portion on the rod portion of the transfer piston.

In an embodiment of the first aspect, at least one of the first valve stop and the second valve stop comprises a v-shaped member configured to prevent the transfer piston valve from closing.

In an embodiment of the first aspect, the v-shaped member is configured to prevent the transfer piston valve from closing when the v-shaped member contacts an activator.

In an embodiment of the first aspect, the power fluid column is internal and the power fluid chamber, the transfer chamber and the product chamber are situated coaxially about the power fluid column.

In an embodiment of the first aspect, the apparatus configured for use in a deep well.

In an embodiment of the first aspect, the system is configured to operate using a power fluid comprising water.

In an embodiment of the first aspect, the system is configured to operate using a power fluid comprising a hydraulic fluid.

In an embodiment of the first aspect, at least one of the power fluid chamber and the power fluid column comprises stainless steel.

In an embodiment of the first aspect, at least one of the power fluid chamber and the power fluid column comprises titanium.

In an embodiment of the first aspect, wherein the apparatus further comprises a solenoid valve configured to control oscillation of a high head, whereby oscillating pressure to the power fluid is delivered.

In an embodiment of the first aspect, the apparatus further comprises a fluid inlet screen configured to filter fluid entering the first inlet.

In an embodiment of the first aspect, the apparatus further comprises a coaxial disconnect.

In an embodiment of the first aspect, the apparatus further comprises a subterranean switch pump.

In an embodiment of the first aspect, the subterranean switch pump comprises a power hydraulic line and a recovery hydraulic line.

In a second aspect, a system is provided for pumping fluid in a deep well, the system comprising: a pumping apparatus comprising a first inlet having an inlet valve, an outlet, and an internal power fluid column having a second inlet and a transfer piston reciprocatingly mounted about the power fluid column, wherein the transfer piston has a sealable channel therethrough, wherein the sealable channel has a transfer piston valve, wherein the transfer piston defines a product fluid chamber and a transfer chamber, wherein the product fluid chamber is situated above the transfer piston valve and the transfer chamber is situated below the transfer piston valve, and wherein the power fluid column comprises at least one passageway configured to allow a fluid inside the power fluid column to be in communication with a power fluid chamber; and a power fluid within the power fluid column and power fluid chamber.

In an embodiment of the second aspect, the system further comprises a coaxial disconnecting device, wherein the coaxial disconnecting device is separately sealed to the power fluid column and the product fluid chamber, whereby fluid communication between the power fluid column and the coaxial disconnecting device is provided, and whereby fluid communication between the product fluid chamber and the coaxial disconnecting device is provided.

In a third aspect, a method is provided for pumping a fluid, the method comprising: introducing a power fluid into a power fluid chamber of a pumping apparatus via an internal power fluid column, whereby a transfer piston is lifted so as to close a transfer piston valve, whereby fluid to be pumped is drawn into a transfer chamber via an inlet valve; decreasing a pressure of the power fluid in the power fluid column and the power fluid chamber, whereby the transfer piston falls, the transfer piston valve is opened, and the inlet valve is closed, whereby the fluid to be pumped passes from the transfer chamber via the transfer piston valve into a product chamber; and increasing the pressure of the power fluid in the power fluid column and the power fluid chamber, whereby the transfer piston is raised, the transfer piston valve closes, and the transfer piston valve closes, such that fluid to be pumped in the product chamber is forced out of the product chamber, such that the fluid is pumped.

In an embodiment of the third aspect, the pressure of the power fluid is increased and decreased through application of an oscillating pressure to the power fluid.

In an embodiment of the third aspect, the oscillating pressure is provided by moving a piston back and forth in a cylinder containing the power fluid.

In an embodiment of the third aspect, motion of the piston is induced by operation of at least one device selected from the group consisting of a motor, an engine with a crank mechanism, a pneumatic device, and a hydraulic device.

In an embodiment of the third aspect, at least one of the inlet valve and the transfer piston valve is a one-way valve.

In an embodiment of the third aspect, the one-way valve is a self-actuating one-way valve.

In an embodiment of the third aspect, providing oscillating pressure to the power fluid comprises providing a column of power fluid extending to an elevation higher than an elevation at which product fluid is recovered.

In an embodiment of the third aspect, introducing a power fluid into a power fluid chamber of a pumping apparatus via an internal power fluid column comprises: closing a valve to a power fluid source; and opening a power fluid release valve at an elevation lower than an elevation at which the pumped fluid is recovered, whereby the power fluid is introduced into the power fluid chamber.

In an embodiment of the third aspect, the fluid to be pumped contains particles, the method further comprising filtering particles from the fluid to be pumped, such that the fluid entering the transfer chamber contains a reduced amount of particles.

In an embodiment of the third aspect, the particles are filtered from the fluid to be pumped by the fluid to be pumped passing through a fluid inlet screen of the pumping apparatus.

In an embodiment of the third aspect, the pumping apparatus in situated in a well, such that the inlet valve is submerged in the fluid to be pumped from the well.

In an embodiment of the third aspect, the pumping device is situated in a well, the method further comprising: introducing a coaxial tube with a coaxial disconnecting device attached thereto into the well; separately sealing the coaxial disconnecting device to the power fluid column and the product fluid chamber, whereby fluid communication between the power fluid column and the coaxial disconnecting device is provided, and whereby fluid communication between the product fluid chamber and the coaxial disconnecting device is provided; pumping up through the coaxial tube the fluid to be pumped; and pumping down through the coaxial tube the power fluid.

DETAILED DESCRIPTION OF THE PREFERRED EMBODIMENT

Figure 1:
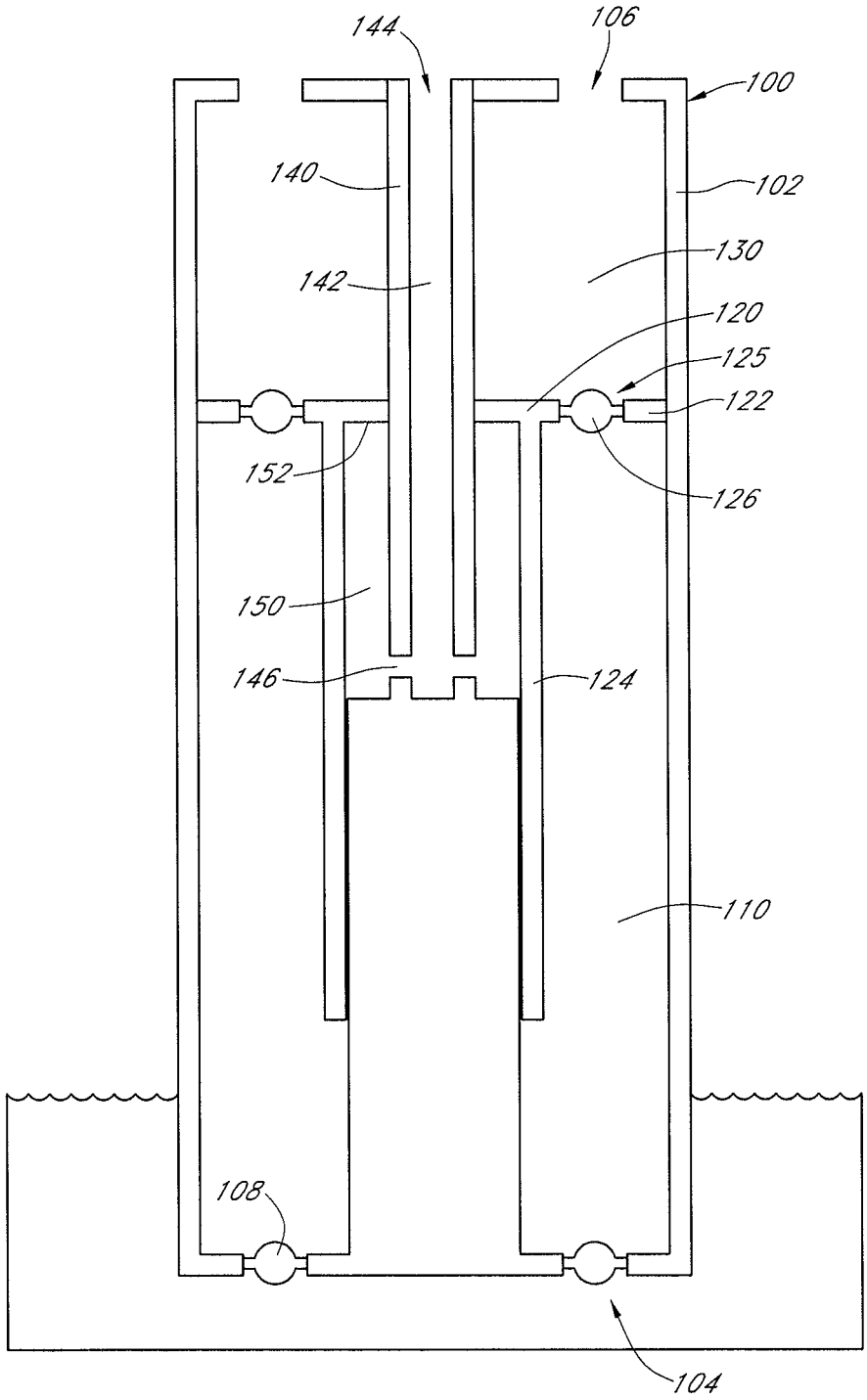
FIG. 1 provides a cross-sectional view of a vertically oriented pump including a pump housing, an inlet near the bottom of the pump, and an outlet near the top of the pump.

FIG. 1 illustrates an embodiment of a pumping apparatus of a preferred embodiment. The vertically oriented pump 100 preferably includes a pump housing 102, at least one inlet 104 near the bottom of the pump 100, and at least one outlet 106 near the top of the pump 100. The pump inlet 104 includes a valve 108. The valve 108 is preferably a one-way valve, allowing fluid to flow through the inlet 104 into a transfer chamber 110 inside the pump 100, but not in the reverse direction. More preferably, the inlet valve 108 is a self-actuating valve, such that it requires no electronic or manual control, but rather opens and closes solely by the force of the fluid moving therethrough and/or by pressure changes in the transfer chamber 110. In such embodiments, any suitable type of one-way valve can be utilized, including check valves and the like.

Check valves are valves that permit fluid to flow in only one direction. Ball check valves contain a ball that sits freely above a seat, which has only one opening therethrough. The ball has a diameter that is larger than the diameter of the opening. When the pressure behind the seat exceeds the pressure above the ball, liquid is allowed to flow through the valve; however, once the pressure above the ball exceeds the pressure below the seat, the ball returns to rest in the seat, forming a seal that prevents backflow. The ball can also be connected to a spring or other alignment device. Such alignment devices are useful if the pump operates in a non-vertical orientation. In some embodiments, the ball can be replaced by another shape, such as a cone.

Swing check valves can also be utilized. Swing check valves use a hinged disc that swings open with the flow. Any other suitable type of check valve, including dual flap check valves and lift check valves, can also be utilized. In addition, numerous other types of valves can be utilized, including reed valves, diaphragm valves, and the like. The valves can optionally be electronically controlled. Using standard computer process control techniques, such as those known in the art, the opening and closing of each valve can be automated. In such embodiments, two-way valves can advantageously be utilized.

Any suitable number of inlets and outlets can be employed, for example, 1, 2, 3, 4, 5, or more inlets, and 1, 2, 3, 4, 5, or more outlets. Preferably three (3) inlets and three (3) outlets are employed.

The pump can be of any suitable size. The preferred size can be selected based upon various factors such as the amount of liquid to be pumped, the type of liquid, and other factors. For example, the pump housing can have a diameter of 1, 3, 6, 12, 24, or 36 inches or more. In a preferred embodiment, the pump housing 102 has an outer diameter of about 3.5 inches. In another preferred embodiment, the pump housing 102 has an outer diameter of about 1.5 inches.

The pump 100 also includes a transfer piston 120, which is reciprocatingly mounted therein. The transfer piston 120 typically includes a piston portion 122 and a rod portion 124.

The piston portion 122 includes a channel 125 and a valve 126, which is referred to herein as the "transfer piston valve." Preferably, the transfer piston valve 126 is a one-way valve, allowing fluid to flow from the transfer chamber 110 into a product cylinder 130, but not in the reverse direction from the product cylinder 130 to the transfer chamber 110.

The pump 100 also includes a vertically oriented power fluid column 140, which defines a power fluid tube 142. The power fluid column can be oriented in any suitable manner, and is not limited to a vertical orientation. For example, the power fluid column can be horizontal, or at any angle displaced from the vertical. In addition, the pump 100 can operate at any angle, including vertical, horizontal, or any angle therebetween. The power fluid tube comprises an inlet 144 such that power fluid can be provided to and/or removed from the power fluid tube 142.

The power fluid column 140 further includes at least one passageway 146. In preferred embodiments, the power fluid column includes 1, 2, 3, 4, 5, 6 or more passageways. This passageway 146 allows power fluid to flow freely between the power fluid tube 142 and a power fluid chamber 150. Preferably, the passageway 146 is located near the bottom of the power fluid tube 142.

In the embodiment illustrated in FIG. 1, the power fluid chamber 150 is defined by the exterior surface of the power fluid column 140 and the transfer piston 120. The power fluid chamber 150 has a top 152, also referred to herein as the "inner surface area." In the embodiment illustrated in FIG. 1, the inner surface area 152 is a portion of the bottom of the piston portion 122 of the transfer piston 120. The inner surface area 152 is the surface area upon which the power fluid acts. The passageway 146 through which the power fluid enters the power fluid chamber 150 is located below the inner surface area 152.

To enclose the power fluid chamber 150, the rod portion 124 of the transfer piston 130 extends coaxially about the power fluid column 140. The shape of the power fluid column 140 and the transfer piston 120 are chosen such that they form a slideable seal both at the top and the bottom of the power fluid chamber 150. For example, in the embodiment illustrated in FIG. 1, the power fluid column 140 increases in diameter to form a slidingly sealable engagement with the rod portion 124 of the transfer piston 120 at the bottom of the power fluid chamber 150, thereby ensuring a secure power fluid chamber 150. The spacing between components, such as between the power fluid column 140 and the rod portion 124, is typically determined by the seal utilized. The type of seal utilized is determined by the operating conditions (i.e. pressure and temperature) and the fluids utilized. In a preferred embodiment, a standard o-ring seal is utilized. In high temperature applications, a ring such as those used in automobile pistons can be utilized.

FIG. 1 is a simplified drawing of a pump of one preferred embodiment. Seals and other conventional elements are omitted from the drawing for purposes of illustration. In addition, numerous modifications can be made to the embodiment illustrated in FIG. 1. As just one example, the piston portion 122 of the transfer piston 120 can alternatively be located at the bottom of the rod portion 124, rather than adjacent the top as illustrated in FIG. 1. In addition, the rod 124 and piston portions 122 can vary in shape and thickness. For example, the thickness of the piston portion 122 can be selected based on the pressure applied.

The operation of the pump illustrated in FIG. 1 is described in connection with pumping of oil from an oil well. However, the pumps of preferred embodiments are also suitable for pumping other liquids as well (e.g., ground water, subterranean liquids, brackish water, sea water, waste water, cooling water, gas, coolants, and the like).

The operating cycle of the pump 100 can be divided into two different stages, referred to herein as the "production stroke" or "power stroke" and the "recovery stroke." During the production stroke, water is supplied under pressure through the power fluid inlet 144. This forces water down the power fluid tube 142, through the passageway 146, and into the power fluid chamber 150. The water acts on the inner surface area 152 to lift the transfer piston 120. As the transfer piston 120 lifts against the weight of the oil in the product cylinder 130, the transfer piston valve 126 closes. Thus, as the transfer piston 120 is lifted, the oil in the product cylinder 130 is forced out through the pump outlet 106. This oil can then be recovered by suitable means or apparatus, such as is known in the art. For example, the outlet 106 can be connected to a pipe, which directs the oil to a desired location. In some instances, the oil can be delivered to the wellhead, where the oil can be directed to separation and/or storage facilities. Storage facilities, when employed, can be either above ground or below ground. Where crude oil is recovered, the oil can be transferred to a refinery or refineries by pipeline, ship, barge, truck, or railroad. Where natural gas is recovered, the gas is typically transported to processing facilities by pipeline. Gas processing facilities are typically located nearby so that impurities such as sulfur can be removed as soon as possible. In cold climate applications, the oil can be transferred via heated lines.

As the transfer piston 120 is rising with the transfer piston valve 126 closed as described above, a vacuum, partial vacuum, or low pressure volume is created in the transfer chamber 110. The decrease in pressure in the transfer chamber 110 causes the inlet valve 108 to open and oil from the well is drawn into the transfer chamber 110 through the pump inlet 104.

The transfer piston 120 rises until the top of the transfer piston 120 contacts the top of the pump or, alternatively, until the force generated by the power fluid and acting on the inner surface area 152 equals the force generated by the weight of the oil in the product cylinder 130 plus the weight of the transfer piston 120. As the transfer piston 120 reaches the highest point (similar to top dead center for a piston in an engine), the product cylinder 130 is at its smallest volume and the transfer chamber 110 is at its largest volume. The inlet valve 108 is open, but the transfer piston valve 126 is closed.

As the transfer piston 120 reaches its highest point, the pressure of the power fluid is reduced until the downward force, provided by gravity acting on the weight of the oil in the product cylinder 130, the weight of the oil in the product pipeline above the pump, and the weight of the transfer piston, is greater than the upward force provided by the power fluid acting on the inner surface area. This causes the transfer piston 120 to fall, and initiates the recovery stroke. In some embodiments, the pressure of the power fluid can be reduced such that the power fluid chamber serves as a vacuum or partial vacuum, providing an additional force to lower the transfer piston 120. In some embodiments, the fluid in the product cylinder can be pumped to a higher elevation or into a pressure vessel to supply additional energy for the recovery stroke.

As the transfer piston 120 lowers, the pressure inside the transfer chamber 110 increases. The increase in pressure causes the inlet valve 108 to close, thereby sealing the pump inlet 104. Alternatively, sensors can be employed and the valves controlled electronically. As the pressure inside the transfer chamber 110 continues to increase due to the lowering transfer piston 120, the transfer piston valve 126 opens, thereby allowing oil located within the transfer chamber 110 to flow into the product cylinder 130. The transfer piston 120 continues to lower until the rod portion 124 of the transfer piston 120 contacts the bottom of the pump 100, or alternatively until the force generated by the power fluid equals the force generated by the weight of the oil and the weight of the transfer piston. Thereafter, power fluid is introduced under pressure, acting on the inner surface area 152 and initiating the production stroke.

The operation of the pump is maintained by providing an oscillating or periodic pressure to the power fluid. The power fluid can be any suitable fluid. In one embodiment, the power fluid is water; however, numerous other power fluids can be utilized, including but not limited to sea water, waste water from oil recovery processes, and product fluid (i.e. oil if the pump is being used in oil recovery processes). In other embodiments, the power fluid can be gas or steam. Thus, the term "fluid," as used herein, is not restricted to liquids, but is intended to have a broad meaning, including gases and vapors. In a preferred embodiment, the power fluid is air. In another embodiment, the power fluid is steam.

The appropriate power fluid for a particular application can be based on a variety of factors, including cost and availability, corrosiveness, viscosity, density, and operating conditions. For example, the power fluid can be the same fluid as the product fluid. This allows the product fluid and the power fluid to have the same density, thereby simplifying the forces acting on the transfer piston. Alternatively, a more dense power fluid can be utilized. Utilizing a power fluid that is more dense than the product fluid allows the pump to operate with either (a) the power fluid supplied at a lower pressure, or (b) a smaller inner surface area. For example, in some embodiments, brine or mercury can be utilized. Preferably, a low-viscosity power fluid is utilized, as use of a high viscosity power fluid may result in pressure loss due to friction between the power fluid and the power fluid column.

In some embodiments, such as where the pump is utilized in high temperature applications, a power fluid such as motor oil can be utilized. Similarly, various oils and liquids with low freezing points can be utilized in cold environments.

The pump can be operated by one power source, or a number of pumps can be operated by the same power source. For example, in some applications such as construction, mine dewatering, or other commercial and industrial applications, several pumps can be operated by the same power source. In addition, several pumps can be operated using an air system, such as in a manufacturing facility.

The pump 100 and its components can be any suitable shape. The use of the terms column, chamber, tube, rod, and the like are not intended to limit the shape of the components. Rather, these terms are used solely to aid in describing particular embodiments. For example, with reference to FIG. 1, the pump housing 102 and power fluid column 140 can both be substantially cylindrical in shape. Thus, the piston portion 122 of the transfer piston 120 seals the annular gap between these two cylinders. However, the pumps of preferred embodiments are not limited to this configuration; the pump housing 102 can be any shape, and the power fluid column 140 can be any shape. For example, in addition to being circular, the pump components can also be square, rectangular, triangular, or elliptical.

The pump housing 102 and the pump components, such as the power fluid column 140 and the transfer piston 120, can be constructed of any suitable material. For example, in preferred embodiments, these components can be constructed of 304 or 316 stainless steel. In some embodiments, such as when the pump is in contact with highly corrosive materials, a 400 series stainless steel can be used. One of skill in the art will appreciate that selection of the pump materials depends on a variety of factors, including strength, corrosion resistance, and cost. For example, in high temperature applications, pump components can preferably be constructed of ceramic, carbon fiber, or other heat resistant materials.

Referring still to FIG. 1, the upper surface of the transfer piston 120 defines an area $A_1$. This upper surface can be planar, but can also be concave, convex, or linearly sloping. The surface area $A_1$ supports the weight of the fluid in the product cylinder 130 and any standing column of fluid above the pump. That is, the fluid in the product cylinder 130 and in any vertical pump outlet pipes creates a downward force on the transfer piston 120. This downward force is equal to the mass of the product fluid multiplied by gravity, or alternatively, it is equal to the pressure of the product fluid in the product cylinder 130 multiplied by the surface area $A_1$. Additionally, gravity acting on the weight of the transfer piston 120 also creates a downwards force.

The bottom surface of the transfer piston 120 that is exposed to the fluid in the transfer chamber 110 also defines an area, $A_2$. $A_2$ is the surface area upon which the fluid in the transfer chamber acts. During the recovery stroke, the fluid in the transfer chamber 110 exerts an upwards force on the transfer piston equal to the pressure inside the transfer chamber 110 multiplied by the surface area $A_2$ upon which it acts. For the embodiment illustrated in FIG. 1, the difference between $A_1$ and $A_2$ represents the inner surface area, $A_3$, the area upon which the pressure fluid acts.

Therefore, if:

$P_1$=Pressure of product fluid in the product chamber 130

$A_1$=Area upon which fluid in the product chamber 130 acts $P_2$=Pressure of fluid in the transfer chamber 110

$A_2$=Area upon which fluid in the transfer chamber 110 acts $P_{pf}$=Pressure of power fluid in the power fluid chamber 150

$A_3=(A_1-A_2)$ Pressure upon which power fluid acts ("inner surface area")

T=Weight of the transfer piston

And ignoring any forces caused due to friction between the components and seals inside the pump, then:

$$\text{Force}_{down}=P_1A_1+T$$

$$\text{Force}_{up}=P_2A_2+P_{pf}A_3$$

Accordingly, changes to the values for $A_1$ and $A_2$ influence the amount of pressure required for the power fluid to lift the piston during the power stroke. Moreover, the amount of work required to lift the piston is determined by multiplying the force exerted by the power fluid by the distance the piston travels. Therefore, if S represents the distance the piston travels from its lowest position to its highest position, then the work ($W_{in}$) necessary to lift the piston is:

$$W_{in}=P_{pf}A_3S$$

Accordingly, the amount of work required is also impacted by the ratio of $A_1$:$A_3$, as is the pump's efficiency. In a preferred embodiment, the ratio of $A_1$:$A_3$ is from about 1.25 to about 4.

Figure 2:
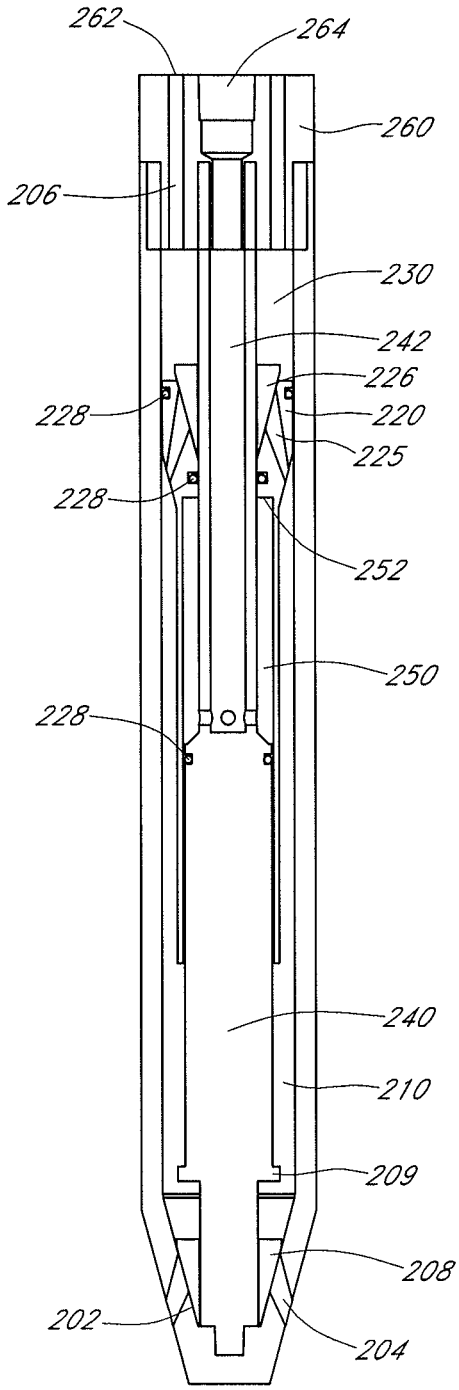
FIG. 2 provides a cross-sectional view of a pump having a tapered pump inlet.

FIG. 2 illustrates another embodiment of a pump. The pump is, in many respects, similar to the embodiment described above in connection with FIG. 1. As shown in FIG. 2, the pump inlet 204 is not located on the bottom of the pump 100, as illustrated in FIG. 1. The inlet 204 can be located at any point below the transfer piston valve 226. In a preferred embodiment, the inlet 204 is not located on the bottom of the pump housing 202, because when the pump is placed down a well, the bottom of the pump can rest on the ground beneath the fluid being pumped. Accordingly, pump inlets on the bottom of the pump often become plugged. As illustrated in FIG. 2, the pump inlet 204 can be tapered such that the narrowest portion of the inlet is at the exterior of the pump housing 202. In a preferred embodiment, the inlet has a one-eighth inch external opening, and has an inwardly enlarging taper. This tapering of the inlet 204 prevents suspended particles from becoming lodged within the pump.

The embodiment illustrated in FIG. 2 provides one example of a one-way valve system that can be utilized. The inlet 204 comprises a hole or passageway, as illustrated. A conical check valve member 208 is located near the bottom of the power fluid column 240. Thus, as the pressure inside the transfer chamber 210 decreases, the check valve opens, allowing fluid to flow through the inlet 204 into the transfer chamber 210. The conical valve member 208 can rise up freely, or it can rise until it reaches a stop 209, as illustrated in FIG. 2. The valve member 208 can also be slideably coupled to the power fluid column 240.

As illustrated, the pump 200 is in the recovery stroke. The increased pressure inside the transfer chamber 210 has caused the inlet valve member 208 to lower. As illustrated, the valve member 208 has lowered and formed a sealing engagement with the interior surface of the pump housing 202 (often referred to as the valve "seat"), thereby preventing fluid from flowing out of the transfer chamber 210 through the inlet holes 204.

The embodiment illustrated in FIG. 2 also utilizes a conical check valve as the transfer piston valve 226. Any suitable type of one-way valve can be used, and any combination of valve types can be used for the pump inlet valve 208 and the transfer piston valve 226. As previously described, automated valves and two-way valves can also be utilized with appropriate controls. As described previously in connection with pump inlet valve 208, the conical portion of the transfer piston valve 226 can be slideably coupled to the power fluid column 240. The amount of travel the conical portion of the piston valve 226 has can be limited by a stop (not shown). In a preferred embodiment, the valves 208, 226 are spring loaded. In other embodiments, the valves can be guided by other mechanisms, or, alternatively, free of constraints.

In the embodiment illustrated in FIG. 2, the transfer piston 220 comprises a channel 225. The transfer piston channel 225 can also be tapered to prevent solid particles from being lodged therein. Any number of piston channels and valves can be utilized. For example, the transfer piston can include 1, 2, 3, 4, 5, or 6 or more channels and/or valves.

As illustrated, the pumping apparatus 200 is in the recovery stroke. Thus, the pressure inside the transfer chamber 210 is greater than the pressure inside the product cylinder 230, and the transfer piston valve 226 is open, allowing fluid to flow from the transfer chamber 210 into the product cylinder 230.

The embodiment illustrated in FIG. 2 employs a preferred method for sealing the transfer piston 220. Sealing mechanisms 228 are used to prevent fluid communication between the transfer chamber 210 and the product cylinder 230, as well as between the transfer piston 220 and the power fluid column 240 to ensure a secure power fluid chamber 250. Methods of creating and maintaining a seal are well known in the art, and any such suitable method of forming a seal can be utilized with the pumps provided herein. For example, rings formed of polyurethane or polytetrafluoroethylene (PTFE) can be used.

The embodiment illustrated in FIG. 2 further utilizes a top cap 260. The top cap 260 serves as a mechanism 264 for connecting the source of the power fluid to the power fluid tube 242. Any suitable connection mechanism, including those connection mechanisms as are known in the art, can be employed. The top cap 260 also provides a mechanism 262 for connecting the pump outlet 206 to a recovery unit (not shown). For example, the top cap 260 can include threads to which a pump can be connected, or a seat to which a flanged pipe can be connected.

Figure 3:
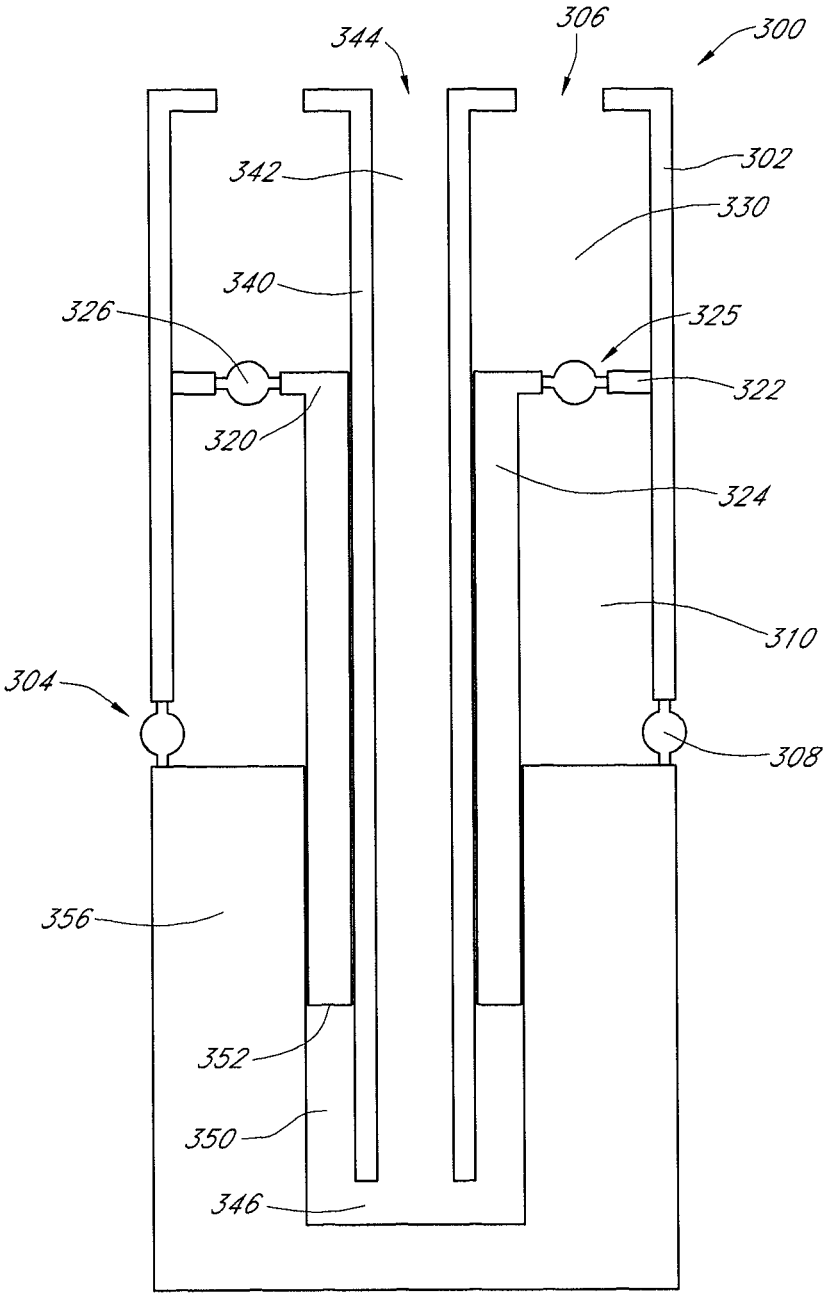
FIG. 3 provides a cross-sectional view of a pump wherein the power fluid acts on the bottom of the rod portion of the transfer piston.

FIG. 3 illustrates another embodiment of a pumping apparatus. The embodiment illustrated in FIG. 3 is similar in many respects to the embodiments illustrated in FIG. 1 and FIG. 2. However, the embodiment in FIG. 3 utilizes the bottom of the rod portion 324 of the transfer piston 320 as the inner surface area 352 upon which the power fluid acts. Accordingly, the power fluid chamber 350 is enclosed not only by the rod portion 324 of the transfer piston 320 and the power fluid column 340, but also by a third component, referred to herein as the power fluid containment portion 356. This containment portion 356, which provides an outer wall for the power fluid chamber 350, can be formed by increasing the thickness of the pump housing 302 below the inlet 304, as illustrated in FIG. 3. However, numerous other configurations and/or mechanisms can alternatively be utilized to enclose power fluid chamber. As an example, if the pump 300 has a 3 inch diameter, and the power fluid column 340 and power fluid chamber 350 have a combined diameter of 1.5 inches, then the pump housing 302 below the inlet 304 can be 1.5 inches thick. However, if the embodiment illustrated in FIG. 1 is utilized, and the transfer chamber occupies an additional 1 inch of the diameter, then the pump housing 302 can be only 0.5 inches thick.

The transfer piston 320, which is reciprocatingly mounted about the power fluid column 340, forms a slideable and sealing engagement with both the power fluid column 340 and the power fluid containment portion 356. The pump inlet 304, as illustrated in the embodiment shown in FIG. 3, is located above the power fluid containment portion 356 and the upper surface of the power fluid containment portion 356 serves as the base for the transfer chamber 310. However, the inlet 304 can alternatively extend through the power fluid containment portion 356.

Figure 4A:
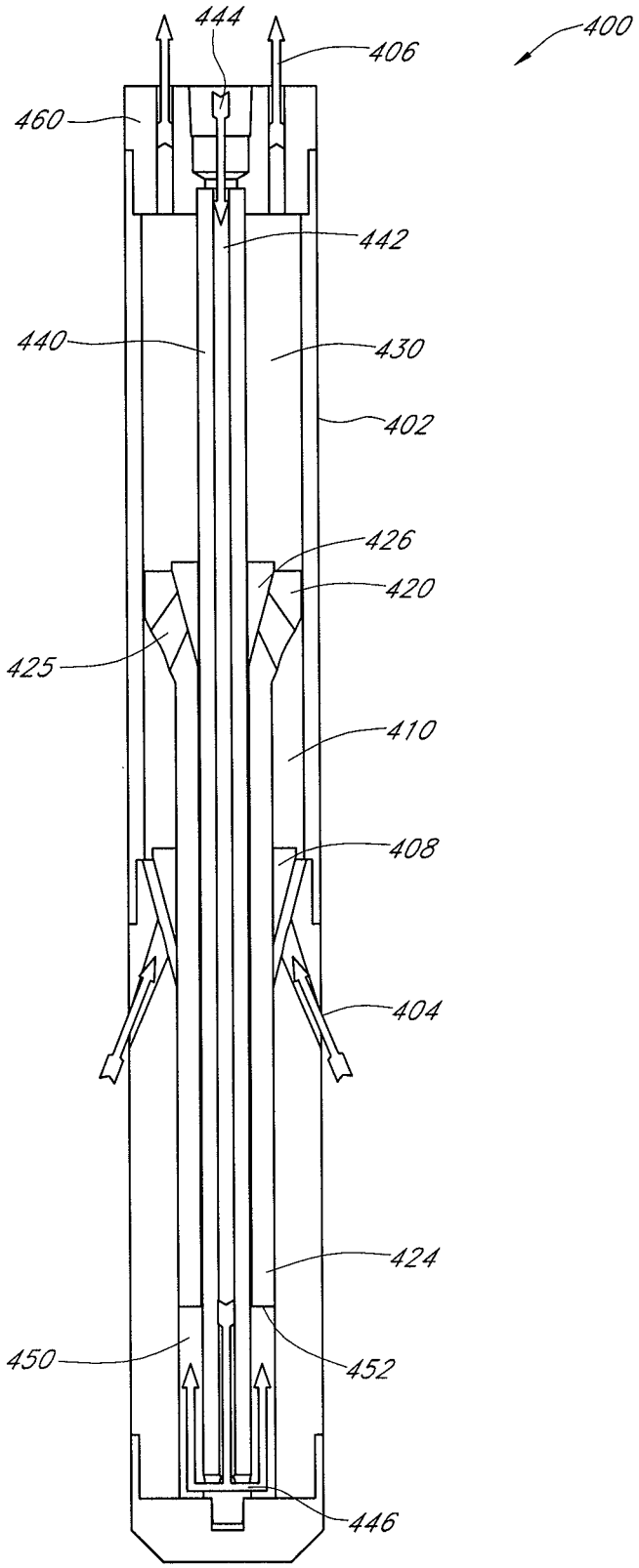
FIG. 4A provides a cross-sectional view of a pump during the production stroke.
Figure 4B:
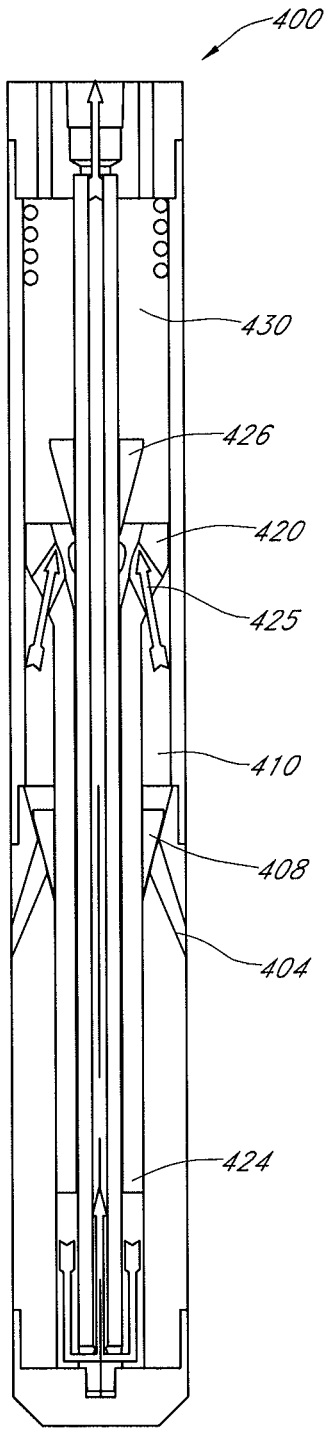
FIG. 4B provides a cross-sectional view of a pump during the recovery stroke.

FIG. 4A and FIG. 4B illustrate another embodiment of the pumping apparatus. In many ways, the embodiment illustrated in FIG. 4A and FIG. 4B is similar to the embodiment discussed above in connection with FIG. 3. FIG. 4A and FIG. 4B illustrate the use of conical check valves for both the inlet valve 408 and the transfer piston valve 426.

The embodiments illustrated in FIG. 3, FIG. 4A, and FIG. 4B operate in manner similar to those illustrated in FIG. 1 and FIG. 2. The operation of the pumps of embodiments illustrated in FIG. 4A and FIG. 4B is as follows. Pump dimensions and characteristics described herein are provided to aid in the description only, and are not meant to limit the scope of the application in any way.

FIG. 4A represents one embodiment of a pump during the production stroke. The pump 400 can have any outer diameter, including 1, 1.5, 2, 3, 4, 6, 12, or 24 inches or more. The pump 400 can be any height. In a preferred embodiment, the outer diameter of the pump housing 402 is about 1.5 inches, and the power fluid column 440 is about 0.5 inches in diameter. The pump 400, measured from the bottom of the pump to the top of the top cap 460, is about 19 inches in height. The center of the inlet hole 404 is about 8 inches from the bottom of the pump. When the transfer piston 420 is at its lowest position, the height of the transfer chamber 410 is about 0.7 inches. The pump is placed in a well at a depth of about 1000 feet and both the product fluid and the power fluid are water.

The fluid in the product cylinder 430, as well as the standing column of water above the pump, exerts a pressure $P_1$ on the transfer piston 420. The downward force acting on the transfer piston 420 is equal to this pressure multiplied by the surface area of the piston upon which it acts, $A_1$. Gravity acting on the weight of the transfer piston 420 also creates a downwards force; however, because the piston of this embodiment is only about 1 to about 2 pounds, its effect may be negligible. The resistance R caused by the friction of the seals also exerts a downward force as the piston 420 is raised.

The force lifting the transfer piston 420 is equal to the power fluid pressure, $P_{pf}$, multiplied by the surface area upon which it acts, $A_3$. In order to lift the transfer piston, the force supplied by the power fluid must be greater than the downward force previously discussed. Therefore, the net force on the piston is given by:

$$F_{net}=F_{up}=F_{down}=P_{pf}A3-P_1A_1-R$$

Although the resistance of the seals can be considered in practice, it is ignored here for the purpose of describing this embodiment. In some embodiments, the ratio of $A_1$ to $A_3$ is between about 1.25 and about 4. In a preferred embodiment, the ratio of $A_1$:$A_3$ is about 2:1. Therefore, $$F_{net}=P_{pf}A_3-P_12A_3$$

In order for this net force to be positive, the pressure of the power fluid $P_{pf}$ must be at least twice as great as the pressure of the standing column, $P_1$. Since the pump is placed at a depth of about 1000 ft, $P_1$ is approximately 445 psi (pounds per square inch). Thus, the power fluid is supplied at least double this pressure, or 890 psi. Because the force exerted by the power fluid is proportional to its density, it can be seen that if a power fluid is utilized that is twice as dense as the water being pumped, the power fluid only needs to be supplied at 445 psi to raise the piston.

When power fluid is supplied at this pressure, the power fluid acts against the inner surface area 452, thereby causing the transfer piston 420 to rise. As the transfer piston 420 lifts against the weight of the fluid in the product chamber 430, the transfer piston valve 426 closes, thereby sealing the transfer piston channel 425. As the transfer piston 420 rises, the fluid in the product chamber 430 is forced out of the pump through the pump outlet 406.

As the transfer piston 420 rises with the transfer piston valve 426 closed, the pressure in the transfer chamber 410 decreases. The pressure drop inside the transfer chamber 410 causes the inlet valve 408 to open, thereby allowing fluid from the source to be drawn through the pump inlet 404 into the transfer chamber 410. As described previously, the inlet holes can be tapered to prevent debris from becoming lodged therein. As illustrated, the inlet valve 408 can be guided by, or alternatively slideably coupled to, the rod portion 424 of the transfer piston 420. The transfer piston 420 rises until the top of the transfer piston 420 reaches a predetermined stopping point, such as when the transfer piston hits the top cap 460, or alternatively until the force generated by the power fluid equals the force generated by the weight of the product fluid and the weight of the transfer piston 420. For the embodiment described above, the top of the piston stroke can be set by decreasing the pressure of the power fluid below 890 psi. When the transfer piston is at the top of its stroke, the transfer chamber is about 6.7 inches in height, resulting in a stroke length of about 6 inches.

Once the transfer piston 420 reaches its highest point, the recovery stroke begins. As illustrated in FIG. 4B, during the recovery stroke the pressure of the power fluid is reduced until the weight of the fluid in the product chamber 430 plus the weight of the transfer piston 420 is greater than the force provided by the power fluid and the fluid in the transfer chamber 410. This causes the transfer piston 420 to fall, thereby increasing the pressure of the trapped fluid in the transfer chamber 410. The increased pressure inside the transfer chamber 410 causes the inlet valve 408 to close and seal the pump inlet 404. As the pressure continues to increase inside the transfer chamber 410, it causes the transfer piston valve 426 to open, and fluid is forced from the transfer chamber 410 to the product chamber 430 via the transfer piston channel 425. Like the pump inlet holes, the transfer piston channel 425 can be tapered to prevent debris from becoming lodged therein. In some embodiments, the transfer piston channel 425 had a diameter that is larger than the diameter of the pump inlet holes, thereby allowing any particles that enter the inlet 404 to pass through the pump 400. The transfer piston 420 continues to fall until the bottom of the rod portion 424 of the transfer piston 420 contacts the bottom of the pumping apparatus, or alternatively until the upwards force generated by the power fluid and the fluid in the transfer chamber 410 equals the downwards force generated by both the weight of the fluid in the product chamber 430 and the weight of the transfer piston 420.

The speed at which the pump operates can be varied as desired. The time required for one "stroke," which is defined as the transfer piston 420 moving from its lowest position, through its highest position and returning to its lowest position, can be set by the operator. For the embodiment described above, wherein the outer diameter of the pump is about 1.5 inches, a preferred speed is about 6 strokes per minute, which provides a displaced volume of about three barrels per day. However, any range of speeds can be utilized depending upon the application. For example, in some embodiments, only one stroke per minute can be preferable. In other applications, speeds of 20 strokes per minute or more can be preferable. The volume of product fluid pumped is determined by the speed of the pump as well as the length of the stroke. Any suitable stroke length can be utilized, including 6, 12, 24, or 36 inches or more.

The operating cycle of the pump 400 is maintained by providing an oscillating pressure to the power fluid. This oscillating pressure can be provided by any suitable method, including any of a number of methods known in the art. Among such methods are those described below and those disclosed in United States Patent Publication No. 2005/0169776-A1, the contents of which are incorporated herein by reference in its entirety.

Figure 5A:
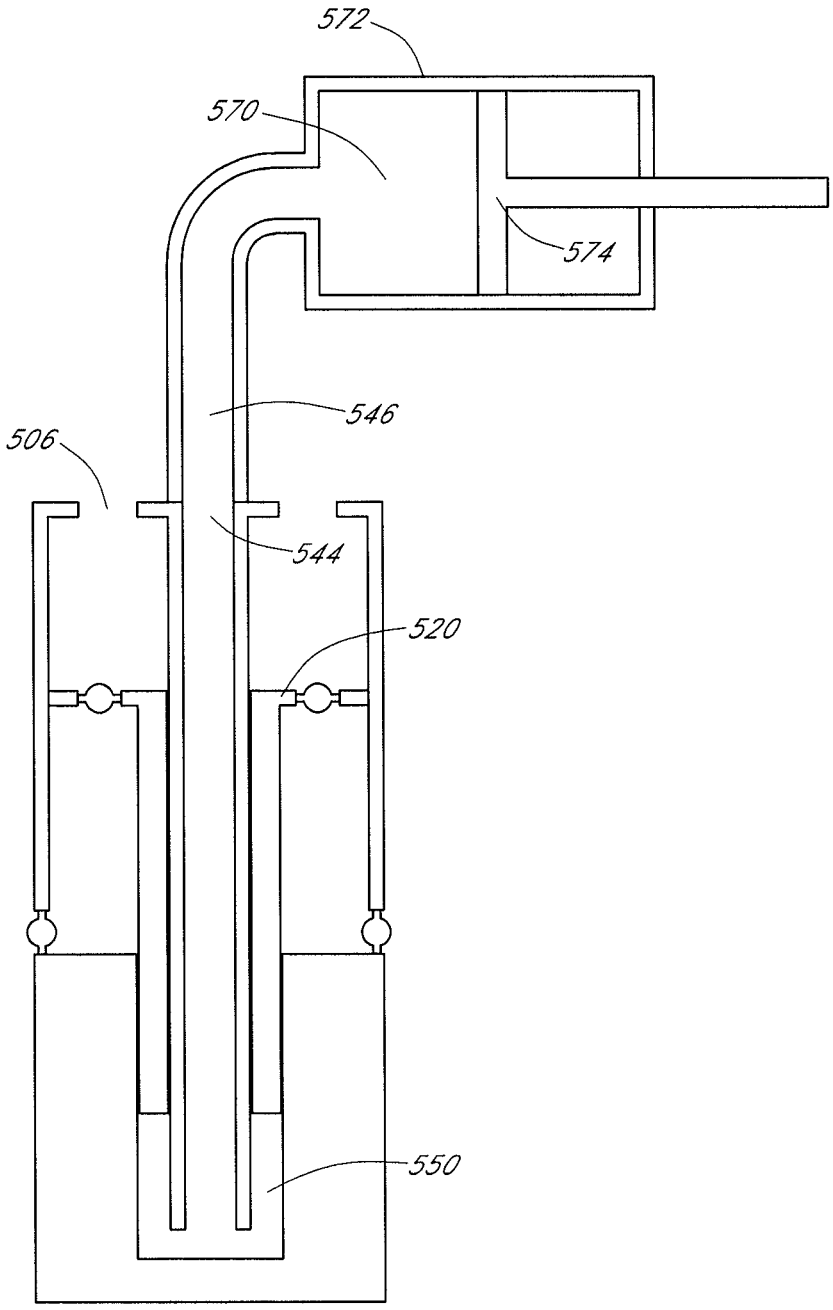
FIG. 5A provides a cross-sectional view of a pump wherein an oscillating pressure is provided by a piston and cylinder system.

For example, as illustrated in FIG. 5A, the oscillating pressure can be provided by a piston and cylinder system, wherein the piston is moved by a motor or engine with a crank mechanism, or a pneumatic or hydraulic device. These systems can be controlled manually, by an electronic timer, by a programmable logic controller ("PLC"), by computer, or by a pendulum. As illustrated in FIG. 5A, a conduit 546 delivers power fluid to the power fluid inlet 544 from a power fluid source 570. The power fluid source 570 comprises a cylinder 572 and a power fluid piston 574. During the power stroke, the power fluid piston 574 moves to the left, forcing power fluid from the power fluid cylinder 572, through the conduit 546, to the power fluid inlet 544. This increases the power fluid pressure inside the power fluid chamber 550, thereby lifting the transfer piston 520. During the recovery stroke, the power fluid piston 574 moves to the right. Power fluid is forced out of the power fluid chamber 550, and the transfer piston 520 lowers.

Figure 5B:
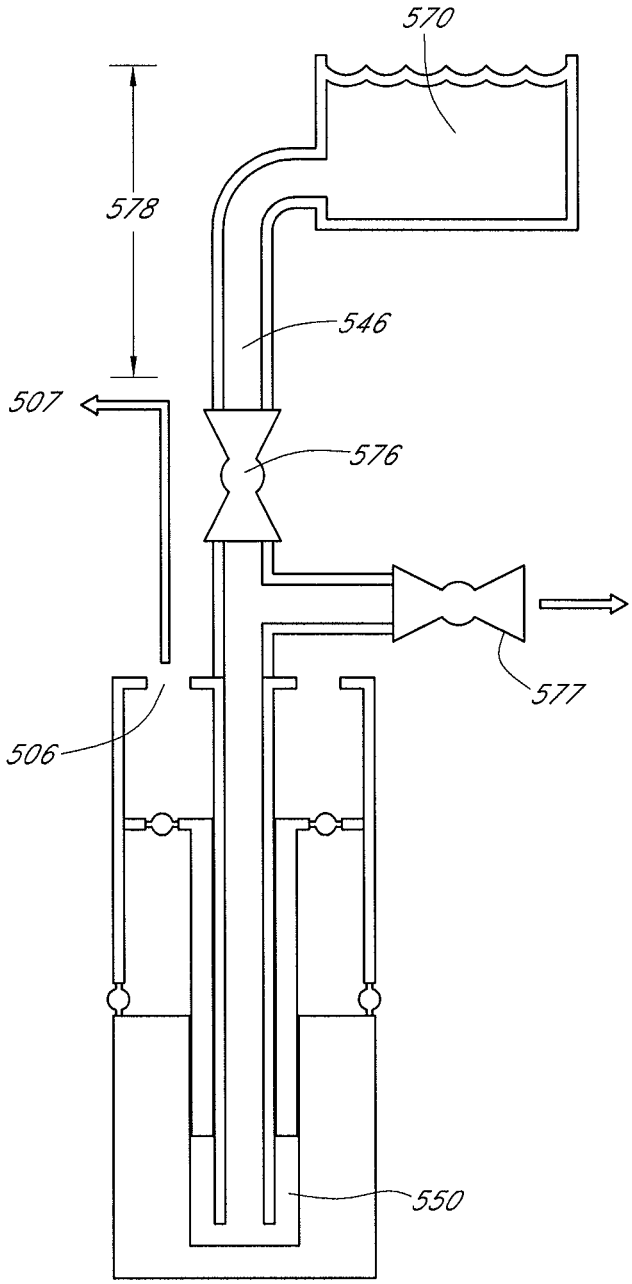
FIG. 5B provides a cross-sectional view of a pump wherein an oscillating pressure is provided by alternating the conduit valve and power release valve.

In some applications, the power fluid in the conduit 546 alone can provide a substantial amount of pressure to the power fluid chamber 550. Accordingly, as illustrated in FIG. 5B, the power source can be a fluid source stored at an elevation that is higher than that where the product fluid is recovered 507. Thus, the difference in elevation 578 provides a natural source of pressure. During the power stroke, a valve 576 in the conduit is opened, allowing power fluid to flow from the power fluid source 570, through the conduit 546, and into the power fluid chamber 550. The difference in elevation 578 alone can cause the transfer piston 520 to rise and pump fluid out of the pump outlet 506 at the recovery elevation 507.

During the recovery stroke, the conduit valve 576, which is located at an elevation that is lower than the recovery elevation 507, is closed and a power fluid release valve 577 is opened. The power fluid release valve 577 is at an elevation that is lower than the elevation of the conduit valve 576. Thus, the power fluid release valve 577 is at an elevation that is lower than the product fluid recovery elevation 507, and the pressure in the pump outlet line forces the transfer piston 520 down and power fluid drains from the power fluid release valve 577.

Accordingly, in the embodiment illustrated in FIG. 5B, the oscillating pressure is provided by alternating the conduit valve 576 and power fluid release valve 577. The differences in elevation can be selected depending on the relative densities of the power fluid and the product fluid.

In some embodiments, the pumping apparatus comprises a power fluid column that is internal to the product fluid. Such a design is advantageous because the power fluid can be supplied at a greater pressure without compromising the structural integrity of the column containing the power fluid. For example, if a pump is 3 inches in diameter, and if the power fluid column is external to the product fluid column, then the diameter of the power fluid column is 3 inches. Since the force (F) exerted by the power fluid on the wall of the power fluid column is determined by multiplying the pressure (P) of the power fluid by the surface area of the column, and the surface area of a cylinder is determined by multiplying the cylinder's circumference by its height, then the force on an externally placed power fluid column is:

$$F_{external}=\pi(\text{diameter})(\text{Pressure})(\text{height})=3P\pi(\text{height})$$

Assuming the same 3 inch diameter pump uses a 1 inch diameter internal power fluid column, the force on the power fluid column is:

$$F_{internal}=\pi(\text{diameter})(\text{pressure})(\text{height})=1P\pi(\text{height})$$

Assuming that the height of the column is the same for each pump, the internally placed power fluid column exerts only one third of the force on the pump material when compared to the externally placed power fluid column. Accordingly, for a pump constructed with a material capable of sustaining a maximum force, the power fluid can be supplied at 3 times the pressure if the power fluid column is internal rather than external.

Similarly, the hoop stress for a thin walled cylinder is equal to the pressure inside the cylinder multiplied by the radius of the cylinder, divided by the wall thickness. Accordingly, as the radius increases, the hoop stress increases linearly. As a result, in applications that require the power fluid to be supplied at significant pressures, such as when pumping fluid from very deep wells, it is preferable to have an internal power fluid column. For example, for a water well at a depth of 10,000 feet, the power fluid can be supplied at a pressure of about 10,000 psi.

Below, Tables 1 through 20 include data compiled from the pumps of the present disclosure. In reference to the pipes of FIG. 5A and FIG. 5B, the data shows that the greater the diameter the conduit 546 the greater the (volume) required in the cylinder 572. The greater cylinder volume is required to compensate for the greater amount of fluid compression loss in the conduit 546. This fluid compression loss is linearly proportional to the volume of the fluid in the conduit 546 for any given drive pressure. Table 1 gives the bulk modulus value of typical hydraulic water-based fluids and volume of fluid contained within different conduit pipes for depths up to 4000 feet. Tables 2 through 10 illustrate the volumes of compression fluid losses for typical hydraulic water-based fluids for given conduits (546) at different depths. Table 2 illustrates the volume of fluid losses for a drive pressure of 500 psi. Table 3 illustrates the volume of fluid losses for a drive pressure of 750 psi, etc. These volumes of water-based hydraulic fluid losses must be compensated by a corresponding increase in volume of the drive cylinder (572). Table 11 gives the bulk modulus value of typical hydraulic oil-based fluids and volume of fluid contained within different conduit pipes for depths up to 4000 feet. Tables 12 through 20 illustrate the volumes of compression fluid losses for typical hydraulic oil-based fluids for given conduits (546) at different depths. Table 12 illustrates the volume of fluid losses for a drive pressure of 500 psi. Table 13 illustrates the volume of fluid losses for a drive pressure of 750 psi, etc. These volumes of oil-based hydraulic fluid losses must be compensated by a corresponding increase in volume of the drive cylinder (572).

TABLE 1

DATA for water
Bulk Modulus = (psi) 300000

| PIPE SIZE/SCHEDULE | OD (in) | OD AREA (in^2) | ID (in) | ID AREA (in^2) | WALL THCK (in) | VOL. @ DEPTH 500 (in^3) | VOL. @ DEPTH 750 (in^3) | VOL. @ DEPTH 1000 (in^3) | VOL. @ DEPTH 1250 (in^3) | VOL. @ DEPTH 1500 (in^3) |
|---|---|---|---|---|---|---|---|---|---|---|
| ⅛" SCH 40 | 0.405 | 0.129 | 0.269 | 0.057 | 0.068 | 340.8 | 511.2 | 681.6 | 852.1 | 1022.5 |
| ¼" SCH 40 | 0.540 | 0.229 | 0.364 | 0.104 | 0.088 | 624.1 | 936.1 | 1248.1 | 1560.1 | 1872.2 |
| ⅜" SCH 40 | 0.675 | 0.358 | 0.493 | 0.191 | 0.091 | 1144.8 | 1717.1 | 2289.5 | 2861.9 | 3434.3 |
| ½" SCH 40 | 0.840 | 0.554 | 0.622 | 0.304 | 0.109 | 1822.2 | 2733.3 | 3644.4 | 4555.6 | 5466.7 |
| ¾" SCH 40 | 1.050 | 0.865 | 0.824 | 0.533 | 0.113 | 3198.0 | 4797.0 | 6396.0 | 7994.9 | 9593.9 |
| 1" SCH 40 | 1.315 | 1.357 | 1.049 | 0.864 | 0.133 | 5182.9 | 7774.3 | 10365.8 | 12957.2 | 15548.7 |
| 1¼" SCH 40 | 1.660 | 2.163 | 1.380 | 1.495 | 0.140 | 8969.7 | 13454.6 | 17939.4 | 22424.3 | 26909.2 |
| 1½" SCH 40 | 1.900 | 2.834 | 1.610 | 2.035 | 0.145 | 12208.8 | 18313.2 | 24417.6 | 30522.0 | 36626.4 |
| ⅛" SCH 80 | 0.405 | 0.129 | 0.215 | 0.036 | 0.095 | 217.7 | 326.6 | 435.4 | 544.3 | 653.2 |
| ¼" SCH 80 | 0.540 | 0.229 | 0.302 | 0.072 | 0.119 | 429.6 | 644.4 | 859.1 | 1073.9 | 1288.7 |
| ⅜" SCH 80 | 0.675 | 0.358 | 0.423 | 0.140 | 0.126 | 842.8 | 1264.1 | 1685.5 | 2106.9 | 2528.3 |
| ½" SCH 80 | 0.840 | 0.554 | 0.546 | 0.234 | 0.147 | 1404.1 | 2106.2 | 2808.3 | 3510.3 | 4212.4 |
| ¾" SCH 80 | 1.050 | 0.865 | 0.742 | 0.432 | 0.154 | 2593.2 | 3889.7 | 5186.3 | 6482.9 | 7779.5 |
| 1" SCH 80 | 1.315 | 1.357 | 0.957 | 0.719 | 0.179 | 4313.6 | 6470.5 | 8627.3 | 10784.1 | 12940.9 |
| 1¼" SCH 80 | 1.660 | 2.163 | 1.278 | 1.282 | 0.191 | 7692.8 | 11539.2 | 15385.5 | 19231.9 | 23078.3 |

TABLE 1-continued

DATA for water
Bulk Modulus = (psi) 300000

| | | | | | | | | | | |
|---|---|---|---|---|---|---|---|---|---|---|
| 1½" SCH 80 | 1.900 | 2.834 | 1.500 | 1.766 | 0.200 | 10597.5 | 15896.3 | 21195.0 | 26493.8 | 31792.5 |
| ½" SCH 160 | 0.840 | 0.554 | 0.464 | 0.169 | 0.188 | 1014.0 | 1521.1 | 2028.1 | 2535.1 | 3042.1 |
| ¾" SCH 160 | 1.050 | 0.865 | 0.612 | 0.294 | 0.219 | 1764.1 | 2646.2 | 3528.2 | 4410.3 | 5292.3 |
| 1" SCH 160 | 1.315 | 1.357 | 0.815 | 0.521 | 0.250 | 3128.5 | 4692.7 | 6257.0 | 7821.2 | 9385.5 |
| 1¼" SCH 160 | 1.660 | 2.163 | 1.160 | 1.056 | 0.250 | 6337.8 | 9506.7 | 12675.6 | 15844.4 | 19013.3 |
| 1½" SCH 160 | 1.900 | 2.834 | 1.338 | 1.405 | 0.281 | 8432.0 | 12648.1 | 16864.1 | 21080.1 | 25296.1 |

| PIPE SIZE/SCHEDULE | OD (in) | OD AREA (in^2) | ID (in) | ID AREA (in^2) | WALL THCK (in) | VOL. @ DEPTH 1750 (in^3) | VOL. @ DEPTH 2000 (in^3) | VOL. @ DEPTH 2250 (in^3) | VOL. @ DEPTH 2500 (in^3) | VOL. @ DEPTH 2750 (in^3) |
|---|---|---|---|---|---|---|---|---|---|---|
| ⅛" SCH 40 | 0.405 | 0.129 | 0.269 | 0.057 | 0.068 | 1192.9 | 1363.3 | 1533.7 | 1704.1 | 1874.5 |
| ¼" SCH 40 | 0.540 | 0.229 | 0.364 | 0.104 | 0.088 | 2184.2 | 2496.2 | 2808.3 | 3120.3 | 3432.3 |
| ⅜" SCH 40 | 0.675 | 0.358 | 0.493 | 0.191 | 0.091 | 4006.7 | 4579.0 | 5151.4 | 5723.8 | 6296.2 |
| ½" SCH 40 | 0.840 | 0.554 | 0.622 | 0.304 | 0.109 | 6377.8 | 7288.9 | 8200.0 | 9111.1 | 10022.2 |
| ¾" SCH 40 | 1.050 | 0.865 | 0.824 | 0.533 | 0.113 | 11192.9 | 12791.9 | 14390.9 | 15989.9 | 17588.9 |
| 1" SCH 40 | 1.315 | 1.357 | 1.049 | 0.864 | 0.133 | 18140.1 | 20731.6 | 23323.0 | 25914.4 | 28505.9 |
| 1¼" SCH 40 | 1.660 | 2.163 | 1.380 | 1.495 | 0.140 | 31394.0 | 35878.9 | 40363.8 | 44848.6 | 49333.5 |
| 1½" SCH 40 | 1.900 | 2.834 | 1.610 | 2.035 | 0.145 | 42730.8 | 48835.2 | 54939.6 | 61044.0 | 67148.4 |
| ⅛" SCH 80 | 0.405 | 0.129 | 0.215 | 0.036 | 0.095 | 762.0 | 870.9 | 979.7 | 1088.6 | 1197.5 |
| ¼" SCH 80 | 0.540 | 0.229 | 0.302 | 0.072 | 0.119 | 1503.5 | 1718.3 | 1933.1 | 2147.9 | 2362.6 |
| ⅜" SCH 80 | 0.675 | 0.358 | 0.423 | 0.140 | 0.126 | 2949.6 | 3371.0 | 3792.4 | 4213.8 | 4635.2 |
| ½" SCH 80 | 0.840 | 0.554 | 0.546 | 0.234 | 0.147 | 4914.4 | 5616.5 | 6318.6 | 7020.6 | 7722.7 |
| ¾" SCH 80 | 1.050 | 0.865 | 0.742 | 0.432 | 0.154 | 9076.0 | 10372.6 | 11669.2 | 12965.8 | 14262.4 |
| 1" SCH 80 | 1.315 | 1.357 | 0.957 | 0.719 | 0.179 | 15097.8 | 17254.6 | 19411.4 | 21568.2 | 23725.1 |
| 1¼" SCH 80 | 1.660 | 2.163 | 1.278 | 1.282 | 0.191 | 26924.7 | 30771.1 | 34617.5 | 38463.8 | 42310.2 |
| 1½" SCH 80 | 1.900 | 2.834 | 1.500 | 1.766 | 0.200 | 37091.3 | 42390.0 | 47688.8 | 52987.5 | 58286.3 |
| ½" SCH 160 | 0.840 | 0.554 | 0.464 | 0.169 | 0.188 | 3549.2 | 4056.2 | 4563.2 | 5070.2 | 5577.2 |
| ¾" SCH 160 | 1.050 | 0.865 | 0.612 | 0.294 | 0.219 | 6174.4 | 7056.4 | 7938.5 | 8820.5 | 9702.6 |
| 1" SCH 160 | 1.315 | 1.357 | 0.815 | 0.521 | 0.250 | 10949.7 | 12514.0 | 14078.2 | 15642.5 | 17206.7 |
| 1¼" SCH 160 | 1.660 | 2.163 | 1.160 | 1.056 | 0.250 | 22182.2 | 25351.1 | 28520.0 | 31688.9 | 34857.8 |
| 1½" SCH 160 | 1.900 | 2.834 | 1.338 | 1.405 | 0.281 | 29512.2 | 33728.2 | 37944.2 | 42160.2 | 46376.3 |

| PIPE SIZE/SCHEDULE | OD (in) | OD AREA (in^2) | ID (in) | ID AREA (in^2) | WALL THCK (in) | VOL. @ DEPTH 3000 (in^3) | VOL. @ DEPTH 3250 (in^3) | VOL. @ DEPTH 3500 (in^3) | VOL. @ DEPTH 3750 (in^3) | VOL. @ DEPTH 4000 (in^3) |
|---|---|---|---|---|---|---|---|---|---|---|
| ⅛" SCH 40 | 0.405 | 0.129 | 0.269 | 0.057 | 0.068 | 2044.9 | 2215.3 | 2385.7 | 2556.2 | 2726.6 |
| ¼" SCH 40 | 0.540 | 0.229 | 0.364 | 0.104 | 0.088 | 3744.3 | 4056.4 | 4368.4 | 4680.4 | 4992.4 |
| ⅜" SCH 40 | 0.675 | 0.358 | 0.493 | 0.191 | 0.091 | 6868.6 | 7440.9 | 8013.3 | 8585.7 | 9158.1 |
| ½" SCH 40 | 0.840 | 0.554 | 0.622 | 0.304 | 0.109 | 10933.3 | 11844.5 | 12755.6 | 13666.7 | 14577.8 |
| ¾" SCH 40 | 1.050 | 0.865 | 0.824 | 0.533 | 0.113 | 19187.9 | 20786.9 | 22385.8 | 23984.8 | 25583.8 |
| 1" SCH 40 | 1.315 | 1.357 | 1.049 | 0.864 | 0.133 | 31097.3 | 33688.8 | 36280.2 | 38871.7 | 41463.1 |
| 1¼" SCH 40 | 1.660 | 2.163 | 1.380 | 1.495 | 0.140 | 53818.3 | 58303.2 | 62788.1 | 67272.9 | 71757.8 |
| 1½" SCH 40 | 1.900 | 2.834 | 1.610 | 2.035 | 0.145 | 73252.7 | 79357.1 | 85461.5 | 91565.9 | 97670.3 |
| ⅛" SCH 80 | 0.405 | 0.129 | 0.215 | 0.036 | 0.095 | 1306.3 | 1415.2 | 1524.0 | 1632.9 | 1741.8 |
| ¼" SCH 80 | 0.540 | 0.229 | 0.302 | 0.072 | 0.119 | 2577.4 | 2792.2 | 3007.0 | 3221.8 | 3436.6 |
| ⅜" SCH 80 | 0.675 | 0.358 | 0.423 | 0.140 | 0.126 | 5056.5 | 5477.9 | 5899.3 | 6320.7 | 6742.0 |
| ½" SCH 80 | 0.840 | 0.554 | 0.546 | 0.234 | 0.147 | 8424.8 | 9126.8 | 9828.9 | 10530.9 | 11233.0 |
| ¾" SCH 80 | 1.050 | 0.865 | 0.742 | 0.432 | 0.154 | 15558.9 | 16855.5 | 18152.1 | 19448.7 | 20745.3 |
| 1" SCH 80 | 1.315 | 1.357 | 0.957 | 0.719 | 0.179 | 25881.9 | 28038.7 | 30195.5 | 32352.4 | 34509.2 |
| 1¼" SCH 80 | 1.660 | 2.163 | 1.278 | 1.282 | 0.191 | 46156.6 | 50003.0 | 53849.4 | 57695.8 | 61542.1 |
| 1½" SCH 80 | 1.900 | 2.834 | 1.500 | 1.766 | 0.200 | 63585.0 | 68883.8 | 74182.5 | 79481.3 | 84780.0 |
| ½" SCH 160 | 0.840 | 0.554 | 0.464 | 0.169 | 0.188 | 6084.3 | 6591.3 | 7098.3 | 7605.3 | 8112.4 |
| ¾" SCH 160 | 1.050 | 0.865 | 0.612 | 0.294 | 0.219 | 10584.6 | 11466.7 | 12348.7 | 13230.8 | 14112.8 |
| 1" SCH 160 | 1.315 | 1.357 | 0.815 | 0.521 | 0.250 | 18771.0 | 20335.2 | 21899.5 | 23463.7 | 25028.0 |
| 1¼" SCH 160 | 1.660 | 2.163 | 1.160 | 1.056 | 0.250 | 38026.7 | 41195.5 | 44364.4 | 47533.3 | 50702.2 |
| 1½" SCH 160 | 1.900 | 2.834 | 1.338 | 1.405 | 0.281 | 50592.3 | 54808.3 | 59024.3 | 63240.4 | 67456.4 |

TABLE 2

Drive Delta-P = (psi) 500

| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) | DRIVE VOLUME LOSS @ 2250' (in^3) |
|---|---|---|---|---|---|---|---|---|
| ⅛" SCH 40 | 0.6 | 0.9 | 1.1 | 1.4 | 1.7 | 2.0 | 2.3 | 2.6 |
| ¼" SCH 40 | 1.0 | 1.6 | 2.1 | 2.6 | 3.1 | 3.6 | 4.2 | 4.7 |
| ⅜" SCH 40 | 1.9 | 2.9 | 3.8 | 4.8 | 5.7 | 6.7 | 7.6 | 8.6 |

TABLE 2-continued

| Drive Delta-P = (psi) 500 | | | | | | | | |
|---|---|---|---|---|---|---|---|---|
| ½" SCH 40 | 3.0 | 4.6 | 6.1 | 7.6 | 9.1 | 10.6 | 12.1 | 13.7 |
| ¾" SCH 40 | 5.3 | 8.0 | 10.7 | 13.3 | 16.0 | 18.7 | 21.3 | 24.0 |
| 1" SCH 40 | 8.6 | 13.0 | 17.3 | 21.6 | 25.9 | 30.2 | 34.6 | 38.9 |
| 1¼" SCH 40 | 14.9 | 22.4 | 29.9 | 37.4 | 44.8 | 52.3 | 59.8 | 67.3 |
| 1½" SCH 40 | 20.3 | 30.5 | 40.7 | 50.9 | 61.0 | 71.2 | 81.4 | 91.6 |
| ⅛" SCH 80 | 0.4 | 0.5 | 0.7 | 0.9 | 1.1 | 1.3 | 1.5 | 1.6 |
| ¼" SCH 80 | 0.7 | 1.1 | 1.4 | 1.8 | 2.1 | 2.5 | 2.9 | 3.2 |
| ⅜" SCH 80 | 1.4 | 2.1 | 2.8 | 3.5 | 4.2 | 4.9 | 5.6 | 6.3 |
| ½" SCH 80 | 2.3 | 3.5 | 4.7 | 5.9 | 7.0 | 8.2 | 9.4 | 10.5 |
| ¾" SCH 80 | 4.3 | 6.5 | 8.6 | 10.8 | 13.0 | 15.1 | 17.3 | 19.4 |
| 1" SCH 80 | 7.2 | 10.8 | 14.4 | 18.0 | 21.6 | 25.2 | 28.8 | 32.4 |
| 1¼" SCH 80 | 12.8 | 19.2 | 25.6 | 32.1 | 38.5 | 44.9 | 51.3 | 57.7 |
| 1½" SCH 80 | 17.7 | 26.5 | 35.3 | 44.2 | 53.0 | 61.8 | 70.7 | 79.5 |
| ½" SCH 160 | 1.7 | 2.5 | 3.4 | 4.2 | 5.1 | 5.9 | 6.8 | 7.6 |
| ¾" SCH 160 | 2.9 | 4.4 | 5.9 | 7.4 | 8.8 | 10.3 | 11.8 | 13.2 |
| 1" SCH 160 | 5.2 | 7.8 | 10.4 | 13.0 | 15.6 | 18.2 | 20.9 | 23.5 |
| 1¼" SCH 160 | 10.6 | 15.8 | 21.1 | 26.4 | 31.7 | 37.0 | 42.3 | 47.5 |
| 1½" SCH 160 | 14.1 | 21.1 | 28.1 | 35.1 | 42.2 | 49.2 | 56.2 | 63.2 |

| PIPE SIZE/SCHEDULE | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|
| ⅛" SCH 40 | 2.8 | 3.1 | 3.4 | 3.7 | 4.0 | 4.3 | 4.5 |
| ¼" SCH 40 | 5.2 | 5.7 | 6.2 | 6.8 | 7.3 | 7.8 | 8.3 |
| ⅜" SCH 40 | 9.5 | 10.5 | 11.4 | 12.4 | 13.4 | 14.3 | 15.3 |
| ½" SCH 40 | 15.2 | 16.7 | 18.2 | 19.7 | 21.3 | 22.8 | 24.3 |
| ¾" SCH 40 | 26.6 | 29.3 | 32.0 | 34.6 | 37.3 | 40.0 | 42.6 |
| 1" SCH 40 | 43.2 | 47.5 | 51.8 | 56.1 | 60.5 | 64.8 | 69.1 |
| 1¼" SCH 40 | 74.7 | 82.2 | 89.7 | 97.2 | 104.6 | 112.1 | 119.6 |
| 1½" SCH 40 | 101.7 | 111.9 | 122.1 | 132.3 | 142.4 | 152.6 | 162.8 |
| ⅛" SCH 80 | 1.8 | 2.0 | 2.2 | 2.4 | 2.5 | 2.7 | 2.9 |
| ¼" SCH 80 | 3.6 | 3.9 | 4.3 | 4.7 | 5.0 | 5.4 | 5.7 |
| ⅜" SCH 80 | 7.0 | 7.7 | 8.4 | 9.1 | 9.8 | 10.5 | 11.2 |
| ½" SCH 80 | 11.7 | 12.9 | 14.0 | 15.2 | 16.4 | 17.6 | 18.7 |
| ¾" SCH 80 | 21.6 | 23.8 | 25.9 | 28.1 | 30.3 | 32.4 | 34.6 |
| 1" SCH 80 | 35.9 | 39.5 | 43.1 | 46.7 | 50.3 | 53.9 | 57.5 |
| 1¼" SCH 80 | 64.1 | 70.5 | 76.9 | 83.3 | 89.7 | 96.2 | 102.6 |
| 1½" SCH 80 | 88.3 | 97.1 | 106.0 | 114.8 | 123.6 | 132.5 | 141.3 |
| ½" SCH 160 | 8.5 | 9.3 | 10.1 | 11.0 | 11.8 | 12.7 | 13.5 |
| ¾" SCH 160 | 14.7 | 16.2 | 17.6 | 19.1 | 20.6 | 22.1 | 23.5 |
| 1" SCH 160 | 26.1 | 28.7 | 31.3 | 33.9 | 36.5 | 39.1 | 41.7 |
| 1¼" SCH 160 | 52.8 | 58.1 | 63.4 | 68.7 | 73.9 | 79.2 | 84.5 |
| 1½" SCH 160 | 70.3 | 77.3 | 84.3 | 91.3 | 98.4 | 105.4 | 112.4 |

TABLE 3

| Drive Delta-P = (psi) 750 | | | | | | | | |
|---|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) | DRIVE VOLUME LOSS @ 2250' (in^3) |
| ⅛" SCH 40 | 0.9 | 1.3 | 1.7 | 2.1 | 2.6 | 3.0 | 3.4 | 3.8 |
| ¼" SCH 40 | 1.6 | 2.3 | 3.1 | 3.9 | 4.7 | 5.5 | 6.2 | 7.0 |
| ⅜" SCH 40 | 2.9 | 4.3 | 5.7 | 7.2 | 8.6 | 10.0 | 11.4 | 12.9 |
| ½" SCH 40 | 4.6 | 6.8 | 9.1 | 11.4 | 13.7 | 15.9 | 18.2 | 20.5 |
| ¾" SCH 40 | 8.0 | 12.0 | 16.0 | 20.0 | 24.0 | 28.0 | 32.0 | 36.0 |
| 1" SCH 40 | 13.0 | 19.4 | 25.9 | 32.4 | 38.9 | 45.4 | 51.8 | 58.3 |
| 1¼" SCH 40 | 22.4 | 33.6 | 44.8 | 56.1 | 67.3 | 78.5 | 89.7 | 100.9 |
| 1½" SCH 40 | 30.5 | 45.8 | 61.0 | 76.3 | 91.6 | 106.8 | 122.1 | 137.3 |
| ⅛" SCH 80 | 0.5 | 0.8 | 1.1 | 1.4 | 1.6 | 1.9 | 2.2 | 2.4 |
| ¼" SCH 80 | 1.1 | 1.6 | 2.1 | 2.7 | 3.2 | 3.8 | 4.3 | 4.8 |
| ⅜" SCH 80 | 2.1 | 3.2 | 4.2 | 5.3 | 6.3 | 7.4 | 8.4 | 9.5 |
| ½" SCH 80 | 3.5 | 5.3 | 7.0 | 8.8 | 10.5 | 12.3 | 14.0 | 15.8 |
| ¾" SCH 80 | 6.5 | 9.7 | 13.0 | 16.2 | 19.4 | 22.7 | 25.9 | 29.2 |
| 1" SCH 80 | 10.8 | 16.2 | 21.6 | 27.0 | 32.4 | 37.7 | 43.1 | 48.5 |
| 1¼" SCH 80 | 19.2 | 28.8 | 38.5 | 48.1 | 57.7 | 67.3 | 76.9 | 86.5 |
| 1½" SCH 80 | 26.5 | 39.7 | 53.0 | 66.2 | 79.5 | 92.7 | 106.0 | 119.2 |
| ½" SCH 160 | 2.5 | 3.8 | 5.1 | 6.3 | 7.6 | 8.9 | 10.1 | 11.4 |
| ¾" SCH 160 | 4.4 | 6.6 | 8.8 | 11.0 | 13.2 | 15.4 | 17.6 | 19.8 |

TABLE 3-continued

| Drive Delta-P = (psi) 750 | | | | | | | | |
|---|---|---|---|---|---|---|---|---|
| 1" SCH 160 | 7.8 | 11.7 | 15.6 | 19.6 | 23.5 | 27.4 | 31.3 | 35.2 |
| 1¼" SCH 160 | 15.8 | 23.8 | 31.7 | 39.6 | 47.5 | 55.5 | 63.4 | 71.3 |
| 1½" SCH 160 | 21.1 | 31.6 | 42.2 | 52.7 | 63.2 | 73.8 | 84.3 | 94.9 |

| PIPE SIZE/SCHEDULE | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|
| ⅛" SCH 40 | 4.3 | 4.7 | 5.1 | 5.5 | 6.0 | 6.4 | 6.8 |
| ¼" SCH 40 | 7.8 | 8.6 | 9.4 | 10.1 | 10.9 | 11.7 | 12.5 |
| ⅜" SCH 40 | 14.3 | 15.7 | 17.2 | 18.6 | 20.0 | 21.5 | 22.9 |
| ½" SCH 40 | 22.8 | 25.1 | 27.3 | 29.6 | 31.9 | 34.2 | 36.4 |
| ¾" SCH 40 | 40.0 | 44.0 | 48.0 | 52.0 | 56.0 | 60.0 | 64.0 |
| 1" SCH 40 | 64.8 | 71.3 | 77.7 | 84.2 | 90.7 | 97.2 | 103.7 |
| 1¼" SCH 40 | 112.1 | 123.3 | 134.5 | 145.8 | 157.0 | 168.2 | 179.4 |
| 1½" SCH 40 | 152.6 | 167.9 | 183.1 | 198.4 | 213.7 | 228.9 | 244.2 |
| ⅛" SCH 80 | 2.7 | 3.0 | 3.3 | 3.5 | 3.8 | 4.1 | 4.4 |
| ¼" SCH 80 | 5.4 | 5.9 | 6.4 | 7.0 | 7.5 | 8.1 | 8.6 |
| ⅜" SCH 80 | 10.5 | 11.6 | 12.6 | 13.7 | 14.7 | 15.8 | 16.9 |
| ½" SCH 80 | 17.6 | 19.3 | 21.1 | 22.8 | 24.6 | 26.3 | 28.1 |
| ¾" SCH 80 | 32.4 | 35.7 | 38.9 | 42.1 | 45.4 | 48.6 | 51.9 |
| 1" SCH 80 | 53.9 | 59.3 | 64.7 | 70.1 | 75.5 | 80.9 | 86.3 |
| 1¼" SCH 80 | 96.2 | 105.8 | 115.4 | 125.0 | 134.6 | 144.2 | 153.9 |
| 1½" SCH 80 | 132.5 | 145.7 | 159.0 | 172.2 | 185.5 | 198.7 | 212.0 |
| ½" SCH 160 | 12.7 | 13.9 | 15.2 | 16.5 | 17.7 | 19.0 | 20.3 |
| ¾" SCH 160 | 22.1 | 24.3 | 26.5 | 28.7 | 30.9 | 33.1 | 35.3 |
| 1" SCH 160 | 39.1 | 43.0 | 46.9 | 50.8 | 54.7 | 58.7 | 62.6 |
| 1¼" SCH 160 | 79.2 | 87.1 | 95.1 | 103.0 | 110.9 | 118.8 | 126.8 |
| 1½" SCH 160 | 105.4 | 115.9 | 126.5 | 137.0 | 147.6 | 158.1 | 168.6 |

TABLE 4

Drive Delta-P = (psi) 1000

| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
|---|---|---|---|---|---|---|---|
| ⅛" SCH 40 | 1.1 | 1.7 | 2.3 | 2.8 | 3.4 | 4.0 | 4.5 |
| ¼" SCH 40 | 2.1 | 3.1 | 4.2 | 5.2 | 6.2 | 7.3 | 8.3 |
| ⅜" SCH 40 | 3.8 | 5.7 | 7.6 | 9.5 | 11.4 | 13.4 | 15.3 |
| ½" SCH 40 | 6.1 | 9.1 | 12.1 | 15.2 | 18.2 | 21.3 | 24.3 |
| ¾" SCH 40 | 10.7 | 16.0 | 21.3 | 26.6 | 32.0 | 37.3 | 42.6 |
| 1" SCH 40 | 17.3 | 25.9 | 34.6 | 43.2 | 51.8 | 60.5 | 69.1 |
| 1¼" SCH 40 | 29.9 | 44.8 | 59.8 | 74.7 | 89.7 | 104.6 | 119.6 |
| 1½" SCH 40 | 40.7 | 61.0 | 81.4 | 101.7 | 122.1 | 142.4 | 162.8 |
| ⅛" SCH 80 | 0.7 | 1.1 | 1.5 | 1.8 | 2.2 | 2.5 | 2.9 |
| ¼" SCH 80 | 1.4 | 2.1 | 2.9 | 3.6 | 4.3 | 5.0 | 5.7 |
| ⅜" SCH 80 | 2.8 | 4.2 | 5.6 | 7.0 | 8.4 | 9.8 | 11.2 |
| ½" SCH 80 | 4.7 | 7.0 | 9.4 | 11.7 | 14.0 | 16.4 | 18.7 |
| ¾" SCH 80 | 8.6 | 13.0 | 17.3 | 21.6 | 25.9 | 30.3 | 34.6 |
| 1" SCH 80 | 14.4 | 21.6 | 28.8 | 35.9 | 43.1 | 50.3 | 57.5 |
| 1¼" SCH 80 | 25.6 | 38.5 | 51.3 | 64.1 | 76.9 | 89.7 | 102.6 |
| 1½" SCH 80 | 35.3 | 53.0 | 70.7 | 88.3 | 106.0 | 123.6 | 141.3 |
| ½" SCH 160 | 3.4 | 5.1 | 6.8 | 8.5 | 10.1 | 11.8 | 13.5 |
| ¾" SCH 160 | 5.9 | 8.8 | 11.8 | 14.7 | 17.6 | 20.6 | 23.5 |
| 1" SCH 160 | 10.4 | 15.6 | 20.9 | 26.1 | 31.3 | 36.5 | 41.7 |
| 1¼" SCH 160 | 21.1 | 31.7 | 42.3 | 52.8 | 63.4 | 73.9 | 84.5 |
| 1½" SCH 160 | 28.1 | 42.2 | 56.2 | 70.3 | 84.3 | 98.4 | 112.4 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 5.1 | 5.7 | 6.2 | 6.8 | 7.4 | 8.0 | 8.5 | 9.1 |
| ¼" SCH 40 | 9.4 | 10.4 | 11.4 | 12.5 | 13.5 | 14.6 | 15.6 | 16.6 |
| ⅜" SCH 40 | 17.2 | 19.1 | 21.0 | 22.9 | 24.8 | 26.7 | 28.6 | 30.5 |
| ½" SCH 40 | 27.3 | 30.4 | 33.4 | 36.4 | 39.5 | 42.5 | 45.6 | 48.6 |
| ¾" SCH 40 | 48.0 | 53.3 | 58.6 | 64.0 | 69.3 | 74.6 | 79.9 | 85.3 |

TABLE 4-continued

| Drive Delta-P = (psi) 1000 | | | | | | | | |
|---|---|---|---|---|---|---|---|---|
| 1" SCH 40 | 77.7 | 86.4 | 95.0 | 103.7 | 112.3 | 120.9 | 129.6 | 138.2 |
| 1¼" SCH 40 | 134.5 | 149.5 | 164.4 | 179.4 | 194.3 | 209.3 | 224.2 | 239.2 |
| 1½" SCH 40 | 183.1 | 203.5 | 223.8 | 244.2 | 264.5 | 284.9 | 305.2 | 325.6 |
| ⅛" SCH 80 | 3.3 | 3.6 | 4.0 | 4.4 | 4.7 | 5.1 | 5.4 | 5.8 |
| ¼" SCH 80 | 6.4 | 7.2 | 7.9 | 8.6 | 9.3 | 10.0 | 10.7 | 11.5 |
| ⅜" SCH 80 | 12.6 | 14.0 | 15.5 | 16.9 | 18.3 | 19.7 | 21.1 | 22.5 |
| ½" SCH 80 | 21.1 | 23.4 | 25.7 | 28.1 | 30.4 | 32.8 | 35.1 | 37.4 |
| ¾" SCH 80 | 38.9 | 43.2 | 47.5 | 51.9 | 56.2 | 60.5 | 64.8 | 69.2 |
| 1" SCH 80 | 64.7 | 71.9 | 79.1 | 86.3 | 93.5 | 100.7 | 107.8 | 115.0 |
| 1¼" SCH 80 | 115.4 | 128.2 | 141.0 | 153.9 | 166.7 | 179.5 | 192.3 | 205.1 |
| 1½" SCH 80 | 159.0 | 176.6 | 194.3 | 212.0 | 229.6 | 247.3 | 264.9 | 282.6 |
| ½" SCH 160 | 15.2 | 16.9 | 18.6 | 20.3 | 22.0 | 23.7 | 25.4 | 27.0 |
| ¾" SCH 160 | 26.5 | 29.4 | 32.3 | 35.3 | 38.2 | 41.2 | 44.1 | 47.0 |
| 1" SCH 160 | 46.9 | 52.1 | 57.4 | 62.6 | 67.8 | 73.0 | 78.2 | 83.4 |
| 1¼" SCH 160 | 95.1 | 105.6 | 116.2 | 126.8 | 137.3 | 147.9 | 158.4 | 169.0 |
| 1½" SCH 160 | 126.5 | 140.5 | 154.6 | 168.6 | 182.7 | 196.7 | 210.8 | 224.9 |

TABLE 5

| Drive Delta-P = (psi) 1250 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 1.4 | 2.1 | 2.8 | 3.6 | 4.3 | 5.0 | 5.7 |
| ¼" SCH 40 | 2.6 | 3.9 | 5.2 | 6.5 | 7.8 | 9.1 | 10.4 |
| ⅜" SCH 40 | 4.8 | 7.2 | 9.5 | 11.9 | 14.3 | 16.7 | 19.1 |
| ½" SCH 40 | 7.6 | 11.4 | 15.2 | 19.0 | 22.8 | 26.6 | 30.4 |
| ¾" SCH 40 | 13.3 | 20.0 | 26.6 | 33.3 | 40.0 | 46.6 | 53.3 |
| 1" SCH 40 | 21.6 | 32.4 | 43.2 | 54.0 | 64.8 | 75.6 | 86.4 |
| 1¼" SCH 40 | 37.4 | 56.1 | 74.7 | 93.4 | 112.1 | 130.8 | 149.5 |
| 1½" SCH 40 | 50.9 | 76.3 | 101.7 | 127.2 | 152.6 | 178.0 | 203.5 |
| ⅛" SCH 80 | 0.9 | 1.4 | 1.8 | 2.3 | 2.7 | 3.2 | 3.6 |
| ¼" SCH 80 | 1.8 | 2.7 | 3.6 | 4.5 | 5.4 | 6.3 | 7.2 |
| ⅜" SCH 80 | 3.5 | 5.3 | 7.0 | 8.8 | 10.5 | 12.3 | 14.0 |
| ½" SCH 80 | 5.9 | 8.8 | 11.7 | 14.6 | 17.6 | 20.5 | 23.4 |
| ¾" SCH 80 | 10.8 | 16.2 | 21.6 | 27.0 | 32.4 | 37.8 | 43.2 |
| 1" SCH 80 | 18.0 | 27.0 | 35.9 | 44.9 | 53.9 | 62.9 | 71.9 |
| 1¼" SCH 80 | 32.1 | 48.1 | 64.1 | 80.1 | 96.2 | 112.2 | 128.2 |
| 1½" SCH 80 | 44.2 | 66.2 | 88.3 | 110.4 | 132.5 | 154.5 | 176.6 |
| ½" SCH 160 | 4.2 | 6.3 | 8.5 | 10.6 | 12.7 | 14.8 | 16.9 |
| ¾" SCH 160 | 7.4 | 11.0 | 14.7 | 18.4 | 22.1 | 25.7 | 29.4 |
| 1" SCH 160 | 13.0 | 19.6 | 26.1 | 32.6 | 39.1 | 45.6 | 52.1 |
| 1¼" SCH 160 | 26.4 | 39.6 | 52.8 | 66.0 | 79.2 | 92.4 | 105.6 |
| 1½" SCH 160 | 35.1 | 52.7 | 70.3 | 87.8 | 105.4 | 123.0 | 140.5 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 6.4 | 7.1 | 7.8 | 8.5 | 9.2 | 9.9 | 10.7 | 11.4 |
| ¼" SCH 40 | 11.7 | 13.0 | 14.3 | 15.6 | 16.9 | 18.2 | 19.5 | 20.8 |
| ⅜" SCH 40 | 21.5 | 23.8 | 26.2 | 28.6 | 31.0 | 33.4 | 35.8 | 38.2 |
| ½" SCH 40 | 34.2 | 38.0 | 41.8 | 45.6 | 49.4 | 53.1 | 56.9 | 60.7 |
| ¾" SCH 40 | 60.0 | 66.6 | 73.3 | 79.9 | 86.6 | 93.3 | 99.9 | 106.6 |
| 1" SCH 40 | 97.2 | 108.0 | 118.8 | 129.6 | 140.4 | 151.2 | 162.0 | 172.8 |
| 1¼" SCH 40 | 168.2 | 186.9 | 205.6 | 224.2 | 242.9 | 261.6 | 280.3 | 299.0 |
| 1½" SCH 40 | 228.9 | 254.3 | 279.8 | 305.2 | 330.7 | 356.1 | 381.5 | 407.0 |
| ⅛" SCH 80 | 4.1 | 4.5 | 5.0 | 5.4 | 5.9 | 6.4 | 6.8 | 7.3 |
| ¼" SCH 80 | 8.1 | 8.9 | 9.8 | 10.7 | 11.6 | 12.5 | 13.4 | 14.3 |
| ⅜" SCH 80 | 15.8 | 17.6 | 19.3 | 21.1 | 22.8 | 24.6 | 26.3 | 28.1 |
| ½" SCH 80 | 26.3 | 29.3 | 32.2 | 35.1 | 38.0 | 41.0 | 43.9 | 46.8 |
| ¾" SCH 80 | 48.6 | 54.0 | 59.4 | 64.8 | 70.2 | 75.6 | 81.0 | 86.4 |
| 1" SCH 80 | 80.9 | 89.9 | 98.9 | 107.8 | 116.8 | 125.8 | 134.8 | 143.8 |
| 1¼" SCH 80 | 144.2 | 160.3 | 176.3 | 192.3 | 208.3 | 224.4 | 240.4 | 256.4 |
| 1½" SCH 80 | 198.7 | 220.8 | 242.9 | 264.9 | 287.0 | 309.1 | 331.2 | 353.3 |
| ½" SCH 160 | 19.0 | 21.1 | 23.2 | 25.4 | 27.5 | 29.6 | 31.7 | 33.8 |
| ¾" SCH 160 | 33.1 | 36.8 | 40.4 | 44.1 | 47.8 | 51.5 | 55.1 | 58.8 |

TABLE 5-continued

| Drive Delta-P = (psi) 1250 | | | | | | | | |
|---|---|---|---|---|---|---|---|---|
| 1" SCH 160 | 58.7 | 65.2 | 71.7 | 78.2 | 84.7 | 91.2 | 97.8 | 104.3 |
| 1¼" SCH 160 | 118.8 | 132.0 | 145.2 | 158.4 | 171.6 | 184.9 | 198.1 | 211.3 |
| 1½" SCH 160 | 158.1 | 175.7 | 193.2 | 210.8 | 228.4 | 245.9 | 263.5 | 281.1 |

TABLE 6

| Drive Delta-P = (psi) 1500 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 1.7 | 2.6 | 3.4 | 4.3 | 5.1 | 6.0 | 6.8 |
| ¼" SCH 40 | 3.1 | 4.7 | 6.2 | 7.8 | 9.4 | 10.9 | 12.5 |
| ⅜" SCH 40 | 5.7 | 8.6 | 11.4 | 14.3 | 17.2 | 20.0 | 22.9 |
| ½" SCH 40 | 9.1 | 13.7 | 18.2 | 22.8 | 27.3 | 31.9 | 36.4 |
| ¾" SCH 40 | 16.0 | 24.0 | 32.0 | 40.0 | 48.0 | 56.0 | 64.0 |
| 1" SCH 40 | 25.9 | 38.9 | 51.8 | 64.8 | 77.7 | 90.7 | 103.7 |
| 1¼" SCH 40 | 44.8 | 67.3 | 89.7 | 112.1 | 134.5 | 157.0 | 179.4 |
| 1½" SCH 40 | 61.0 | 91.6 | 122.1 | 152.6 | 183.1 | 213.7 | 244.2 |
| ⅛" SCH 80 | 1.1 | 1.6 | 2.2 | 2.7 | 3.3 | 3.8 | 4.4 |
| ¼" SCH 80 | 2.1 | 3.2 | 4.3 | 5.4 | 6.4 | 7.5 | 8.6 |
| ⅜" SCH 80 | 4.2 | 6.3 | 8.4 | 10.5 | 12.6 | 14.7 | 16.9 |
| ½" SCH 80 | 7.0 | 10.5 | 14.0 | 17.6 | 21.1 | 24.6 | 28.1 |
| ¾" SCH 80 | 13.0 | 19.4 | 25.9 | 32.4 | 38.9 | 45.4 | 51.9 |
| 1" SCH 80 | 21.6 | 32.4 | 43.1 | 53.9 | 64.7 | 75.5 | 86.3 |
| 1¼" SCH 80 | 38.5 | 57.7 | 76.9 | 96.2 | 115.4 | 134.6 | 153.9 |
| 1½" SCH 80 | 53.0 | 79.5 | 106.0 | 132.5 | 159.0 | 185.5 | 212.0 |
| ½" SCH 160 | 5.1 | 7.6 | 10.1 | 12.7 | 15.2 | 17.7 | 20.3 |
| ¾" SCH 160 | 8.8 | 13.2 | 17.6 | 22.1 | 26.5 | 30.9 | 35.3 |
| 1" SCH 160 | 15.6 | 23.5 | 31.3 | 39.1 | 46.9 | 54.7 | 62.6 |
| 1¼" SCH 160 | 31.7 | 47.5 | 63.4 | 79.2 | 95.1 | 110.9 | 126.8 |
| 1½" SCH 160 | 42.2 | 63.2 | 84.3 | 105.4 | 126.5 | 147.6 | 168.6 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 7.7 | 8.5 | 9.4 | 10.2 | 11.1 | 11.9 | 12.8 | 13.6 |
| ¼" SCH 40 | 14.0 | 15.6 | 17.2 | 18.7 | 20.3 | 21.8 | 23.4 | 25.0 |
| ⅜" SCH 40 | 25.8 | 28.6 | 31.5 | 34.3 | 37.2 | 40.1 | 42.9 | 45.8 |
| ½" SCH 40 | 41.0 | 45.6 | 50.1 | 54.7 | 59.2 | 63.8 | 68.3 | 72.9 |
| ¾" SCH 40 | 72.0 | 79.9 | 87.9 | 95.9 | 103.9 | 111.9 | 119.9 | 127.9 |
| 1" SCH 40 | 116.6 | 129.6 | 142.5 | 155.5 | 168.4 | 181.4 | 194.4 | 207.3 |
| 1¼" SCH 40 | 201.8 | 224.2 | 246.7 | 269.1 | 291.5 | 313.9 | 336.4 | 358.8 |
| 1½" SCH 40 | 274.7 | 305.2 | 335.7 | 366.3 | 396.8 | 427.3 | 457.8 | 488.4 |
| ⅛" SCH 80 | 4.9 | 5.4 | 6.0 | 6.5 | 7.1 | 7.6 | 8.2 | 8.7 |
| ¼" SCH 80 | 9.7 | 10.7 | 11.8 | 12.9 | 14.0 | 15.0 | 16.1 | 17.2 |
| ⅜" SCH 80 | 19.0 | 21.1 | 23.2 | 25.3 | 27.4 | 29.5 | 31.6 | 33.7 |
| ½" SCH 80 | 31.6 | 35.1 | 38.6 | 42.1 | 45.6 | 49.1 | 52.7 | 56.2 |
| ¾" SCH 80 | 58.3 | 64.8 | 71.3 | 77.8 | 84.3 | 90.8 | 97.2 | 103.7 |
| 1" SCH 80 | 97.1 | 107.8 | 118.6 | 129.4 | 140.2 | 151.0 | 161.8 | 172.5 |
| 1¼" SCH 80 | 173.1 | 192.3 | 211.6 | 230.8 | 250.0 | 269.2 | 288.5 | 307.7 |
| 1½" SCH 80 | 238.4 | 264.9 | 291.4 | 317.9 | 344.4 | 370.9 | 397.4 | 423.9 |
| ½" SCH 160 | 22.8 | 25.4 | 27.9 | 30.4 | 33.0 | 35.5 | 38.0 | 40.6 |
| ¾" SCH 160 | 39.7 | 44.1 | 48.5 | 52.9 | 57.3 | 61.7 | 66.2 | 70.6 |
| 1" SCH 160 | 70.4 | 78.2 | 86.0 | 93.9 | 101.7 | 109.5 | 117.3 | 125.1 |
| 1¼" SCH 160 | 142.6 | 158.4 | 174.3 | 190.1 | 206.0 | 221.8 | 237.7 | 253.5 |
| 1½" SCH 160 | 189.7 | 210.8 | 231.9 | 253.0 | 274.0 | 295.1 | 316.2 | 337.3 |

TABLE 7

Drive Delta-P = (psi) 1750

| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
|---|---|---|---|---|---|---|---|
| ⅛" SCH 40 | 2.0 | 3.0 | 4.0 | 5.0 | 6.0 | 7.0 | 8.0 |
| ¼" SCH 40 | 3.6 | 5.5 | 7.3 | 9.1 | 10.9 | 12.7 | 14.6 |
| ⅜" SCH 40 | 6.7 | 10.0 | 13.4 | 16.7 | 20.0 | 23.4 | 26.7 |
| ½" SCH 40 | 10.6 | 15.9 | 21.3 | 26.6 | 31.9 | 37.2 | 42.5 |
| ¾" SCH 40 | 18.7 | 28.0 | 37.3 | 46.6 | 56.0 | 65.3 | 74.6 |
| 1" SCH 40 | 30.2 | 45.4 | 60.5 | 75.6 | 90.7 | 105.8 | 120.9 |
| 1¼" SCH 40 | 52.3 | 78.5 | 104.6 | 130.8 | 157.0 | 183.1 | 209.3 |
| 1½" SCH 40 | 71.2 | 106.8 | 142.4 | 178.0 | 213.7 | 249.3 | 284.9 |
| ⅛" SCH 80 | 1.3 | 1.9 | 2.5 | 3.2 | 3.8 | 4.4 | 5.1 |
| ¼" SCH 80 | 2.5 | 3.8 | 5.0 | 6.3 | 7.5 | 8.8 | 10.0 |
| ⅜" SCH 80 | 4.9 | 7.4 | 9.8 | 12.3 | 14.7 | 17.2 | 19.7 |
| ½" SCH 80 | 8.2 | 12.3 | 16.4 | 20.5 | 24.6 | 28.7 | 32.8 |
| ¾" SCH 80 | 15.1 | 22.7 | 30.3 | 37.8 | 45.4 | 52.9 | 60.5 |
| 1" SCH 80 | 25.2 | 37.7 | 50.3 | 62.9 | 75.5 | 88.1 | 100.7 |
| 1¼" SCH 80 | 44.9 | 67.3 | 89.7 | 112.2 | 134.6 | 157.1 | 179.5 |
| 1½" SCH 80 | 61.8 | 92.7 | 123.6 | 154.5 | 185.5 | 216.4 | 247.3 |
| ½" SCH 160 | 5.9 | 8.9 | 11.8 | 14.8 | 17.7 | 20.7 | 23.7 |
| ¾" SCH 160 | 10.3 | 15.4 | 20.6 | 25.7 | 30.9 | 36.0 | 41.2 |
| 1" SCH 160 | 18.2 | 27.4 | 36.5 | 45.6 | 54.7 | 63.9 | 73.0 |
| 1¼" SCH 160 | 37.0 | 55.5 | 73.9 | 92.4 | 110.9 | 129.4 | 147.9 |
| 1½" SCH 160 | 49.2 | 73.8 | 98.4 | 123.0 | 147.6 | 172.2 | 196.7 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 8.9 | 9.9 | 10.9 | 11.9 | 12.9 | 13.9 | 14.9 | 15.9 |
| ¼" SCH 40 | 16.4 | 18.2 | 20.0 | 21.8 | 23.7 | 25.5 | 27.3 | 29.1 |
| ⅜" SCH 40 | 30.0 | 33.4 | 36.7 | 40.1 | 43.4 | 46.7 | 50.1 | 53.4 |
| ½" SCH 40 | 47.8 | 53.1 | 58.5 | 63.8 | 69.1 | 74.4 | 79.7 | 85.0 |
| ¾" SCH 40 | 83.9 | 93.3 | 102.6 | 111.9 | 121.3 | 130.6 | 139.9 | 149.2 |
| 1" SCH 40 | 136.1 | 151.2 | 166.3 | 181.4 | 196.5 | 211.6 | 226.8 | 241.9 |
| 1¼" SCH 40 | 235.5 | 261.6 | 287.8 | 313.9 | 340.1 | 366.3 | 392.4 | 418.6 |
| 1½" SCH 40 | 320.5 | 356.1 | 391.7 | 427.3 | 462.9 | 498.5 | 534.1 | 569.7 |
| ⅛" SCH 80 | 5.7 | 6.4 | 7.0 | 7.6 | 8.3 | 8.9 | 9.5 | 10.2 |
| ¼" SCH 80 | 11.3 | 12.5 | 13.8 | 15.0 | 16.3 | 17.5 | 18.8 | 20.0 |
| ⅜" SCH 80 | 22.1 | 24.6 | 27.0 | 29.5 | 32.0 | 34.4 | 36.9 | 39.3 |
| ½" SCH 80 | 36.9 | 41.0 | 45.0 | 49.1 | 53.2 | 57.3 | 61.4 | 65.5 |
| ¾" SCH 80 | 68.1 | 75.6 | 83.2 | 90.8 | 98.3 | 105.9 | 113.5 | 121.0 |
| 1" SCH 80 | 113.2 | 125.8 | 138.4 | 151.0 | 163.6 | 176.1 | 188.7 | 201.3 |
| 1¼" SCH 80 | 201.9 | 224.4 | 246.8 | 269.2 | 291.7 | 314.1 | 336.6 | 359.0 |
| 1½" SCH 80 | 278.2 | 309.1 | 340.0 | 370.9 | 401.8 | 432.7 | 463.6 | 494.6 |
| ½" SCH 160 | 26.6 | 29.6 | 32.5 | 35.5 | 38.4 | 41.4 | 44.4 | 47.3 |
| ¾" SCH 160 | 46.3 | 51.5 | 56.6 | 61.7 | 66.9 | 72.0 | 77.2 | 82.3 |
| 1" SCH 160 | 82.1 | 91.2 | 100.4 | 109.5 | 118.6 | 127.7 | 136.9 | 146.0 |
| 1¼" SCH 160 | 166.4 | 184.9 | 203.3 | 221.8 | 240.3 | 258.8 | 277.3 | 295.8 |
| 1½" SCH 160 | 221.3 | 245.9 | 270.5 | 295.1 | 319.7 | 344.3 | 368.9 | 393.5 |

TABLE 8

Drive Delta-P = (psi) 2000

| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
|---|---|---|---|---|---|---|---|
| ⅛" SCH 40 | 2.3 | 3.4 | 4.5 | 5.7 | 6.8 | 8.0 | 9.1 |
| ¼" SCH 40 | 4.2 | 6.2 | 8.3 | 10.4 | 12.5 | 14.6 | 16.6 |
| ⅜" SCH 40 | 7.6 | 11.4 | 15.3 | 19.1 | 22.9 | 26.7 | 30.5 |
| ½" SCH 40 | 12.1 | 18.2 | 24.3 | 30.4 | 36.4 | 42.5 | 48.6 |
| ¾" SCH 40 | 21.3 | 32.0 | 42.6 | 53.3 | 64.0 | 74.6 | 85.3 |
| 1" SCH 40 | 34.6 | 51.8 | 69.1 | 86.4 | 103.7 | 120.9 | 138.2 |
| 1¼" SCH 40 | 59.8 | 89.7 | 119.6 | 149.5 | 179.4 | 209.3 | 239.2 |
| 1½" SCH 40 | 81.4 | 122.1 | 162.8 | 203.5 | 244.2 | 284.9 | 325.6 |
| ⅛" SCH 80 | 1.5 | 2.2 | 2.9 | 3.6 | 4.4 | 5.1 | 5.8 |

TABLE 8-continued

| Drive Delta-P = (psi) 2000 | | | | | | | |
|---|---|---|---|---|---|---|---|
| ¼" SCH 80 | 2.9 | 4.3 | 5.7 | 7.2 | 8.6 | 10.0 | 11.5 |
| ⅜" SCH 80 | 5.6 | 8.4 | 11.2 | 14.0 | 16.9 | 19.7 | 22.5 |
| ½" SCH 80 | 9.4 | 14.0 | 18.7 | 23.4 | 28.1 | 32.8 | 37.4 |
| ¾" SCH 80 | 17.3 | 25.9 | 34.6 | 43.2 | 51.9 | 60.5 | 69.2 |
| 1" SCH 80 | 28.8 | 43.1 | 57.5 | 71.9 | 86.3 | 100.7 | 115.0 |
| 1¼" SCH 80 | 51.3 | 76.9 | 102.6 | 128.2 | 153.9 | 179.5 | 205.1 |
| 1½" SCH 80 | 70.7 | 106.0 | 141.3 | 176.6 | 212.0 | 247.3 | 282.6 |
| ½" SCH 160 | 6.8 | 10.1 | 13.5 | 16.9 | 20.3 | 23.7 | 27.0 |
| ¾" SCH 160 | 11.8 | 17.6 | 23.5 | 29.4 | 35.3 | 41.2 | 47.0 |
| 1" SCH 160 | 20.9 | 31.3 | 41.7 | 52.1 | 62.6 | 73.0 | 83.4 |
| 1¼" SCH 160 | 42.3 | 63.4 | 84.5 | 105.6 | 126.8 | 147.9 | 169.0 |
| 1½" SCH 160 | 56.2 | 84.3 | 112.4 | 140.5 | 168.6 | 196.7 | 224.9 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 10.2 | 11.4 | 12.5 | 13.6 | 14.8 | 15.9 | 17.0 | 18.2 |
| ¼" SCH 40 | 18.7 | 20.8 | 22.9 | 25.0 | 27.0 | 29.1 | 31.2 | 33.3 |
| ⅜" SCH 40 | 34.3 | 38.2 | 42.0 | 45.8 | 49.6 | 53.4 | 57.2 | 61.1 |
| ½" SCH 40 | 54.7 | 60.7 | 66.8 | 72.9 | 79.0 | 85.0 | 91.1 | 97.2 |
| ¾" SCH 40 | 95.9 | 106.6 | 117.3 | 127.9 | 138.6 | 149.2 | 159.9 | 170.6 |
| 1" SCH 40 | 155.5 | 172.8 | 190.0 | 207.3 | 224.6 | 241.9 | 259.1 | 276.4 |
| 1¼" SCH 40 | 269.1 | 299.0 | 328.9 | 358.8 | 388.7 | 418.6 | 448.5 | 478.4 |
| 1½" SCH 40 | 366.3 | 407.0 | 447.7 | 488.4 | 529.0 | 569.7 | 610.4 | 651.1 |
| ⅛" SCH 80 | 6.5 | 7.3 | 8.0 | 8.7 | 9.4 | 10.2 | 10.9 | 11.6 |
| ¼" SCH 80 | 12.9 | 14.3 | 15.8 | 17.2 | 18.6 | 20.0 | 21.5 | 22.9 |
| ⅜" SCH 80 | 25.3 | 28.1 | 30.9 | 33.7 | 36.5 | 39.3 | 42.1 | 44.9 |
| ½" SCH 80 | 42.1 | 46.8 | 51.5 | 56.2 | 60.8 | 65.5 | 70.2 | 74.9 |
| ¾" SCH 80 | 77.8 | 86.4 | 95.1 | 103.7 | 112.4 | 121.0 | 129.7 | 138.3 |
| 1" SCH 80 | 129.4 | 143.8 | 158.2 | 172.5 | 186.9 | 201.3 | 215.7 | 230.1 |
| 1¼" SCH 80 | 230.8 | 256.4 | 282.1 | 307.7 | 333.4 | 359.0 | 384.6 | 410.3 |
| 1½" SCH 80 | 317.9 | 353.3 | 388.6 | 423.9 | 459.2 | 494.6 | 529.9 | 565.2 |
| ½" SCH 160 | 30.4 | 33.8 | 37.2 | 40.6 | 43.9 | 47.3 | 50.7 | 54.1 |
| ¾" SCH 160 | 52.9 | 58.8 | 64.7 | 70.6 | 76.4 | 82.3 | 88.2 | 94.1 |
| 1" SCH 160 | 93.9 | 104.3 | 114.7 | 125.1 | 135.6 | 146.0 | 156.4 | 166.9 |
| 1¼" SCH 160 | 190.1 | 211.3 | 232.4 | 253.5 | 274.6 | 295.8 | 316.9 | 338.0 |
| 1½" SCH 160 | 253.0 | 281.1 | 309.2 | 337.3 | 365.4 | 393.5 | 421.6 | 449.7 |

TABLE 9

| Drive Delta-P = (psi) 2250 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 2.6 | 3.8 | 5.1 | 6.4 | 7.7 | 8.9 | 10.2 |
| ¼" SCH 40 | 4.7 | 7.0 | 9.4 | 11.7 | 14.0 | 16.4 | 18.7 |
| ⅜" SCH 40 | 8.6 | 12.9 | 17.2 | 21.5 | 25.8 | 30.0 | 34.3 |
| ½" SCH 40 | 13.7 | 20.5 | 27.3 | 34.2 | 41.0 | 47.8 | 54.7 |
| ¾" SCH 40 | 24.0 | 36.0 | 48.0 | 60.0 | 72.0 | 83.9 | 95.9 |
| 1" SCH 40 | 38.9 | 58.3 | 77.7 | 97.2 | 116.6 | 136.1 | 155.5 |
| 1¼" SCH 40 | 67.3 | 100.9 | 134.5 | 168.2 | 201.8 | 235.5 | 269.1 |
| 1½" SCH 40 | 91.6 | 137.3 | 183.1 | 228.9 | 274.7 | 320.5 | 366.3 |
| ⅛" SCH 80 | 1.6 | 2.4 | 3.3 | 4.1 | 4.9 | 5.7 | 6.5 |
| ¼" SCH 80 | 3.2 | 4.8 | 6.4 | 8.1 | 9.7 | 11.3 | 12.9 |
| ⅜" SCH 80 | 6.3 | 9.5 | 12.6 | 15.8 | 19.0 | 22.1 | 25.3 |
| ½" SCH 80 | 10.5 | 15.8 | 21.1 | 26.3 | 31.6 | 36.9 | 42.1 |
| ¾" SCH 80 | 19.4 | 29.2 | 38.9 | 48.6 | 58.3 | 68.1 | 77.8 |
| 1" SCH 80 | 32.4 | 48.5 | 64.7 | 80.9 | 97.1 | 113.2 | 129.4 |
| 1¼" SCH 80 | 57.7 | 86.5 | 115.4 | 144.2 | 173.1 | 201.9 | 230.8 |
| 1½" SCH 80 | 79.5 | 119.2 | 159.0 | 198.7 | 238.4 | 278.2 | 317.9 |
| ½" SCH 160 | 7.6 | 11.4 | 15.2 | 19.0 | 22.8 | 26.6 | 30.4 |
| ¾" SCH 160 | 13.2 | 19.8 | 26.5 | 33.1 | 39.7 | 46.3 | 52.9 |
| 1" SCH 160 | 23.5 | 35.2 | 46.9 | 58.7 | 70.4 | 82.1 | 93.9 |
| 1¼" SCH 160 | 47.5 | 71.3 | 95.1 | 118.8 | 142.6 | 166.4 | 190.1 |
| 1½" SCH 160 | 63.2 | 94.9 | 126.5 | 158.1 | 189.7 | 221.3 | 253.0 |

TABLE 9-continued

| Drive Delta-P = (psi) 2250 | | | | | | | | |
|---|---|---|---|---|---|---|---|---|
| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
| ⅛" SCH 40 | 11.5 | 12.8 | 14.1 | 15.3 | 16.6 | 17.9 | 19.2 | 20.4 |
| ¼" SCH 40 | 21.1 | 23.4 | 25.7 | 28.1 | 30.4 | 32.8 | 35.1 | 37.4 |
| ⅜" SCH 40 | 38.6 | 42.9 | 47.2 | 51.5 | 55.8 | 60.1 | 64.4 | 68.7 |
| ½" SCH 40 | 61.5 | 68.3 | 75.2 | 82.0 | 88.8 | 95.7 | 102.5 | 109.3 |
| ¾" SCH 40 | 107.9 | 119.9 | 131.9 | 143.9 | 155.9 | 167.9 | 179.9 | 191.9 |
| 1" SCH 40 | 174.9 | 194.4 | 213.8 | 233.2 | 252.7 | 272.1 | 291.5 | 311.0 |
| 1¼" SCH 40 | 302.7 | 336.4 | 370.0 | 403.6 | 437.3 | 470.9 | 504.5 | 538.2 |
| 1½" SCH 40 | 412.0 | 457.8 | 503.6 | 549.4 | 595.2 | 641.0 | 686.7 | 732.5 |
| ⅛" SCH 80 | 7.3 | 8.2 | 9.0 | 9.8 | 10.6 | 11.4 | 12.2 | 13.1 |
| ¼" SCH 80 | 14.5 | 16.1 | 17.7 | 19.3 | 20.9 | 22.6 | 24.2 | 25.8 |
| ⅜" SCH 80 | 28.4 | 31.6 | 34.8 | 37.9 | 41.1 | 44.2 | 47.4 | 50.6 |
| ½" SCH 80 | 47.4 | 52.7 | 57.9 | 63.2 | 68.5 | 73.7 | 79.0 | 84.2 |
| ¾" SCH 80 | 87.5 | 97.2 | 107.0 | 116.7 | 126.4 | 136.1 | 145.9 | 155.6 |
| 1" SCH 80 | 145.6 | 161.8 | 177.9 | 194.1 | 210.3 | 226.5 | 242.6 | 258.8 |
| 1¼" SCH 80 | 259.6 | 288.5 | 317.3 | 346.2 | 375.0 | 403.9 | 432.7 | 461.6 |
| 1½" SCH 80 | 357.7 | 397.4 | 437.1 | 476.9 | 516.6 | 556.4 | 596.1 | 635.9 |
| ½" SCH 160 | 34.2 | 38.0 | 41.8 | 45.6 | 49.4 | 53.2 | 57.0 | 60.8 |
| ¾" SCH 160 | 59.5 | 66.2 | 72.8 | 79.4 | 86.0 | 92.6 | 99.2 | 105.8 |
| 1" SCH 160 | 105.6 | 117.3 | 129.1 | 140.8 | 152.5 | 164.2 | 176.0 | 187.7 |
| 1¼" SCH 160 | 213.9 | 237.7 | 261.4 | 285.2 | 309.0 | 332.7 | 356.5 | 380.3 |
| 1½" SCH 160 | 284.6 | 316.2 | 347.8 | 379.4 | 411.1 | 442.7 | 474.3 | 505.9 |

TABLE 10

| Drive Delta-P = (psi) 2500 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 2.8 | 4.3 | 5.7 | 7.1 | 8.5 | 9.9 | 11.4 |
| ¼" SCH 40 | 5.2 | 7.8 | 10.4 | 13.0 | 15.6 | 18.2 | 20.8 |
| ⅜" SCH 40 | 9.5 | 14.3 | 19.1 | 23.8 | 28.6 | 33.4 | 38.2 |
| ½" SCH 40 | 15.2 | 22.8 | 30.4 | 38.0 | 45.6 | 53.1 | 60.7 |
| ¾" SCH 40 | 26.6 | 40.0 | 53.3 | 66.6 | 79.9 | 93.3 | 106.6 |
| 1" SCH 40 | 43.2 | 64.8 | 86.4 | 108.0 | 129.6 | 151.2 | 172.8 |
| 1¼" SCH 40 | 74.7 | 112.1 | 149.5 | 186.9 | 224.2 | 261.6 | 299.0 |
| 1½" SCH 40 | 101.7 | 152.6 | 203.5 | 254.3 | 305.2 | 356.1 | 407.0 |
| ⅛" SCH 80 | 1.8 | 2.7 | 3.6 | 4.5 | 5.4 | 6.4 | 7.3 |
| ¼" SCH 80 | 3.6 | 5.4 | 7.2 | 8.9 | 10.7 | 12.5 | 14.3 |
| ⅜" SCH 80 | 7.0 | 10.5 | 14.0 | 17.6 | 21.1 | 24.6 | 28.1 |
| ½" SCH 80 | 11.7 | 17.6 | 23.4 | 29.3 | 35.1 | 41.0 | 46.8 |
| ¾" SCH 80 | 21.6 | 32.4 | 43.2 | 54.0 | 64.8 | 75.6 | 86.4 |
| 1" SCH 80 | 35.9 | 53.9 | 71.9 | 89.9 | 107.8 | 125.8 | 143.8 |
| 1¼" SCH 80 | 64.1 | 96.2 | 128.2 | 160.3 | 192.3 | 224.4 | 256.4 |
| 1½" SCH 80 | 88.3 | 132.5 | 176.6 | 220.8 | 264.9 | 309.1 | 353.3 |
| ½" SCH 160 | 8.5 | 12.7 | 16.9 | 21.1 | 25.4 | 29.6 | 33.8 |
| ¾" SCH 160 | 14.7 | 22.1 | 29.4 | 36.8 | 44.1 | 51.5 | 58.8 |
| 1" SCH 160 | 26.1 | 39.1 | 52.1 | 65.2 | 78.2 | 91.2 | 104.3 |
| 1¼" SCH 160 | 52.8 | 79.2 | 105.6 | 132.0 | 158.4 | 184.9 | 211.3 |
| 1½" SCH 160 | 70.3 | 105.4 | 140.5 | 175.7 | 210.8 | 245.9 | 281.1 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 12.8 | 14.2 | 15.6 | 17.0 | 18.5 | 19.9 | 21.3 | 22.7 |
| ¼" SCH 40 | 23.4 | 26.0 | 28.6 | 31.2 | 33.8 | 36.4 | 39.0 | 41.6 |
| ⅜" SCH 40 | 42.9 | 47.7 | 52.5 | 57.2 | 62.0 | 66.8 | 71.5 | 76.3 |
| ½" SCH 40 | 68.3 | 75.9 | 83.5 | 91.1 | 98.7 | 106.3 | 113.9 | 121.5 |
| ¾" SCH 40 | 119.9 | 133.2 | 146.6 | 159.9 | 173.2 | 186.5 | 199.9 | 213.2 |
| 1" SCH 40 | 194.4 | 216.0 | 237.5 | 259.1 | 280.7 | 302.3 | 323.9 | 345.5 |
| 1¼" SCH 40 | 336.4 | 373.7 | 411.1 | 448.5 | 485.9 | 523.2 | 560.6 | 598.0 |
| 1½" SCH 40 | 457.8 | 508.7 | 559.6 | 610.4 | 661.3 | 712.2 | 763.0 | 813.9 |
| ⅛" SCH 80 | 8.2 | 9.1 | 10.0 | 10.9 | 11.8 | 12.7 | 13.6 | 14.5 |

TABLE 10-continued

| Drive Delta-P = (psi) 2500 | | | | | | | | |
|---|---|---|---|---|---|---|---|---|
| ¼" SCH 80 | 16.1 | 17.9 | 19.7 | 21.5 | 23.3 | 25.1 | 26.8 | 28.6 |
| ⅜" SCH 80 | 31.6 | 35.1 | 38.6 | 42.1 | 45.6 | 49.2 | 52.7 | 56.2 |
| ½" SCH 80 | 52.7 | 58.5 | 64.4 | 70.2 | 76.1 | 81.9 | 87.8 | 93.6 |
| ¾" SCH 80 | 97.2 | 108.0 | 118.9 | 129.7 | 140.5 | 151.3 | 162.1 | 172.9 |
| 1" SCH 80 | 161.8 | 179.7 | 197.7 | 215.7 | 233.7 | 251.6 | 269.6 | 287.6 |
| 1¼" SCH 80 | 288.5 | 320.5 | 352.6 | 384.6 | 416.7 | 448.7 | 480.8 | 512.9 |
| 1½" SCH 80 | 397.4 | 441.6 | 485.7 | 529.9 | 574.0 | 618.2 | 662.3 | 706.5 |
| ½" SCH 160 | 38.0 | 42.3 | 46.5 | 50.7 | 54.9 | 59.2 | 63.4 | 67.6 |
| ¾" SCH 160 | 66.2 | 73.5 | 80.9 | 88.2 | 95.6 | 102.9 | 110.3 | 117.6 |
| 1" SCH 160 | 117.3 | 130.4 | 143.4 | 156.4 | 169.5 | 182.5 | 195.5 | 208.6 |
| 1¼" SCH 160 | 237.7 | 264.1 | 290.5 | 316.9 | 343.3 | 369.7 | 396.1 | 422.5 |
| 1½" SCH 160 | 316.2 | 351.3 | 386.5 | 421.6 | 456.7 | 491.9 | 527.0 | 562.1 |

TABLE 11

DATA for oil
Bulk Modulus = (psi) 250000

| PIPE SIZE/SCHEDULE | OD (in) | OD AREA (in^2) | ID (in) | ID AREA (in^2) | WALL THCK (in) | VOL. @ DEPTH 500 (in^3) | VOL. @ DEPTH 750 (in^3) | VOL. @ DEPTH 1000 (in^3) | VOL. @ DEPTH 1250 (in^3) |
|---|---|---|---|---|---|---|---|---|---|
| ⅛" SCH 40 | 0.405 | 0.129 | 0.269 | 0.057 | 0.068 | 340.8 | 511.2 | 681.6 | 852.1 |
| ¼" SCH 40 | 0.540 | 0.229 | 0.364 | 0.104 | 0.088 | 624.1 | 936.1 | 1248.1 | 1560.1 |
| ⅜" SCH 40 | 0.675 | 0.358 | 0.493 | 0.191 | 0.091 | 1144.8 | 1717.1 | 2289.5 | 2861.9 |
| ½" SCH 40 | 0.840 | 0.554 | 0.622 | 0.304 | 0.109 | 1822.2 | 2733.3 | 3644.4 | 4555.6 |
| ¾" SCH 40 | 1.050 | 0.865 | 0.824 | 0.533 | 0.113 | 3198.0 | 4797.0 | 6396.0 | 7994.9 |
| 1" SCH 40 | 1.315 | 1.357 | 1.049 | 0.864 | 0.133 | 5182.9 | 7774.3 | 10365.8 | 12957.2 |
| 1¼" SCH 40 | 1.660 | 2.163 | 1.380 | 1.495 | 0.140 | 8969.7 | 13454.6 | 17939.4 | 22424.3 |
| 1½" SCH 40 | 1.900 | 2.834 | 1.610 | 2.035 | 0.145 | 12208.8 | 18313.2 | 24417.6 | 30522.0 |
| ⅛" SCH 80 | 0.405 | 0.129 | 0.215 | 0.036 | 0.095 | 217.7 | 326.6 | 435.4 | 544.3 |
| ¼" SCH 80 | 0.540 | 0.229 | 0.302 | 0.072 | 0.119 | 429.6 | 644.4 | 859.1 | 1073.9 |
| ⅜" SCH 80 | 0.675 | 0.358 | 0.423 | 0.140 | 0.126 | 842.8 | 1264.1 | 1685.5 | 2106.9 |
| ½" SCH 80 | 0.840 | 0.554 | 0.546 | 0.234 | 0.147 | 1404.1 | 2106.2 | 2808.3 | 3510.3 |
| ¾" SCH 80 | 1.050 | 0.865 | 0.742 | 0.432 | 0.154 | 2593.2 | 3889.7 | 5186.3 | 6482.9 |
| 1" SCH 80 | 1.315 | 1.357 | 0.957 | 0.719 | 0.179 | 4313.6 | 6470.5 | 8627.3 | 10784.1 |
| 1¼" SCH 80 | 1.660 | 2.163 | 1.278 | 1.282 | 0.191 | 7692.8 | 11539.2 | 15385.5 | 19231.9 |
| 1½" SCH 80 | 1.900 | 2.834 | 1.500 | 1.766 | 0.200 | 10597.5 | 15896.3 | 21195.0 | 26493.8 |
| ½" SCH 160 | 0.840 | 0.554 | 0.464 | 0.169 | 0.188 | 1014.0 | 1521.1 | 2028.1 | 2535.1 |
| ¾" SCH 160 | 1.050 | 0.865 | 0.612 | 0.294 | 0.219 | 1764.1 | 2646.2 | 3528.2 | 4410.3 |
| 1" SCH 160 | 1.315 | 1.357 | 0.815 | 0.521 | 0.250 | 3128.5 | 4692.7 | 6257.0 | 7821.2 |
| 1¼" SCH 160 | 1.660 | 2.163 | 1.160 | 1.056 | 0.250 | 6337.8 | 9506.7 | 12675.6 | 15844.4 |
| 1½" SCH 160 | 1.900 | 2.834 | 1.338 | 1.405 | 0.281 | 8432.0 | 12648.1 | 16864.1 | 21080.1 |

| PIPE SIZE/SCHEDULE | OD (in) | OD AREA (in^2) | ID (in) | ID AREA (in^2) | WALL THCK (in) | VOL. @ DEPTH 1500 (in^3) | VOL. @ DEPTH 1750 (in^3) | VOL. @ DEPTH 2000 (in^3) | VOL. @ DEPTH 2250 (in^3) |
|---|---|---|---|---|---|---|---|---|---|
| ⅛" SCH 40 | 0.405 | 0.129 | 0.269 | 0.057 | 0.068 | 1022.5 | 1192.9 | 1363.3 | 1533.7 |
| ¼" SCH 40 | 0.540 | 0.229 | 0.364 | 0.104 | 0.088 | 1872.2 | 2184.2 | 2496.2 | 2808.3 |
| ⅜" SCH 40 | 0.675 | 0.358 | 0.493 | 0.191 | 0.091 | 3434.3 | 4006.7 | 4579.0 | 5151.4 |
| ½" SCH 40 | 0.840 | 0.554 | 0.622 | 0.304 | 0.109 | 5466.7 | 6377.8 | 7288.9 | 8200.0 |
| ¾" SCH 40 | 1.050 | 0.865 | 0.824 | 0.533 | 0.113 | 9593.9 | 11192.9 | 12791.9 | 14390.9 |
| 1" SCH 40 | 1.315 | 1.357 | 1.049 | 0.864 | 0.133 | 15548.7 | 18140.1 | 20731.6 | 23323.0 |
| 1¼" SCH 40 | 1.660 | 2.163 | 1.380 | 1.495 | 0.140 | 26909.2 | 31394.0 | 35878.9 | 40363.8 |
| 1½" SCH 40 | 1.900 | 2.834 | 1.610 | 2.035 | 0.145 | 36626.4 | 42730.8 | 48835.2 | 54939.6 |
| ⅛" SCH 80 | 0.405 | 0.129 | 0.215 | 0.036 | 0.095 | 653.2 | 762.0 | 870.9 | 979.7 |
| ¼" SCH 80 | 0.540 | 0.229 | 0.302 | 0.072 | 0.119 | 1288.7 | 1503.5 | 1718.3 | 1933.1 |
| ⅜" SCH 80 | 0.675 | 0.358 | 0.423 | 0.140 | 0.126 | 2528.3 | 2949.6 | 3371.0 | 3792.4 |
| ½" SCH 80 | 0.840 | 0.554 | 0.546 | 0.234 | 0.147 | 4212.4 | 4914.4 | 5616.5 | 6318.6 |
| ¾" SCH 80 | 1.050 | 0.865 | 0.742 | 0.432 | 0.154 | 7779.5 | 9076.0 | 10372.6 | 11669.2 |
| 1" SCH 80 | 1.315 | 1.357 | 0.957 | 0.719 | 0.179 | 12940.9 | 15097.8 | 17254.6 | 19411.4 |
| 1¼" SCH 80 | 1.660 | 2.163 | 1.278 | 1.282 | 0.191 | 23078.3 | 26924.7 | 30771.1 | 34617.5 |
| 1½" SCH 80 | 1.900 | 2.834 | 1.500 | 1.766 | 0.200 | 31792.5 | 37091.3 | 42390.0 | 47688.8 |
| ½" SCH 160 | 0.840 | 0.554 | 0.464 | 0.169 | 0.188 | 3042.1 | 3549.2 | 4056.2 | 4563.2 |
| ¾" SCH 160 | 1.050 | 0.865 | 0.612 | 0.294 | 0.219 | 5292.3 | 6174.4 | 7056.4 | 7938.5 |
| 1" SCH 160 | 1.315 | 1.357 | 0.815 | 0.521 | 0.250 | 9385.5 | 10949.7 | 12514.0 | 14078.2 |
| 1¼" SCH 160 | 1.660 | 2.163 | 1.160 | 1.056 | 0.250 | 19013.3 | 22182.2 | 25351.1 | 28520.0 |
| 1½" SCH 160 | 1.900 | 2.834 | 1.338 | 1.405 | 0.281 | 25296.1 | 29512.2 | 33728.2 | 37944.2 |

TABLE 11-continued

DATA for oil
Bulk Modulus = (psi) 250000

| PIPE SIZE/SCHEDULE | OD (in) | OD AREA (in^2) | ID (in) | ID AREA (in^2) | WALL THCK (in) | VOL. @ DEPTH 2500 (in^3) | VOL. @ DEPTH 2750 (in^3) | VOL. @ DEPTH 3000 (in^3) | VOL. @ DEPTH 3250 (in^3) |
|---|---|---|---|---|---|---|---|---|---|
| ⅛" SCH 40 | 0.405 | 0.129 | 0.269 | 0.057 | 0.068 | 1704.1 | 1874.5 | 2044.9 | 2215.3 |
| ¼" SCH 40 | 0.540 | 0.229 | 0.364 | 0.104 | 0.088 | 3120.3 | 3432.3 | 3744.3 | 4056.4 |
| ⅜" SCH 40 | 0.675 | 0.358 | 0.493 | 0.191 | 0.091 | 5723.8 | 6296.2 | 6868.6 | 7440.9 |
| ½" SCH 40 | 0.840 | 0.554 | 0.622 | 0.304 | 0.109 | 9111.1 | 10022.2 | 10933.3 | 11844.5 |
| ¾" SCH 40 | 1.050 | 0.865 | 0.824 | 0.533 | 0.113 | 15989.9 | 17588.9 | 19187.9 | 20786.9 |
| 1" SCH 40 | 1.315 | 1.357 | 1.049 | 0.864 | 0.133 | 25914.4 | 28505.9 | 31097.3 | 33688.8 |
| 1¼" SCH 40 | 1.660 | 2.163 | 1.380 | 1.495 | 0.140 | 44848.6 | 49333.5 | 53818.3 | 58303.2 |
| 1½" SCH 40 | 1.900 | 2.834 | 1.610 | 2.035 | 0.145 | 61044.0 | 67148.4 | 73252.7 | 79357.1 |
| ⅛" SCH 80 | 0.405 | 0.129 | 0.215 | 0.036 | 0.095 | 1088.6 | 1197.5 | 1306.3 | 1415.2 |
| ¼" SCH 80 | 0.540 | 0.229 | 0.302 | 0.072 | 0.119 | 2147.9 | 2362.6 | 2577.4 | 2792.2 |
| ⅜" SCH 80 | 0.675 | 0.358 | 0.423 | 0.140 | 0.126 | 4213.8 | 4635.2 | 5056.5 | 5477.9 |
| ½" SCH 80 | 0.840 | 0.554 | 0.546 | 0.234 | 0.147 | 7020.6 | 7722.7 | 8424.8 | 9126.8 |
| ¾" SCH 80 | 1.050 | 0.865 | 0.742 | 0.432 | 0.154 | 12965.8 | 14262.4 | 15558.9 | 16855.5 |
| 1" SCH 80 | 1.315 | 1.357 | 0.957 | 0.719 | 0.179 | 21568.2 | 23725.1 | 25881.9 | 28038.7 |
| 1¼" SCH 80 | 1.660 | 2.163 | 1.278 | 1.282 | 0.191 | 38463.8 | 42310.2 | 46156.6 | 50003.0 |
| 1½" SCH 80 | 1.900 | 2.834 | 1.500 | 1.766 | 0.200 | 52987.5 | 58286.3 | 63585.0 | 68883.8 |
| ½" SCH 160 | 0.840 | 0.554 | 0.464 | 0.169 | 0.188 | 5070.2 | 5577.2 | 6084.3 | 6591.3 |
| ¾" SCH 160 | 1.050 | 0.865 | 0.612 | 0.294 | 0.219 | 8820.5 | 9702.6 | 10584.6 | 11466.7 |
| 1" SCH 160 | 1.315 | 1.357 | 0.815 | 0.521 | 0.250 | 15642.5 | 17206.7 | 18771.0 | 20335.2 |
| 1¼" SCH 160 | 1.660 | 2.163 | 1.160 | 1.056 | 0.250 | 31688.9 | 34857.8 | 38026.7 | 41195.5 |
| 1½" SCH 160 | 1.900 | 2.834 | 1.338 | 1.405 | 0.281 | 42160.2 | 46376.3 | 50592.3 | 54808.3 |

| PIPE SIZE/SCHEDULE | OD (in) | OD AREA (in^2) | ID (in) | ID AREA (in^2) | WALL THCK (in) | VOL. @ DEPTH 3500 (in^3) | VOL. @ DEPTH 3750 (in^3) | VOL. @ DEPTH 4000 (in^3) |
|---|---|---|---|---|---|---|---|---|
| ⅛" SCH 40 | 0.405 | 0.129 | 0.269 | 0.057 | 0.068 | 2385.7 | 2556.2 | 2726.6 |
| ¼" SCH 40 | 0.540 | 0.229 | 0.364 | 0.104 | 0.088 | 4368.4 | 4680.4 | 4992.4 |
| ⅜" SCH 40 | 0.675 | 0.358 | 0.493 | 0.191 | 0.091 | 8013.3 | 8585.7 | 9158.1 |
| ½" SCH 40 | 0.840 | 0.554 | 0.622 | 0.304 | 0.109 | 12755.6 | 13666.7 | 14577.8 |
| ¾" SCH 40 | 1.050 | 0.865 | 0.824 | 0.533 | 0.113 | 22385.8 | 23984.8 | 25583.8 |
| 1" SCH 40 | 1.315 | 1.357 | 1.049 | 0.864 | 0.133 | 36280.2 | 38871.7 | 41463.1 |
| 1¼" SCH 40 | 1.660 | 2.163 | 1.380 | 1.495 | 0.140 | 62788.1 | 67272.9 | 71757.8 |
| 1½" SCH 40 | 1.900 | 2.834 | 1.610 | 2.035 | 0.145 | 85461.5 | 91565.9 | 97670.3 |
| ⅛" SCH 80 | 0.405 | 0.129 | 0.215 | 0.036 | 0.095 | 1524.0 | 1632.9 | 1741.8 |
| ¼" SCH 80 | 0.540 | 0.229 | 0.302 | 0.072 | 0.119 | 3007.0 | 3221.8 | 3436.6 |
| ⅜" SCH 80 | 0.675 | 0.358 | 0.423 | 0.140 | 0.126 | 5899.3 | 6320.7 | 6742.0 |
| ½" SCH 80 | 0.840 | 0.554 | 0.546 | 0.234 | 0.147 | 9828.9 | 10530.9 | 11233.0 |
| ¾" SCH 80 | 1.050 | 0.865 | 0.742 | 0.432 | 0.154 | 18152.1 | 19448.7 | 20745.3 |
| 1" SCH 80 | 1.315 | 1.357 | 0.957 | 0.719 | 0.179 | 30195.5 | 32352.4 | 34509.2 |
| 1¼" SCH 80 | 1.660 | 2.163 | 1.278 | 1.282 | 0.191 | 53849.4 | 57695.8 | 61542.1 |
| 1½" SCH 80 | 1.900 | 2.834 | 1.500 | 1.766 | 0.200 | 74182.5 | 79481.3 | 84780.0 |
| ½" SCH 160 | 0.840 | 0.554 | 0.464 | 0.169 | 0.188 | 7098.3 | 7605.3 | 8112.4 |
| ¾" SCH 160 | 1.050 | 0.865 | 0.612 | 0.294 | 0.219 | 12348.7 | 13230.8 | 14112.8 |
| 1" SCH 160 | 1.315 | 1.357 | 0.815 | 0.521 | 0.250 | 21899.5 | 23463.7 | 25028.0 |
| 1¼" SCH 160 | 1.660 | 2.163 | 1.160 | 1.056 | 0.250 | 44364.4 | 47533.3 | 50702.2 |
| 1½" SCH 160 | 1.900 | 2.834 | 1.338 | 1.405 | 0.281 | 59024.3 | 63240.4 | 67456.4 |

TABLE 12

Drive Delta-P = (psi) 500

| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
|---|---|---|---|---|---|---|---|
| ⅛" SCH 40 | 0.7 | 1.0 | 1.4 | 1.7 | 2.0 | 2.4 | 2.7 |
| ¼" SCH 40 | 1.2 | 1.9 | 2.5 | 3.1 | 3.7 | 4.4 | 5.0 |
| ⅜" SCH 40 | 2.3 | 3.4 | 4.6 | 5.7 | 6.9 | 8.0 | 9.2 |
| ½" SCH 40 | 3.6 | 5.5 | 7.3 | 9.1 | 10.9 | 12.8 | 14.6 |
| ¾" SCH 40 | 6.4 | 9.6 | 12.8 | 16.0 | 19.2 | 22.4 | 25.6 |
| 1" SCH 40 | 10.4 | 15.5 | 20.7 | 25.9 | 31.1 | 36.3 | 41.5 |
| 1¼" SCH 40 | 17.9 | 26.9 | 35.9 | 44.8 | 53.8 | 62.8 | 71.8 |
| 1½" SCH 40 | 24.4 | 36.6 | 48.8 | 61.0 | 73.3 | 85.5 | 97.7 |
| ⅛" SCH 80 | 0.4 | 0.7 | 0.9 | 1.1 | 1.3 | 1.5 | 1.7 |
| ¼" SCH 80 | 0.9 | 1.3 | 1.7 | 2.1 | 2.6 | 3.0 | 3.4 |

TABLE 12-continued

| | | | | | | | |
|---|---|---|---|---|---|---|---|
| ⅜" SCH 80 | 1.7 | 2.5 | 3.4 | 4.2 | 5.1 | 5.9 | 6.7 |
| ½" SCH 80 | 2.8 | 4.2 | 5.6 | 7.0 | 8.4 | 9.8 | 11.2 |
| ¾" SCH 80 | 5.2 | 7.8 | 10.4 | 13.0 | 15.6 | 18.2 | 20.7 |
| 1" SCH 80 | 8.6 | 12.9 | 17.3 | 21.6 | 25.9 | 30.2 | 34.5 |
| 1¼" SCH 80 | 15.4 | 23.1 | 30.8 | 38.5 | 46.2 | 53.8 | 61.5 |
| 1½" SCH 80 | 21.2 | 31.8 | 42.4 | 53.0 | 63.6 | 74.2 | 84.8 |
| ½" SCH 160 | 2.0 | 3.0 | 4.1 | 5.1 | 6.1 | 7.1 | 8.1 |
| ¾" SCH 160 | 3.5 | 5.3 | 7.1 | 8.8 | 10.6 | 12.3 | 14.1 |
| 1" SCH 160 | 6.3 | 9.4 | 12.5 | 15.6 | 18.8 | 21.9 | 25.0 |
| 1¼" SCH 160 | 12.7 | 19.0 | 25.4 | 31.7 | 38.0 | 44.4 | 50.7 |
| 1½" SCH 160 | 16.9 | 25.3 | 33.7 | 42.2 | 50.6 | 59.0 | 67.5 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 3.1 | 3.4 | 3.7 | 4.1 | 4.4 | 4.8 | 5.1 | 5.5 |
| ¼" SCH 40 | 5.6 | 6.2 | 6.9 | 7.5 | 8.1 | 8.7 | 9.4 | 10.0 |
| ⅜" SCH 40 | 10.3 | 11.4 | 12.6 | 13.7 | 14.9 | 16.0 | 17.2 | 18.3 |
| ½" SCH 40 | 16.4 | 18.2 | 20.0 | 21.9 | 23.7 | 25.5 | 27.3 | 29.2 |
| ¾" SCH 40 | 28.8 | 32.0 | 35.2 | 38.4 | 41.6 | 44.8 | 48.0 | 51.2 |
| 1" SCH 40 | 46.6 | 51.8 | 57.0 | 62.2 | 67.4 | 72.6 | 77.7 | 82.9 |
| 1¼" SCH 40 | 80.7 | 89.7 | 98.7 | 107.6 | 116.6 | 125.6 | 134.5 | 143.5 |
| 1½" SCH 40 | 109.9 | 122.1 | 134.3 | 146.5 | 158.7 | 170.9 | 183.1 | 195.3 |
| ⅛" SCH 80 | 2.0 | 2.2 | 2.4 | 2.6 | 2.8 | 3.0 | 3.3 | 3.5 |
| ¼" SCH 80 | 3.9 | 4.3 | 4.7 | 5.2 | 5.6 | 6.0 | 6.4 | 6.9 |
| ⅜" SCH 80 | 7.6 | 8.4 | 9.3 | 10.1 | 11.0 | 11.8 | 12.6 | 13.5 |
| ½" SCH 80 | 12.6 | 14.0 | 15.4 | 16.8 | 18.3 | 19.7 | 21.1 | 22.5 |
| ¾" SCH 80 | 23.3 | 25.9 | 28.5 | 31.1 | 33.7 | 36.3 | 38.9 | 41.5 |
| 1" SCH 80 | 38.8 | 43.1 | 47.5 | 51.8 | 56.1 | 60.4 | 64.7 | 69.0 |
| 1¼" SCH 80 | 69.2 | 76.9 | 84.6 | 92.3 | 100.0 | 107.7 | 115.4 | 123.1 |
| 1½" SCH 80 | 95.4 | 106.0 | 116.6 | 127.2 | 137.8 | 148.4 | 159.0 | 169.6 |
| ½" SCH 160 | 9.1 | 10.1 | 11.2 | 12.2 | 13.2 | 14.2 | 15.2 | 16.2 |
| ¾" SCH 160 | 15.9 | 17.6 | 19.4 | 21.2 | 22.9 | 24.7 | 26.5 | 28.2 |
| 1" SCH 160 | 28.2 | 31.3 | 34.4 | 37.5 | 40.7 | 43.8 | 46.9 | 50.1 |
| 1¼" SCH 160 | 57.0 | 63.4 | 69.7 | 76.1 | 82.4 | 88.7 | 95.1 | 101.4 |
| 1½" SCH 160 | 75.9 | 84.3 | 92.8 | 101.2 | 109.6 | 118.0 | 126.5 | 134.9 |

TABLE 13

Drive Delta-P = (psi) 750

| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
|---|---|---|---|---|---|---|---|
| ⅛" SCH 40 | 1.0 | 1.5 | 2.0 | 2.6 | 3.1 | 3.6 | 4.1 |
| ¼" SCH 40 | 1.9 | 2.8 | 3.7 | 4.7 | 5.6 | 6.6 | 7.5 |
| ⅜" SCH 40 | 3.4 | 5.2 | 6.9 | 8.6 | 10.3 | 12.0 | 13.7 |
| ½" SCH 40 | 5.5 | 8.2 | 10.9 | 13.7 | 16.4 | 19.1 | 21.9 |
| ¾" SCH 40 | 9.6 | 14.4 | 19.2 | 24.0 | 28.8 | 33.6 | 38.4 |
| 1" SCH 40 | 15.5 | 23.3 | 31.1 | 38.9 | 46.6 | 54.4 | 62.2 |
| 1¼" SCH 40 | 26.9 | 40.4 | 53.8 | 67.3 | 80.7 | 94.2 | 107.6 |
| 1½" SCH 40 | 36.6 | 54.9 | 73.3 | 91.6 | 109.9 | 128.2 | 146.5 |
| ⅛" SCH 80 | 0.7 | 1.0 | 1.3 | 1.6 | 2.0 | 2.3 | 2.6 |
| ¼" SCH 80 | 1.3 | 1.9 | 2.6 | 3.2 | 3.9 | 4.5 | 5.2 |
| ⅜" SCH 80 | 2.5 | 3.8 | 5.1 | 6.3 | 7.6 | 8.8 | 10.1 |
| ½" SCH 80 | 4.2 | 6.3 | 8.4 | 10.5 | 12.6 | 14.7 | 16.8 |
| ¾" SCH 80 | 7.8 | 11.7 | 15.6 | 19.4 | 23.3 | 27.2 | 31.1 |
| 1" SCH 80 | 12.9 | 19.4 | 25.9 | 32.4 | 38.8 | 45.3 | 51.8 |
| 1¼" SCH 80 | 23.1 | 34.6 | 46.2 | 57.7 | 69.2 | 80.8 | 92.3 |
| 1½" SCH 80 | 31.8 | 47.7 | 63.6 | 79.5 | 95.4 | 111.3 | 127.2 |
| ½" SCH 160 | 3.0 | 4.6 | 6.1 | 7.6 | 9.1 | 10.6 | 12.2 |
| ¾" SCH 160 | 5.3 | 7.9 | 10.6 | 13.2 | 15.9 | 18.5 | 21.2 |
| 1" SCH 160 | 9.4 | 14.1 | 18.8 | 23.5 | 28.2 | 32.8 | 37.5 |
| 1¼" SCH 160 | 19.0 | 28.5 | 38.0 | 47.5 | 57.0 | 66.5 | 76.1 |
| 1½" SCH 160 | 25.3 | 37.9 | 50.6 | 63.2 | 75.9 | 88.5 | 101.2 |

TABLE 13-continued

| Drive Delta-P = (psi) 750 | | | | | | | | |
|---|---|---|---|---|---|---|---|---|
| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
| ⅛" SCH 40 | 4.6 | 5.1 | 5.6 | 6.1 | 6.6 | 7.2 | 7.7 | 8.2 |
| ¼" SCH 40 | 8.4 | 9.4 | 10.3 | 11.2 | 12.2 | 13.1 | 14.0 | 15.0 |
| ⅜" SCH 40 | 15.5 | 17.2 | 18.9 | 20.6 | 22.3 | 24.0 | 25.8 | 27.5 |
| ½" SCH 40 | 24.6 | 27.3 | 30.1 | 32.8 | 35.5 | 38.3 | 41.0 | 43.7 |
| ¾" SCH 40 | 43.2 | 48.0 | 52.8 | 57.6 | 62.4 | 67.2 | 72.0 | 76.8 |
| 1" SCH 40 | 70.0 | 77.7 | 85.5 | 93.3 | 101.1 | 108.8 | 116.6 | 124.4 |
| 1¼" SCH 40 | 121.1 | 134.5 | 148.0 | 161.5 | 174.9 | 188.4 | 201.8 | 215.3 |
| 1½" SCH 40 | 164.8 | 183.1 | 201.4 | 219.8 | 238.1 | 256.4 | 274.7 | 293.0 |
| ⅛" SCH 80 | 2.9 | 3.3 | 3.6 | 3.9 | 4.2 | 4.6 | 4.9 | 5.2 |
| ¼" SCH 80 | 5.8 | 6.4 | 7.1 | 7.7 | 8.4 | 9.0 | 9.7 | 10.3 |
| ⅜" SCH 80 | 11.4 | 12.6 | 13.9 | 15.2 | 16.4 | 17.7 | 19.0 | 20.2 |
| ½" SCH 80 | 19.0 | 21.1 | 23.2 | 25.3 | 27.4 | 29.5 | 31.6 | 33.7 |
| ¾" SCH 80 | 35.0 | 38.9 | 42.8 | 46.7 | 50.6 | 54.5 | 58.3 | 62.2 |
| 1" SCH 80 | 58.2 | 64.7 | 71.2 | 77.6 | 84.1 | 90.6 | 97.1 | 103.5 |
| 1¼" SCH 80 | 103.9 | 115.4 | 126.9 | 138.5 | 150.0 | 161.5 | 173.1 | 184.6 |
| 1½" SCH 80 | 143.1 | 159.0 | 174.9 | 190.8 | 206.7 | 222.5 | 238.4 | 254.3 |
| ½" SCH 160 | 13.7 | 15.2 | 16.7 | 18.3 | 19.8 | 21.3 | 22.8 | 24.3 |
| ¾" SCH 160 | 23.8 | 26.5 | 29.1 | 31.8 | 34.4 | 37.0 | 39.7 | 42.3 |
| 1" SCH 160 | 42.2 | 46.9 | 51.6 | 56.3 | 61.0 | 65.7 | 70.4 | 75.1 |
| 1¼" SCH 160 | 85.6 | 95.1 | 104.6 | 114.1 | 123.6 | 133.1 | 142.6 | 152.1 |
| 1½" SCH 160 | 113.8 | 126.5 | 139.1 | 151.8 | 164.4 | 177.1 | 89.7 | 202.4 |

TABLE 14

| Drive Delta-P = (psi) 1000 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 1.4 | 2.0 | 2.7 | 3.4 | 4.1 | 4.8 | 5.5 |
| ¼" SCH 40 | 2.5 | 3.7 | 5.0 | 6.2 | 7.5 | 8.7 | 10.0 |
| ⅜" SCH 40 | 4.6 | 6.9 | 9.2 | 11.4 | 13.7 | 16.0 | 18.3 |
| ½" SCH 40 | 7.3 | 10.9 | 14.6 | 18.2 | 21.9 | 25.5 | 29.2 |
| ¾" SCH 40 | 12.8 | 19.2 | 25.6 | 32.0 | 38.4 | 44.8 | 51.2 |
| 1" SCH 40 | 20.7 | 31.1 | 41.5 | 51.8 | 62.2 | 72.6 | 82.9 |
| 1¼" SCH 40 | 35.9 | 53.8 | 71.8 | 89.7 | 107.6 | 125.6 | 143.5 |
| 1½" SCH 40 | 48.8 | 73.3 | 97.7 | 122.1 | 146.5 | 170.9 | 195.3 |
| ⅛" SCH 80 | 0.9 | 1.3 | 1.7 | 2.2 | 2.6 | 3.0 | 3.5 |
| ¼" SCH 80 | 1.7 | 2.6 | 3.4 | 4.3 | 5.2 | 6.0 | 6.9 |
| ⅜" SCH 80 | 3.4 | 5.1 | 6.7 | 8.4 | 10.1 | 11.8 | 13.5 |
| ½" SCH 80 | 5.6 | 8.4 | 11.2 | 14.0 | 16.8 | 19.7 | 22.5 |
| ¾" SCH 80 | 10.4 | 15.6 | 20.7 | 25.9 | 31.1 | 36.3 | 41.5 |
| 1" SCH 80 | 17.3 | 25.9 | 34.5 | 43.1 | 51.8 | 60.4 | 69.0 |
| 1¼" SCH 80 | 30.8 | 46.2 | 61.5 | 76.9 | 92.3 | 107.7 | 123.1 |
| 1½" SCH 80 | 42.4 | 63.6 | 84.8 | 106.0 | 127.2 | 148.4 | 169.6 |
| ½" SCH 160 | 4.1 | 6.1 | 8.1 | 10.1 | 12.2 | 14.2 | 16.2 |
| ¾" SCH 160 | 7.1 | 10.6 | 14.1 | 17.6 | 21.2 | 24.7 | 28.2 |
| 1" SCH 160 | 12.5 | 18.8 | 25.0 | 31.3 | 37.5 | 43.8 | 50.1 |
| 1¼" SCH 160 | 25.4 | 38.0 | 50.7 | 63.4 | 76.1 | 88.7 | 101.4 |
| 1½" SCH 160 | 33.7 | 50.6 | 67.5 | 84.3 | 101.2 | 118.0 | 134.9 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 6.1 | 6.8 | 7.5 | 8.2 | 8.9 | 9.5 | 10.2 | 10.9 |
| ¼" SCH 40 | 11.2 | 12.5 | 13.7 | 15.0 | 16.2 | 17.5 | 18.7 | 20.0 |
| ⅜" SCH 40 | 20.6 | 22.9 | 25.2 | 27.5 | 29.8 | 32.1 | 34.3 | 36.6 |
| ½" SCH 40 | 32.8 | 36.4 | 40.1 | 43.7 | 47.4 | 51.0 | 54.7 | 58.3 |
| ¾" SCH 40 | 57.6 | 64.0 | 70.4 | 76.8 | 83.1 | 89.5 | 95.9 | 102.3 |
| 1" SCH 40 | 93.3 | 103.7 | 114.0 | 124.4 | 134.8 | 145.1 | 155.5 | 165.9 |
| 1¼" SCH 40 | 161.5 | 179.4 | 197.3 | 215.3 | 233.2 | 251.2 | 269.1 | 287.0 |
| 1½" SCH 40 | 219.8 | 244.2 | 268.6 | 293.0 | 317.4 | 341.8 | 366.3 | 390.7 |
| ⅛" SCH 80 | 3.9 | 4.4 | 4.8 | 5.2 | 5.7 | 6.1 | 6.5 | 7.0 |

TABLE 14-continued

| Drive Delta-P = (psi) 1000 | | | | | | | | |
|---|---|---|---|---|---|---|---|---|
| ¼" SCH 80 | 7.7 | 8.6 | 9.5 | 10.3 | 11.2 | 12.0 | 12.9 | 13.7 |
| ⅜" SCH 80 | 15.2 | 16.9 | 18.5 | 20.2 | 21.9 | 23.6 | 25.3 | 27.0 |
| ½" SCH 80 | 25.3 | 28.1 | 30.9 | 33.7 | 36.5 | 39.3 | 42.1 | 44.9 |
| ¾" SCH 80 | 46.7 | 51.9 | 57.0 | 62.2 | 67.4 | 72.6 | 77.8 | 83.0 |
| 1" SCH 80 | 77.6 | 86.3 | 94.9 | 103.5 | 112.2 | 120.8 | 129.4 | 138.0 |
| 1¼" SCH 80 | 138.5 | 153.9 | 169.2 | 184.6 | 200.0 | 215.4 | 230.8 | 246.2 |
| 1½" SCH 80 | 190.8 | 212.0 | 233.1 | 254.3 | 275.5 | 296.7 | 317.9 | 339.1 |
| ½" SCH 160 | 18.3 | 20.3 | 22.3 | 24.3 | 26.4 | 28.4 | 30.4 | 32.4 |
| ¾" SCH 160 | 31.8 | 35.3 | 38.8 | 42.3 | 45.9 | 49.4 | 52.9 | 56.5 |
| 1" SCH 160 | 56.3 | 62.6 | 68.8 | 75.1 | 81.3 | 87.6 | 93.9 | 100.1 |
| 1¼" SCH 160 | 114.1 | 126.8 | 139.4 | 152.1 | 164.8 | 177.5 | 190.1 | 202.8 |
| 1½" SCH 160 | 151.8 | 168.6 | 185.5 | 202.4 | 219.2 | 236.1 | 253.0 | 269.8 |

TABLE 15

| Drive Delta-P = (psi) 1250 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 1.7 | 2.6 | 3.4 | 4.3 | 5.1 | 6.0 | 6.8 |
| ¼" SCH 40 | 3.1 | 4.7 | 6.2 | 7.8 | 9.4 | 10.9 | 12.5 |
| ⅜" SCH 40 | 5.7 | 8.6 | 11.4 | 14.3 | 17.2 | 20.0 | 22.9 |
| ½" SCH 40 | 9.1 | 13.7 | 18.2 | 22.8 | 27.3 | 31.9 | 36.4 |
| ¾" SCH 40 | 16.0 | 24.0 | 32.0 | 40.0 | 48.0 | 56.0 | 64.0 |
| 1" SCH 40 | 25.9 | 38.9 | 51.8 | 64.8 | 77.7 | 90.7 | 103.7 |
| 1¼" SCH 40 | 44.8 | 67.3 | 89.7 | 112.1 | 134.5 | 157.0 | 179.4 |
| 1½" SCH 40 | 61.0 | 91.6 | 122.1 | 152.6 | 183.1 | 213.7 | 244.2 |
| ⅛" SCH 80 | 1.1 | 1.6 | 2.2 | 2.7 | 3.3 | 3.8 | 4.4 |
| ¼" SCH 80 | 2.1 | 3.2 | 4.3 | 5.4 | 6.4 | 7.5 | 8.6 |
| ⅜" SCH 80 | 4.2 | 6.3 | 8.4 | 10.5 | 12.6 | 14.7 | 16.9 |
| ½" SCH 80 | 7.0 | 10.5 | 14.0 | 17.6 | 21.1 | 24.6 | 28.1 |
| ¾" SCH 80 | 13.0 | 19.4 | 25.9 | 32.4 | 38.9 | 45.4 | 51.9 |
| 1" SCH 80 | 21.6 | 32.4 | 43.1 | 53.9 | 64.7 | 75.5 | 86.3 |
| 1¼" SCH 80 | 38.5 | 57.7 | 76.9 | 96.2 | 115.4 | 134.6 | 153.9 |
| 1½" SCH 80 | 53.0 | 79.5 | 106.0 | 132.5 | 159.0 | 185.5 | 212.0 |
| ½" SCH 160 | 5.1 | 7.6 | 10.1 | 12.7 | 15.2 | 17.7 | 20.3 |
| ¾" SCH 160 | 8.8 | 13.2 | 17.6 | 22.1 | 26.5 | 30.9 | 35.3 |
| 1" SCH 160 | 15.6 | 23.5 | 31.3 | 39.1 | 46.9 | 54.7 | 62.6 |
| 1¼" SCH 160 | 31.7 | 47.5 | 63.4 | 79.2 | 95.1 | 110.9 | 126.8 |
| 1½" SCH 160 | 42.2 | 63.2 | 84.3 | 105.4 | 126.5 | 147.6 | 168.6 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛' SCH 40 | 7.7 | 8.5 | 9.4 | 10.2 | 11.1 | 11.9 | 12.8 | 13.6 |
| ¼" SCH 40 | 14.0 | 15.6 | 17.2 | 18.7 | 20.3 | 21.8 | 23.4 | 25.0 |
| ⅜" SCH 40 | 25.8 | 28.6 | 31.5 | 34.3 | 37.2 | 40.1 | 42.9 | 45.8 |
| ½" SCH 40 | 41.0 | 45.6 | 50.1 | 54.7 | 59.2 | 63.8 | 68.3 | 72.9 |
| ¾" SCH 40 | 72.0 | 79.9 | 87.9 | 95.9 | 103.9 | 111.9 | 119.9 | 127.9 |
| 1" SCH 40 | 116.6 | 129.6 | 142.5 | 155.5 | 168.4 | 181.4 | 194.4 | 207.3 |
| 1¼" SCH 40 | 201.8 | 224.2 | 246.7 | 269.1 | 291.5 | 313.9 | 336.4 | 358.8 |
| 1½" SCH 40 | 274.7 | 305.2 | 335.7 | 366.3 | 396.8 | 427.3 | 457.8 | 488.4 |
| ⅛" SCH 80 | 4.9 | 5.4 | 6.0 | 6.5 | 7.1 | 7.6 | 8.2 | 8.7 |
| ¼" SCH 80 | 9.7 | 10.7 | 11.8 | 12.9 | 14.0 | 15.0 | 16.1 | 17.2 |
| ⅜" SCH 80 | 19.0 | 21.1 | 23.2 | 25.3 | 27.4 | 29.5 | 31.6 | 33.7 |
| ½" SCH 80 | 31.6 | 35.1 | 38.6 | 42.1 | 45.6 | 49.1 | 52.7 | 56.2 |
| ¾" SCH 80 | 58.3 | 64.8 | 71.3 | 77.8 | 84.3 | 90.8 | 97.2 | 103.7 |
| 1" SCH 80 | 97.1 | 107.8 | 118.6 | 129.4 | 140.2 | 151.0 | 161.8 | 172.5 |
| 1¼" SCH 80 | 173.1 | 192.3 | 211.6 | 230.8 | 250.0 | 269.2 | 288.5 | 307.7 |
| 1½" SCH 80 | 238.4 | 264.9 | 291.4 | 317.9 | 344.4 | 370.9 | 397.4 | 423.9 |
| ½" SCH 160 | 22.8 | 25.4 | 27.9 | 30.4 | 33.0 | 35.5 | 38.0 | 40.6 |
| ¾" SCH 160 | 39.7 | 44.1 | 48.5 | 52.9 | 57.3 | 61.7 | 66.2 | 70.6 |
| 1" SCH 160 | 70.4 | 78.2 | 86.0 | 93.9 | 101.7 | 109.5 | 117.3 | 125.1 |
| 1¼" SCH 160 | 142.6 | 158.4 | 174.3 | 190.1 | 206.0 | 221.8 | 237.7 | 253.5 |
| 1½" SCH 160 | 189.7 | 210.8 | 231.9 | 253.0 | 274.0 | 295.1 | 316.2 | 337.3 |

TABLE 16

Drive Delta-P = (psi) 1500

| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
|---|---|---|---|---|---|---|---|
| ⅛" SCH 40 | 2.0 | 3.1 | 4.1 | 5.1 | 6.1 | 7.2 | 8.2 |
| ¼" SCH 40 | 3.7 | 5.6 | 7.5 | 9.4 | 11.2 | 13.1 | 15.0 |
| ⅜" SCH 40 | 6.9 | 10.3 | 13.7 | 17.2 | 20.6 | 24.0 | 27.5 |
| ½" SCH 40 | 10.9 | 16.4 | 21.9 | 27.3 | 32.8 | 38.3 | 43.7 |
| ¾" SCH 40 | 19.2 | 28.8 | 38.4 | 48.0 | 57.6 | 67.2 | 76.8 |
| 1" SCH 40 | 31.1 | 46.6 | 62.2 | 77.7 | 93.3 | 108.8 | 124.4 |
| 1¼" SCH 40 | 53.8 | 80.7 | 107.6 | 134.5 | 161.5 | 188.4 | 215.3 |
| 1½" SCH 40 | 73.3 | 109.9 | 146.5 | 183.1 | 219.8 | 256.4 | 293.0 |
| ⅛" SCH 80 | 1.3 | 2.0 | 2.6 | 3.3 | 3.9 | 4.6 | 5.2 |
| ¼" SCH 80 | 2.6 | 3.9 | 5.2 | 6.4 | 7.7 | 9.0 | 10.3 |
| ⅜" SCH 80 | 5.1 | 7.6 | 10.1 | 12.6 | 15.2 | 17.7 | 20.2 |
| ½" SCH 80 | 8.4 | 12.6 | 16.8 | 21.1 | 25.3 | 29.5 | 33.7 |
| ¾" SCH 80 | 15.6 | 23.3 | 31.1 | 38.9 | 46.7 | 54.5 | 62.2 |
| 1" SCH 80 | 25.9 | 38.8 | 51.8 | 64.7 | 77.6 | 90.6 | 103.5 |
| 1¼" SCH 80 | 46.2 | 69.2 | 92.3 | 115.4 | 138.5 | 161.5 | 184.6 |
| 1½" SCH 80 | 63.6 | 95.4 | 127.2 | 159.0 | 190.8 | 222.5 | 254.3 |
| ½" SCH 160 | 6.1 | 9.1 | 12.2 | 15.2 | 18.3 | 21.3 | 24.3 |
| ¾" SCH 160 | 10.6 | 15.9 | 21.2 | 26.5 | 31.8 | 37.0 | 42.3 |
| 1" SCH 160 | 18.8 | 28.2 | 37.5 | 46.9 | 56.3 | 65.7 | 75.1 |
| 1¼" SCH 160 | 38.0 | 57.0 | 76.1 | 95.1 | 114.1 | 133.1 | 152.1 |
| 1½" SCH 160 | 50.6 | 75.9 | 101.2 | 126.5 | 151.8 | 177.1 | 202.4 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛' SCH 40 | 9.2 | 10.2 | 11.2 | 12.3 | 13.3 | 14.3 | 15.3 | 16.4 |
| ¼" SCH 40 | 16.8 | 18.7 | 20.6 | 22.5 | 24.3 | 26.2 | 28.1 | 30.0 |
| ⅜" SCH 40 | 30.9 | 34.3 | 37.8 | 41.2 | 44.6 | 48.1 | 51.5 | 54.9 |
| ½" SCH 40 | 49.2 | 54.7 | 60.1 | 65.6 | 71.1 | 76.5 | 82.0 | 87.5 |
| ¾" SCH 40 | 86.3 | 95.9 | 105.5 | 115.1 | 124.7 | 134.3 | 143.9 | 153.5 |
| 1" SCH 40 | 139.9 | 155.5 | 171.0 | 186.6 | 202.1 | 217.7 | 233.2 | 248.8 |
| 1¼" SCH 40 | 242.2 | 269.1 | 296.0 | 322.9 | 349.8 | 376.7 | 403.6 | 430.5 |
| 1½" SCH 40 | 329.6 | 366.3 | 402.9 | 439.5 | 476.1 | 512.8 | 549.4 | 586.0 |
| ⅛" SCH 80 | 5.9 | 6.5 | 7.2 | 7.8 | 8.5 | 9.1 | 9.8 | 10.5 |
| ¼" SCH 80 | 11.6 | 12.9 | 14.2 | 15.5 | 16.8 | 18.0 | 19.3 | 20.6 |
| ⅜" SCH 80 | 22.8 | 25.3 | 27.8 | 30.3 | 32.9 | 35.4 | 37.9 | 40.5 |
| ½" SCH 80 | 37.9 | 42.1 | 46.3 | 50.5 | 54.8 | 59.0 | 63.2 | 67.4 |
| ¾" SCH 80 | 70.0 | 77.8 | 85.6 | 93.4 | 101.1 | 108.9 | 116.7 | 124.5 |
| 1" SCH 80 | 116.5 | 129.4 | 142.4 | 155.3 | 168.2 | 181.2 | 194.1 | 207.1 |
| 1¼" SCH 80 | 207.7 | 230.8 | 253.9 | 276.9 | 300.0 | 323.1 | 346.2 | 369.3 |
| 1½" SCH 80 | 286.1 | 317.9 | 349.7 | 381.5 | 413.3 | 445.1 | 476.9 | 508.7 |
| ½" SCH 160 | 27.4 | 30.4 | 33.5 | 36.5 | 39.5 | 42.6 | 45.6 | 48.7 |
| ¾" SCH 160 | 47.6 | 52.9 | 58.2 | 63.5 | 68.8 | 74.1 | 79.4 | 84.7 |
| 1" SCH 160 | 84.5 | 93.9 | 103.2 | 112.6 | 122.0 | 131.4 | 140.8 | 150.2 |
| 1¼" SCH 160 | 171.1 | 190.1 | 209.1 | 228.2 | 247.2 | 266.2 | 285.2 | 304.2 |
| 1½" SCH 160 | 227.7 | 253.0 | 278.3 | 303.6 | 328.8 | 354.1 | 379.4 | 404.7 |

TABLE 17

Drive Delta-P = (psi) 1750

| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
|---|---|---|---|---|---|---|---|
| ⅛" SCH 40 | 2.4 | 3.6 | 4.8 | 6.0 | 7.2 | 8.4 | 9.5 |
| ¼" SCH 40 | 4.4 | 6.6 | 8.7 | 10.9 | 13.1 | 15.3 | 17.5 |
| ⅜" SCH 40 | 8.0 | 12.0 | 16.0 | 20.0 | 24.0 | 28.0 | 32.1 |
| ½" SCH 40 | 12.8 | 19.1 | 25.5 | 31.9 | 38.3 | 44.6 | 51.0 |
| ¾" SCH 40 | 22.4 | 33.6 | 44.8 | 56.0 | 67.2 | 78.4 | 89.5 |
| 1" SCH 40 | 36.3 | 54.4 | 72.6 | 90.7 | 108.8 | 127.0 | 145.1 |
| 1¼" SCH 40 | 62.8 | 94.2 | 125.6 | 157.0 | 188.4 | 219.8 | 251.2 |
| 1½" SCH 40 | 85.5 | 128.2 | 170.9 | 213.7 | 256.4 | 299.1 | 341.8 |
| ⅛" SCH 80 | 1.5 | 2.3 | 3.0 | 3.8 | 4.6 | 5.3 | 6.1 |

TABLE 17-continued

| Drive Delta-P = (psi) 1750 | | | | | | | |
|---|---|---|---|---|---|---|---|
| ¼" SCH 80 | 3.0 | 4.5 | 6.0 | 7.5 | 9.0 | 10.5 | 12.0 |
| ⅜" SCH 80 | 5.9 | 8.8 | 11.8 | 14.7 | 17.7 | 20.6 | 23.6 |
| ½" SCH 80 | 9.8 | 14.7 | 19.7 | 24.6 | 29.5 | 34.4 | 39.3 |
| ¾" SCH 80 | 18.2 | 27.2 | 36.3 | 45.4 | 54.5 | 63.5 | 72.6 |
| 1" SCH 80 | 30.2 | 45.3 | 60.4 | 75.5 | 90.6 | 105.7 | 120.8 |
| 1¼" SCH 80 | 53.8 | 80.8 | 107.7 | 134.6 | 161.5 | 188.5 | 215.4 |
| 1½" SCH 80 | 74.2 | 111.3 | 148.4 | 185.5 | 222.5 | 259.6 | 296.7 |
| ½" SCH 160 | 7.1 | 10.6 | 14.2 | 17.7 | 21.3 | 24.8 | 28.4 |
| ¾" SCH 160 | 12.3 | 18.5 | 24.7 | 30.9 | 37.0 | 43.2 | 49.4 |
| 1" SCH 160 | 21.9 | 32.8 | 43.8 | 54.7 | 65.7 | 76.6 | 87.6 |
| 1¼" SCH 160 | 44.4 | 66.5 | 88.7 | 110.9 | 133.1 | 155.3 | 177.5 |
| 1½" SCH 160 | 59.0 | 88.5 | 118.0 | 147.6 | 177.1 | 206.6 | 236.1 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 10.7 | 11.9 | 13.1 | 14.3 | 15.5 | 16.7 | 17.9 | 19.1 |
| ¼" SCH 40 | 19.7 | 21.8 | 24.0 | 26.2 | 28.4 | 30.6 | 32.8 | 34.9 |
| ⅜" SCH 40 | 36.1 | 40.1 | 44.1 | 48.1 | 52.1 | 56.1 | 60.1 | 64.1 |
| ½" SCH 40 | 57.4 | 63.8 | 70.2 | 76.5 | 82.9 | 89.3 | 95.7 | 102.0 |
| ¾" SCH 40 | 100.7 | 111.9 | 123.1 | 134.3 | 145.5 | 156.7 | 167.9 | 179.1 |
| 1" SCH 40 | 163.3 | 181.4 | 199.5 | 217.7 | 235.8 | 254.0 | 272.1 | 290.2 |
| 1¼" SCH 40 | 282.5 | 313.9 | 345.3 | 376.7 | 408.1 | 439.5 | 470.9 | 502.3 |
| 1½" SCH 40 | 384.6 | 427.3 | 470.0 | 512.8 | 555.5 | 598.2 | 641.0 | 683.7 |
| ⅛" SCH 80 | 6.9 | 7.6 | 8.4 | 9.1 | 9.9 | 10.7 | 11.4 | 12.2 |
| ¼" SCH 80 | 13.5 | 15.0 | 16.5 | 18.0 | 19.5 | 21.0 | 22.6 | 24.1 |
| ⅜" SCH 80 | 26.5 | 29.5 | 32.4 | 35.4 | 38.3 | 41.3 | 44.2 | 47.2 |
| ½" SCH 80 | 44.2 | 49.1 | 54.1 | 59.0 | 63.9 | 68.8 | 73.7 | 78.6 |
| ¾" SCH 80 | 81.7 | 90.8 | 99.8 | 108.9 | 118.0 | 127.1 | 136.1 | 145.2 |
| 1" SCH 80 | 135.9 | 151.0 | 166.1 | 181.2 | 196.3 | 211.4 | 226.5 | 241.6 |
| 1¼" SCH 80 | 242.3 | 269.2 | 296.2 | 323.1 | 350.0 | 376.9 | 403.9 | 430.8 |
| 1½" SCH 80 | 333.8 | 370.9 | 408.0 | 445.1 | 482.2 | 519.3 | 556.4 | 593.5 |
| ½" SCH 160 | 31.9 | 35.5 | 39.0 | 42.6 | 46.1 | 49.7 | 53.2 | 56.8 |
| ¾" SCH 160 | 55.6 | 61.7 | 67.9 | 74.1 | 80.3 | 86.4 | 92.6 | 98.8 |
| 1" SCH 160 | 98.5 | 109.5 | 120.4 | 131.4 | 142.3 | 153.3 | 164.2 | 175.2 |
| 1¼" SCH 160 | 199.6 | 221.8 | 244.0 | 266.2 | 288.4 | 310.6 | 332.7 | 354.9 |
| 1½" SCH 160 | 265.6 | 295.1 | 324.6 | 354.1 | 383.7 | 413.2 | 442.7 | 472.2 |

TABLE 18

| Drive Delta-P = (psi) 2000 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 2.7 | 4.1 | 5.5 | 6.8 | 8.2 | 9.5 | 10.9 |
| ¼" SCH 40 | 5.0 | 7.5 | 10.0 | 12.5 | 15.0 | 17.5 | 20.0 |
| ⅜" SCH 40 | 9.2 | 13.7 | 18.3 | 22.9 | 27.5 | 32.1 | 36.6 |
| ½" SCH 40 | 14.6 | 21.9 | 29.2 | 36.4 | 43.7 | 51.0 | 58.3 |
| ¾" SCH 40 | 25.6 | 38.4 | 51.2 | 64.0 | 76.8 | 89.5 | 102.3 |
| 1" SCH 40 | 41.5 | 62.2 | 82.9 | 103.7 | 124.4 | 145.1 | 165.9 |
| 1¼" SCH 40 | 71.8 | 107.6 | 143.5 | 179.4 | 215.3 | 251.2 | 287.0 |
| 1½" SCH 40 | 97.7 | 146.5 | 195.3 | 244.2 | 293.0 | 341.8 | 390.7 |
| ⅛" SCH 80 | 1.7 | 2.6 | 3.5 | 4.4 | 5.2 | 6.1 | 7.0 |
| ¼" SCH 80 | 3.4 | 5.2 | 6.9 | 8.6 | 10.3 | 12.0 | 13.7 |
| ⅜" SCH 80 | 6.7 | 10.1 | 13.5 | 16.9 | 20.2 | 23.6 | 27.0 |
| ½" SCH 80 | 11.2 | 16.8 | 22.5 | 28.1 | 33.7 | 39.3 | 44.9 |
| ¾" SCH 80 | 20.7 | 31.1 | 41.5 | 51.9 | 62.2 | 72.6 | 83.0 |
| 1" SCH 80 | 34.5 | 51.8 | 69.0 | 86.3 | 103.5 | 120.8 | 138.0 |
| 1¼" SCH 80 | 61.5 | 92.3 | 123.1 | 153.9 | 184.6 | 215.4 | 246.2 |
| 1½" SCH 80 | 84.8 | 127.2 | 169.6 | 212.0 | 254.3 | 296.7 | 339.1 |
| ½" SCH 160 | 8.1 | 12.2 | 16.2 | 20.3 | 24.3 | 28.4 | 32.4 |
| ¾" SCH 160 | 14.1 | 21.2 | 28.2 | 35.3 | 42.3 | 49.4 | 56.5 |
| 1" SCH 160 | 25.0 | 37.5 | 50.1 | 62.6 | 75.1 | 87.6 | 100.1 |
| 1¼" SCH 160 | 50.7 | 76.1 | 101.4 | 126.8 | 152.1 | 177.5 | 202.8 |
| 1½" SCH 160 | 67.5 | 101.2 | 134.9 | 168.6 | 202.4 | 236.1 | 269.8 |

TABLE 18-continued

| Drive Delta-P = (psi) 2000 | | | | | | | | |
|---|---|---|---|---|---|---|---|---|
| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
| ⅛" SCH 40 | 12.3 | 13.6 | 15.0 | 16.4 | 17.7 | 19.1 | 20.4 | 21.8 |
| ¼" SCH 40 | 22.5 | 25.0 | 27.5 | 30.0 | 32.5 | 34.9 | 37.4 | 39.9 |
| ⅜" SCH 40 | 41.2 | 45.8 | 50.4 | 54.9 | 59.5 | 64.1 | 68.7 | 73.3 |
| ½" SCH 40 | 65.6 | 72.9 | 80.2 | 87.5 | 94.8 | 102.0 | 109.3 | 116.6 |
| ¾" SCH 40 | 115.1 | 127.9 | 140.7 | 153.5 | 166.3 | 179.1 | 191.9 | 204.7 |
| 1" SCH 40 | 186.6 | 207.3 | 228.0 | 248.8 | 269.5 | 290.2 | 311.0 | 331.7 |
| 1¼" SCH 40 | 322.9 | 358.8 | 394.7 | 430.5 | 466.4 | 502.3 | 538.2 | 574.1 |
| 1½" SCH 40 | 439.5 | 488.4 | 537.2 | 586.0 | 634.9 | 683.7 | 732.5 | 781.4 |
| ⅛" SCH 80 | 7.8 | 8.7 | 9.6 | 10.5 | 11.3 | 12.2 | 13.1 | 13.9 |
| ¼" SCH 80 | 15.5 | 17.2 | 18.9 | 20.6 | 22.3 | 24.1 | 25.8 | 27.5 |
| ⅜" SCH 80 | 30.3 | 33.7 | 37.1 | 40.5 | 43.8 | 47.2 | 50.6 | 53.9 |
| ½" SCH 80 | 50.5 | 56.2 | 61.8 | 67.4 | 73.0 | 78.6 | 84.2 | 89.9 |
| ¾" SCH 80 | 93.4 | 103.7 | 114.1 | 124.5 | 134.8 | 145.2 | 155.6 | 166.0 |
| 1" SCH 80 | 155.3 | 172.5 | 189.8 | 207.1 | 224.3 | 241.6 | 258.8 | 276.1 |
| 1¼" SCH 80 | 276.9 | 307.7 | 338.5 | 369.3 | 400.0 | 430.8 | 461.6 | 492.3 |
| 1½" SCH 80 | 381.5 | 423.9 | 466.3 | 508.7 | 551.1 | 593.5 | 635.9 | 678.2 |
| ½" SCH 160 | 36.5 | 40.6 | 44.6 | 48.7 | 52.7 | 56.8 | 60.8 | 64.9 |
| ¾" SCH 160 | 63.5 | 70.6 | 77.6 | 84.7 | 91.7 | 98.8 | 105.8 | 112.9 |
| 1" SCH 160 | 112.6 | 125.1 | 137.7 | 150.2 | 162.7 | 175.2 | 187.7 | 200.2 |
| 1¼" SCH 160 | 228.2 | 253.5 | 278.9 | 304.2 | 329.6 | 354.9 | 380.3 | 405.6 |
| 1½" SCH 160 | 303.6 | 337.3 | 371.0 | 404.7 | 438.5 | 472.2 | 505.9 | 539.7 |

TABLE 19

| Drive Delta-P = (psi) 2250 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 3.1 | 4.6 | 6.1 | 7.7 | 9.2 | 10.7 | 12.3 |
| ¼" SCH 40 | 5.6 | 8.4 | 11.2 | 14.0 | 16.8 | 19.7 | 22.5 |
| ⅜" SCH 40 | 10.3 | 15.5 | 20.6 | 25.8 | 30.9 | 36.1 | 41.2 |
| ½" SCH 40 | 16.4 | 24.6 | 32.8 | 41.0 | 49.2 | 57.4 | 65.6 |
| ¾" SCH 40 | 28.8 | 43.2 | 57.6 | 72.0 | 86.3 | 100.7 | 115.1 |
| 1" SCH 40 | 46.6 | 70.0 | 93.3 | 116.6 | 139.9 | 163.3 | 186.6 |
| 1¼" SCH 40 | 80.7 | 121.1 | 161.5 | 201.8 | 242.2 | 282.5 | 322.9 |
| 1½" SCH 40 | 109.9 | 164.8 | 219.8 | 274.7 | 329.6 | 384.6 | 439.5 |
| ⅛" SCH 80 | 2.0 | 2.9 | 3.9 | 4.9 | 5.9 | 6.9 | 7.8 |
| ¼" SCH 80 | 3.9 | 5.8 | 7.7 | 9.7 | 11.6 | 13.5 | 15.5 |
| ⅜" SCH 80 | 7.6 | 11.4 | 15.2 | 19.0 | 22.8 | 26.5 | 30.3 |
| ½" SCH 80 | 12.6 | 19.0 | 25.3 | 31.6 | 37.9 | 44.2 | 50.5 |
| ¾" SCH 80 | 23.3 | 35.0 | 46.7 | 58.3 | 70.0 | 81.7 | 93.4 |
| 1" SCH 80 | 38.8 | 58.2 | 77.6 | 97.1 | 116.5 | 135.9 | 155.3 |
| 1¼" SCH 80 | 69.2 | 103.9 | 138.5 | 173.1 | 207.7 | 242.3 | 276.9 |
| 1½" SCH 80 | 95.4 | 143.1 | 190.8 | 238.4 | 286.1 | 333.8 | 381.5 |
| ½" SCH 160 | 9.1 | 13.7 | 18.3 | 22.8 | 27.4 | 31.9 | 36.5 |
| ¾" SCH 160 | 15.9 | 23.8 | 31.8 | 39.7 | 47.6 | 55.6 | 63.5 |
| 1" SCH 160 | 28.2 | 42.2 | 56.3 | 70.4 | 84.5 | 98.5 | 112.6 |
| 1¼" SCH 160 | 57.0 | 85.6 | 114.1 | 142.6 | 171.1 | 199.6 | 228.2 |
| 1½" SCH 160 | 75.9 | 113.8 | 151.8 | 189.7 | 227.7 | 265.6 | 303.6 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 13.8 | 15.3 | 16.9 | 18.4 | 19.9 | 21.5 | 23.0 | 24.5 |
| ¼" SCH 40 | 25.3 | 28.1 | 30.9 | 33.7 | 36.5 | 39.3 | 42.1 | 44.9 |
| ⅜" SCH 40 | 46.4 | 51.5 | 56.7 | 61.8 | 67.0 | 72.1 | 77.3 | 82.4 |
| ½" SCH 40 | 73.8 | 82.0 | 90.2 | 98.4 | 106.6 | 114.8 | 123.0 | 131.2 |
| ¾" SCH 40 | 129.5 | 143.9 | 158.3 | 172.7 | 187.1 | 201.5 | 215.9 | 230.3 |
| 1" SCH 40 | 209.9 | 233.2 | 256.6 | 279.9 | 303.2 | 326.5 | 349.8 | 373.2 |
| 1¼" SCH 40 | 363.3 | 403.6 | 444.0 | 484.4 | 524.7 | 565.1 | 605.5 | 645.8 |
| 1½" SCH 40 | 494.5 | 549.4 | 604.3 | 659.3 | 714.2 | 769.2 | 824.1 | 879.0 |
| ⅛" SCH 80 | 8.8 | 9.8 | 10.8 | 11.8 | 12.7 | 13.7 | 14.7 | 15.7 |

TABLE 19-continued

| Drive Delta-P = (psi) 2250 | | | | | | | | |
|---|---|---|---|---|---|---|---|---|
| ¼" SCH 80 | 17.4 | 19.3 | 21.3 | 23.2 | 25.1 | 27.1 | 29.0 | 30.9 |
| ⅜" SCH 80 | 34.1 | 37.9 | 41.7 | 45.5 | 49.3 | 53.1 | 56.9 | 60.7 |
| ½" SCH 80 | 56.9 | 63.2 | 69.5 | 75.8 | 82.1 | 88.5 | 94.8 | 101.1 |
| ¾" SCH 80 | 105.0 | 116.7 | 128.4 | 140.0 | 151.7 | 163.4 | 175.0 | 186.7 |
| 1" SCH 80 | 174.7 | 194.1 | 213.5 | 232.9 | 252.3 | 271.8 | 291.2 | 310.6 |
| 1¼" SCH 80 | 311.6 | 346.2 | 380.8 | 415.4 | 450.0 | 484.6 | 519.3 | 553.9 |
| 1½" SCH 80 | 429.2 | 476.9 | 524.6 | 572.3 | 620.0 | 667.6 | 715.3 | 763.0 |
| ½" SCH 160 | 41.1 | 45.6 | 50.2 | 54.8 | 59.3 | 63.9 | 68.4 | 73.0 |
| ¾" SCH 160 | 71.4 | 79.4 | 87.3 | 95.3 | 103.2 | 111.1 | 119.1 | 127.0 |
| 1" SCH 160 | 126.7 | 140.8 | 154.9 | 168.9 | 183.0 | 197.1 | 211.2 | 225.3 |
| 1¼" SCH 160 | 256.7 | 285.2 | 313.7 | 342.2 | 370.8 | 399.3 | 427.8 | 456.3 |
| 1½" SCH 160 | 341.5 | 379.4 | 417.4 | 455.3 | 493.3 | 531.2 | 569.2 | 607.1 |

TABLE 20

| Drive Delta-P = (psi) 2500 | | | | | | | |
|---|---|---|---|---|---|---|---|
| PIPE SIZE/ SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 3.4 | 5.1 | 6.8 | 8.5 | 10.2 | 11.9 | 13.6 |
| ¼" SCH 40 | 6.2 | 9.4 | 12.5 | 15.6 | 18.7 | 21.8 | 25.0 |
| ⅜" SCH 40 | 11.4 | 17.2 | 22.9 | 28.6 | 34.3 | 40.1 | 45.8 |
| ½" SCH 40 | 18.2 | 27.3 | 36.4 | 45.6 | 54.7 | 63.8 | 72.9 |
| ¾" SCH 40 | 32.0 | 48.0 | 64.0 | 79.9 | 95.9 | 111.9 | 127.9 |
| 1" SCH 40 | 51.8 | 77.7 | 103.7 | 129.6 | 155.5 | 181.4 | 207.3 |
| 1¼" SCH 40 | 89.7 | 134.5 | 179.4 | 224.2 | 269.1 | 313.9 | 358.8 |
| 1½" SCH 40 | 122.1 | 183.1 | 244.2 | 305.2 | 366.3 | 427.3 | 488.4 |
| ⅛" SCH 80 | 2.2 | 3.3 | 4.4 | 5.4 | 6.5 | 7.6 | 8.7 |
| ¼" SCH 80 | 4.3 | 6.4 | 8.6 | 10.7 | 12.9 | 15.0 | 17.2 |
| ⅜" SCH 80 | 8.4 | 12.6 | 16.9 | 21.1 | 25.3 | 29.5 | 33.7 |
| ½" SCH 80 | 14.0 | 21.1 | 28.1 | 35.1 | 42.1 | 49.1 | 56.2 |
| ¾" SCH 80 | 25.9 | 38.9 | 51.9 | 64.8 | 77.8 | 90.8 | 103.7 |
| 1" SCH 80 | 43.1 | 64.7 | 86.3 | 107.8 | 129.4 | 151.0 | 172.5 |
| 1¼" SCH 80 | 76.9 | 115.4 | 153.9 | 192.3 | 230.8 | 269.2 | 307.7 |
| 1½" SCH 80 | 106.0 | 159.0 | 212.0 | 264.9 | 317.9 | 370.9 | 423.9 |
| ½" SCH 160 | 10.1 | 15.2 | 20.3 | 25.4 | 30.4 | 35.5 | 40.6 |
| ¾" SCH 160 | 17.6 | 26.5 | 35.3 | 44.1 | 52.9 | 61.7 | 70.6 |
| 1" SCH 160 | 31.3 | 46.9 | 62.6 | 78.2 | 93.9 | 109.5 | 125.1 |
| 1¼" SCH 160 | 63.4 | 95.1 | 126.8 | 158.4 | 190.1 | 221.8 | 253.5 |
| 1½" SCH 160 | 84.3 | 126.5 | 168.6 | 210.8 | 253.0 | 295.1 | 337.3 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 15.3 | 17.0 | 18.7 | 20.4 | 22.2 | 23.9 | 25.6 | 27.3 |
| ¼" SCH 40 | 28.1 | 31.2 | 34.3 | 37.4 | 40.6 | 43.7 | 46.8 | 49.9 |
| ⅜" SCH 40 | 51.5 | 57.2 | 63.0 | 68.7 | 74.4 | 80.1 | 85.9 | 91.6 |
| ½" SCH 40 | 82.0 | 91.1 | 100.2 | 109.3 | 118.4 | 127.6 | 136.7 | 145.8 |
| ¾" SCH 40 | 143.9 | 159.9 | 175.9 | 191.9 | 207.9 | 223.9 | 239.8 | 255.8 |
| 1" SCH 40 | 233.2 | 259.1 | 285.1 | 311.0 | 336.9 | 362.8 | 388.7 | 414.6 |
| 1¼" SCH 40 | 403.6 | 448.5 | 493.3 | 538.2 | 583.0 | 627.9 | 672.7 | 717.6 |
| 1½" SCH 40 | 549.4 | 610.4 | 671.5 | 732.5 | 793.6 | 854.6 | 915.7 | 976.7 |
| ⅛" SCH 80 | 9.8 | 10.9 | 12.0 | 13.1 | 14.2 | 15.2 | 16.3 | 17.4 |
| ¼" SCH 80 | 19.3 | 21.5 | 23.6 | 25.8 | 27.9 | 30.1 | 32.2 | 34.4 |
| ⅜" SCH 80 | 37.9 | 42.1 | 46.4 | 50.6 | 54.8 | 59.0 | 63.2 | 67.4 |
| ½" SCH 80 | 63.2 | 70.2 | 77.2 | 84.2 | 91.3 | 98.3 | 105.3 | 112.3 |
| ¾" SCH 80 | 116.7 | 129.7 | 142.6 | 155.6 | 168.6 | 181.5 | 194.5 | 207.5 |
| 1" SCH 80 | 194.1 | 215.7 | 237.3 | 258.8 | 280.4 | 302.0 | 323.5 | 345.1 |
| 1¼" SCH 80 | 346.2 | 384.6 | 423.1 | 461.6 | 500.0 | 538.5 | 577.0 | 615.4 |
| 1½" SCH 80 | 476.9 | 529.9 | 582.9 | 635.9 | 688.8 | 741.8 | 794.8 | 847.8 |
| ½" SCH 160 | 45.6 | 50.7 | 55.8 | 60.8 | 65.9 | 71.0 | 76.1 | 81.1 |
| ¾" SCH 160 | 79.4 | 88.2 | 97.0 | 105.8 | 114.7 | 123.5 | 132.3 | 141.1 |
| 1" SCH 160 | 140.8 | 156.4 | 172.1 | 187.7 | 203.4 | 219.0 | 234.6 | 250.3 |
| 1¼" SCH 160 | 285.2 | 316.9 | 348.6 | 380.3 | 412.0 | 443.6 | 475.3 | 507.0 |
| 1½" SCH 160 | 379.4 | 421.6 | 463.8 | 505.9 | 548.1 | 590.2 | 632.4 | 674.6 |

The greater length of the conduit 546 for a given flow through conduit 546, the greater the amount of energy loss due to friction of the fluid in the conduit 546. The larger the conduit 546 for a given flow through the conduit 546, the lesser the amount of energy loss due to friction of the fluid in the conduit 546. The data in Table 21 provided below illustrate these concepts. These losses must be considered and balanced with the compression losses discussed previously to determine an optimum drive system configuration for the pumping system.

TABLE 21

DATA for oil
Specific gravity = 0.9
Viscosity (SUS) = 220
Bulk Modulus (psi) = 250000

| PIPE SIZE/ SCHEDULE | PRESSURE DROP/ 100 FEET OF PIPE FLOW = 10 GAL/MIN (PSI) | PRESSURE DROP/ 100 FEET OF PIPE FLOW = 15 GAL/MIN (PSI) | PRESSURE DROP/ 100 FEET OF PIPE FLOW = 20 GAL/MIN (PSI) |
|---|---|---|---|
| ⅜" SCH 40 | 185.0 | | |
| ½" SCH 40 | 73.0 | 109.0 | 146.0 |
| ¾" SCH 40 | 24.0 | 36.0 | 47.0 |
| 1" SCH 40 | 9.0 | 14.0 | 18.0 |
| 1¼" SCH 40 | 3.0 | 4.5 | 6.0 |
| 1½" SCH 40 | | 2.4 | 3.2 |

The pumping apparatus of preferred embodiments is also useful in applications where the fluid being pumped contains significant impurities, which can cause damage to conventional pumps, such as a centrifugal pump. For example, sand grains and particles can cause substantial and catastrophic failure to centrifugal pumps. In contrast, similarly sized particles do not cause substantial damage to the pumps of preferred embodiments. Provided the valves are appropriately chosen, even product fluid which contains suspended rocks and other solid materials can be pumped using the pumps of preferred embodiments. Accordingly, the maintenance costs and costs associated with pump failure are greatly reduced. In addition, such design enables filtration to occur after the product fluid is removed from its source, rather than requiring that the pump inlet contain a filter.

Figure 6A:
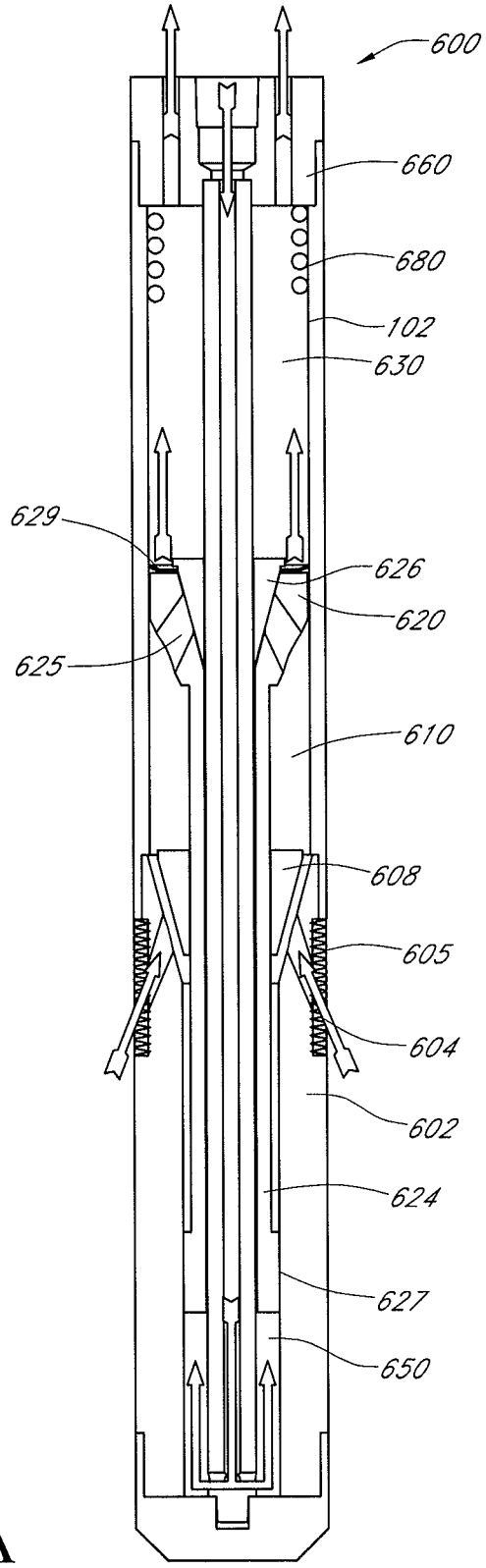
FIG. 6A provides a cross-sectional view of a pump fitted with a filter or screen to reduce the risk of plugging within the pump. The pump is depicted during the power stroke.
Figure 6B:
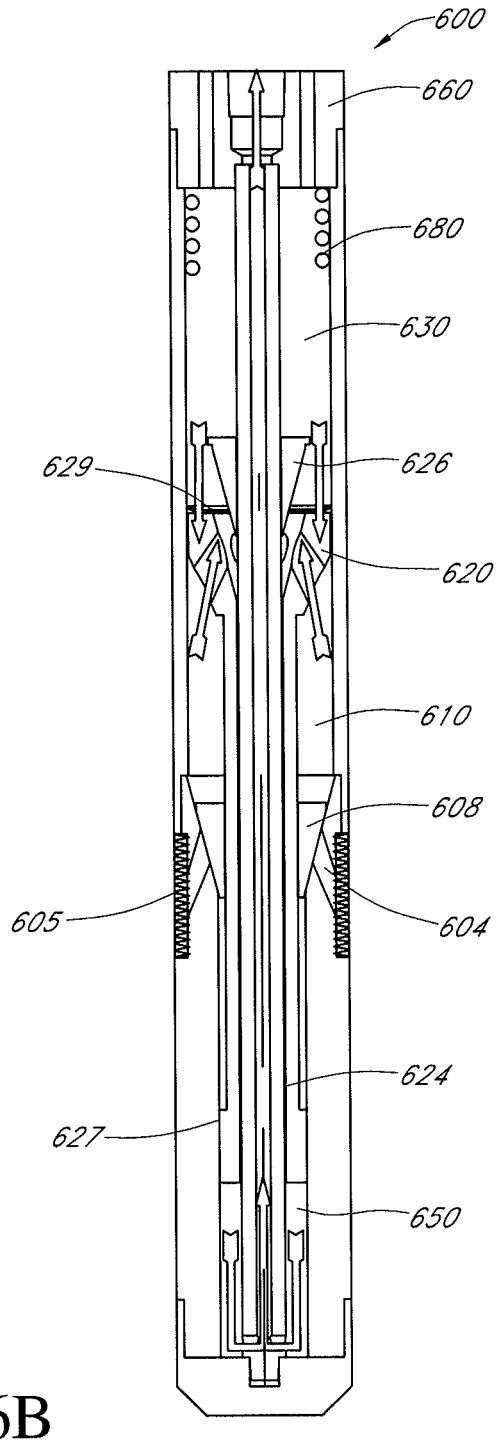
FIG. 6B provides a cross-sectional view of a pump according to preferred embodiment. The pump is depicted during the recovery stroke.
Figure 6C:
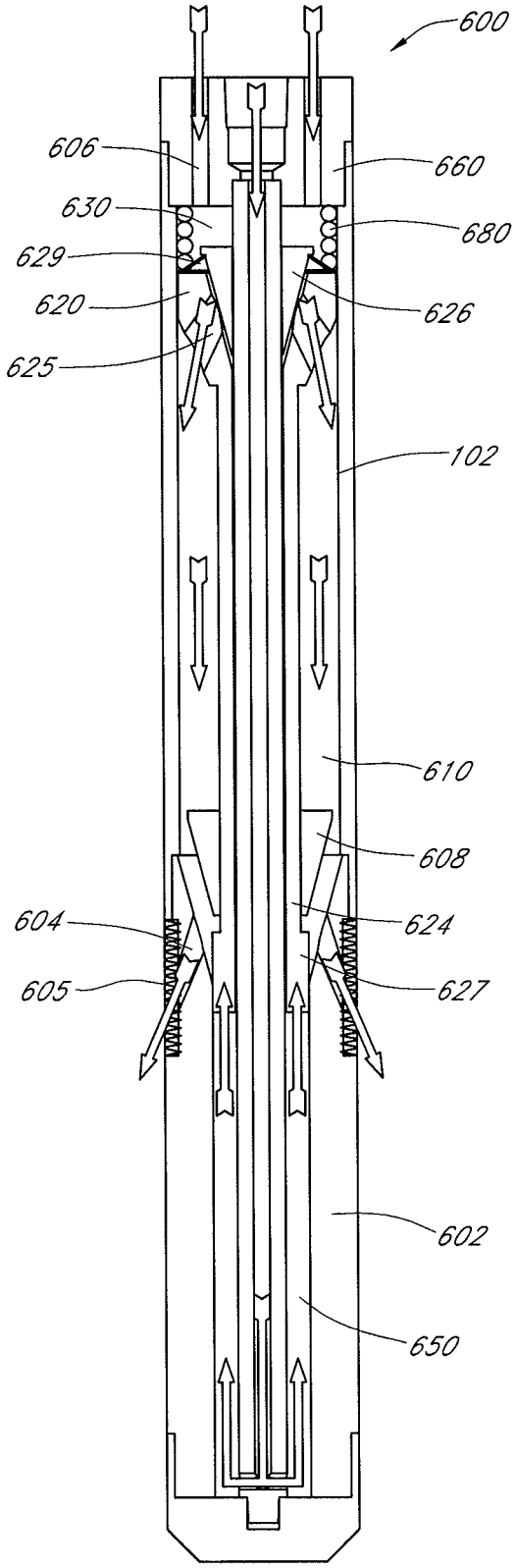
FIG. 6C provides a cross-sectional view of a pump according to a preferred embodiment. The pump is depicted during a cleaning operation wherein the transfer piston is lifted beyond its highest point during normal operation.

Nevertheless, in some embodiments, the pumping apparatus can be fitted with a filter or screen to reduce the risk of plugging within the pump as illustrated in FIGS. 6A-C. The embodiment illustrated in FIGS. 6A-C also employs a pump 600 that can be flushed or cleaned. The pump 600 is similar to the embodiments described above in connection with FIGS. 3-5, and therefore only the differences are discussed in detail.

The pump 600 can comprise a pump inlet filter 605. In the embodiment illustrated in FIGS. 6A-C, the filter 605 is a fluid inlet screen placed in the pump housing 602. Alternatively, the filter or screen can be set off from the exterior surface of the pump housing such that any build up on the filter does not block the pump inlet. However, in some circumstances where the accumulation of particles is less of a concern, the filter can be placed adjacent to or within the pump inlet, as illustrated. The filtering of fluid to the inlet of a pump is well-known in the art, and any suitable filtering or screening mechanism can be utilized. In preferred embodiments, screens that prevent sand particles from entering the pump and also prevent screen clogging are utilized. For example, in some embodiments, well screens with a v-shaped opening, such as Johnson Vee-Wire® screens, can be utilized. Preferred screens have an opening (sometimes referred to as the "slot size") of between about 0.01 inches to about 0.25 inches. These screens prevent the majority of fine sand particles from entering the pump. The openings in the screen are preferably smaller than the smallest channel within the pump. Therefore, any particles that pass through the screen do not plug the pump.

The size of particles permitted to flow through the pump is determined by the size of the perforations or holes in the filter or screen. Preferably, the diameters of the perforations/holes in the filter are at least as small as the smallest channel through which the product fluid passes. Typically, the smallest channel is one of (a) the pump inlet holes, (b) the transfer piston channel, or (c) the diameter of the opening created when either the inlet valve or the transfer piston valve opens. Therefore, any particle small enough to pass through the perforations/holes in the external filter is expected to pass through the pump apparatus without difficulty.

In some embodiments, one way valves are used to prevent the flow of fluid from the reverse direction, e.g., from the product chamber 630 to the transfer chamber 610, and from the transfer chamber 610 through the pump inlet 604. However allowing flow in the reverse direction is desirable in many circumstances, such as when the pump or inlet screen has become plugged or is no longer operating optimally. For example, sensors may detect an increased pressure drop across the inlet screen, or across one of the valves in the pump. Alternatively, the pump can be flushed at regular intervals to prevent the accumulation of particles, such as after it has been in operation for a predetermined period or after it has pumped a predetermined amount of fluid. Accordingly, FIGS. 6A-C illustrate an embodiment of a pump wherein the pump 600 is capable of allowing the reverse flow of product fluid.

In some embodiments, the pump 600 is provided with a mechanism by which the one-way valves, 608 (inlet valve) and 626 (transfer piston valve), are prevented from closing. In one embodiment, the one-way valves are prevented from closing only upon an increase in the power fluid pressure beyond the normal operating pressures. In such an embodiment, the increased pressure lifts the transfer piston 620 higher than it is typically lifted during normal operating conditions. Accordingly, any mechanism which utilizes the increased lift to prevent the valves from closing can be utilized.

In the embodiments illustrated in FIGS. 6A-C, the rod portion 624 of the transfer piston 620 contains an inlet valve stop 627. During regular operation of the pump 600, as illustrated in FIG. 6A and FIG. 6B, this inlet valve stop 627 does not alter the operation of the pump 600. When it is necessary to prop open the inlet valve 608 and allow reverse flow, such as for flushing, cleaning, or adding chemicals for cleaning or rehabilitating a hydraulic structure, the power fluid pressure is increased beyond the pressure utilized for normal operation of the pump, thereby lifting the transfer piston 620 higher than usual. When raised to this higher level, the inlet valve stop 627 catches the conical check valve member 608, thereby preventing it from closing, as illustrated in FIG. 6C. Thus, fluid is permitted to flow from the transfer chamber 610 through the pump inlet 604. The stop 627 need not be coupled to the transfer piston 620.

A transfer piston valve stop 629 can be coupled to the upper surface of the transfer piston 620. As shown in FIG. 6A and FIG. 6B, the valve stop 629 does not influence the operation of the pump 600 during normal operating conditions. However, when the power fluid pressure is increased beyond its normal operating parameters and the transfer piston rises higher than usual, the transfer piston valve stop 629 is activated and it prevents the transfer piston valve 626 from closing. In the embodiment illustrated, the transfer piston valve stop 629 comprises a v-shaped member, a portion of which is positioned under the transfer piston valve member 626. During normal operation, this v-shaped member does not prevent the transfer piston valve member 626 from lowering and sealing the transfer piston channel 625, as shown in FIG. 6A (power stroke) and FIG. 6B (recovery stroke). However, when the piston 620 rises to a predetermined level, an activator 680 applies force to the v-shaped member, thereby forcing the transfer piston valve 626 open, as illustrated in FIG. 6C. The activator 680 can take the form of a spring as illustrated, a rod extending down from the top cap 660, or it can be a stop mounted on the inside of the pump housing 602 in the product chamber 630. Numerous other mechanisms for activating the piston valve stop 629 as are known in the art are also suitable for use. In one embodiment, the activator 680 is a spring, as this prevents damage to the pump components (such as the top cap and piston) if the pressure of the power fluid is accidentally increased during normal operation.

Referring to FIG. 6C, if the pump becomes plugged or it is desirable to clean the pump or work on the well, the pump operator can supply power fluid at an increased pressure. The increased pressure in the power fluid chamber 650 lifts the transfer piston 620 beyond its highest point during normal operation. For example, if the power fluid is supplied at 1000 psi during normal operation to lift the transfer piston, the power fluid might be supplied at 1200 psi in order for the stop to contact the activator. The inlet valve stop 627 prevents the inlet valve 608 from closing. Similarly, the transfer piston valve stop 629 prevents the transfer piston valve 626 from closing. The product fluid is then permitted to flow from the pump outlet 606 into the product chamber 630, from the product chamber 630 to the transfer chamber 610, and from the transfer chamber 610 through the pump inlet 604 to the fluid source. This allows the pump operators to work on the pump and the well without having to remove the pump from a borehole such as a water, oil, gas or coal bed methane dewatering well.

In some embodiments described herein, the valves are self-actuating one-way valves. However, the valves can optionally be electronically controlled. Using standard computer process control techniques, such as those known in the art, the opening and closing of each valve can be automated. In such embodiments, two-way valves can be utilized. Two-way valves allow the pump operators to open the valves and permit flow in the reverse direction when necessary, such as to flush an inlet or channel that has become plugged or to clean the pump, without employing the valve stops 627, 629 previously discussed. Accordingly, a pump with electronically controlled valves can be flushed or cleaned without increasing the power fluid pressure as described in connection with the embodiments illustrated in FIGS. 6A-C.

Figure 7A:
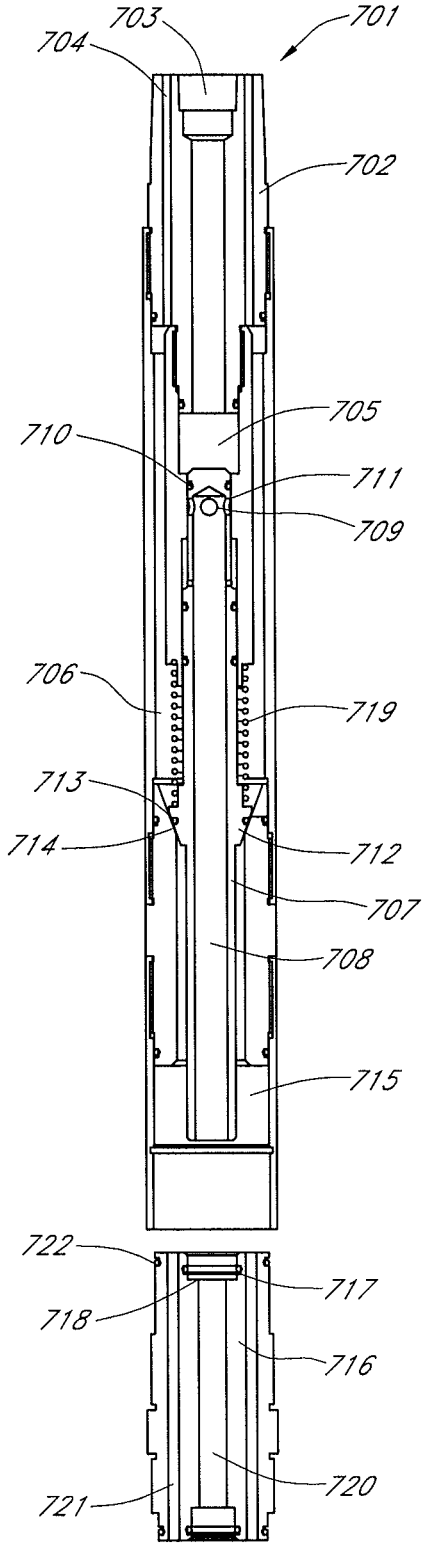
FIG. 7A provides a cross-sectional view of a pump coaxial disconnect in a closed position.
Figure 7B:
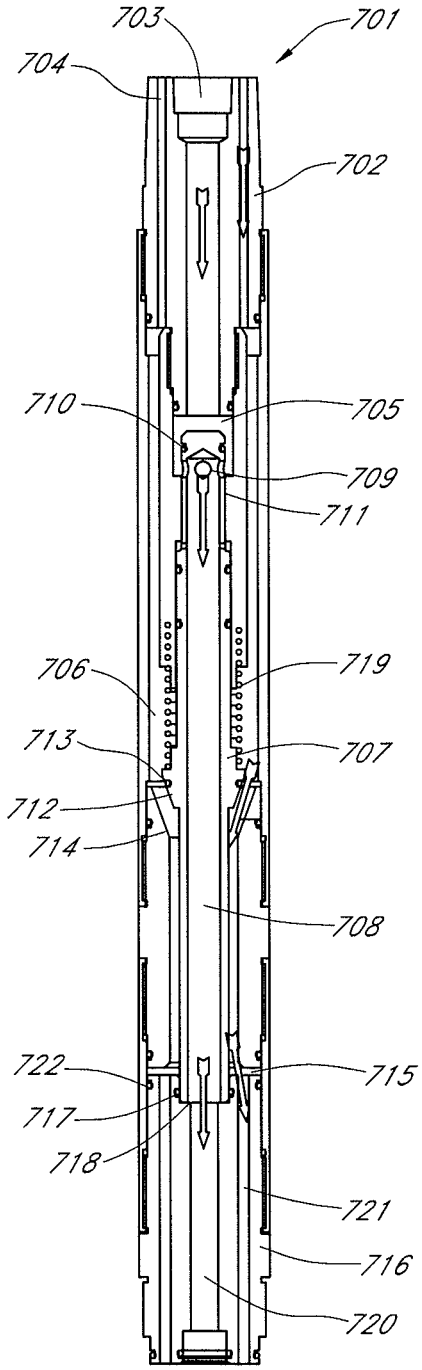
FIG. 7B provides a cross-sectional view of a pump coaxial disconnect in an open position.

FIG. 7A and FIG. 7B illustrate a coaxial disconnect (HCDC) configured to allow removal of any coaxial hydraulic equipment from a coaxial pipe or tube connection without the loss of either of the two prime fluids. In pumps and downhole well applications, the HCDC is connected between the coaxial tubing installed down the well casing and the coaxial pump which is located at the bottom of the well. To replace the pump, the coaxial tubing is rolled up onto a waiting tube reel, and the pump is disconnected from the HCDC. The HCDC allows the pump to be removed without the loss of the two fluids located within the coaxial tubing.

Referring now to FIG. 7A, the illustrated embodiment of an HCDC 701 includes a top cap 702, which provides connection interfaces to both a power fluid port 703 and a product fluid port 704 of the coaxial tube. A valve stem 707 is configured to control both the power and product fluid flows through the HCDC. A power fluid seat 711 is configured to control flow of the power fluid. A product fluid seat 714 is configured to control flow of the product fluid. A pump top cap 716 is configured to control the position of the valve stem 707.

FIG. 7A illustrates the HCDC 701 in a closed position. When connected to the coaxial tube, a power fluid chamber 705 maintains a fluid connection with the inner coaxial tube and a product fluid chamber 706 maintains a fluid connection with the outer coaxial tube. The HCDC valve stem 707 isolates the power fluid chamber 705 from a power fluid outlet 708 when a power fluid seal 710 is seated within the power fluid seat 711. This prevents the power fluid from flowing from the power fluid chamber 705 to the power fluid outlet 708 through a power fluid valve port 709.

The HCDC valve stem 707 isolates the product fluid chamber 706 from a product fluid outlet 715 when a product fluid seal 713 is seated against the product fluid seat 714. This prevents the product fluid from flowing from the product fluid chamber 706 to the power fluid outlet 715 past a product fluid valve stem 712. An HCDC return spring 719 maintains a closing force on the valve stem 707 to isolate both the power and product fluid flows.

FIG. 7B illustrates the HCDC 701 in an open position. When connected to the coaxial tube, the power fluid chamber 705 maintains a fluid connection with the inner coaxial tube and the product fluid chamber 706 maintains a fluid connection with the outer coaxial tube. When the pump top cap 716 is connected into the bottom of the HCDC 701, the valve stem 707 is pushed up into the HCDC by the pump top cap valve stem pocket 718. The valve stem 707 is sealed to the top cap by a top cap power fluid seal 717. The HCDC power fluid outlet 708 now maintains a fluid connection with the pump top cap power fluid chamber 720. The HCDC product fluid outlet 715 now maintains a fluid connection with a pump top cap product fluid chamber 721.

As the pump top cap 716 is inserted farther into the HCDC, a top cap product fluid seal 722 forms a seal with the inside of the HCDC power fluid outlet 715. As the pump top cap 716 is inserted farther into the HCDC, the valve stem 707 is pushed upwards against the return spring 719 and lifts the product fluid seal 713 away from the product fluid seat 714. This allows product fluid to flow between the product fluid chamber 706 and the product fluid outlet 715.

As the pump top cap 716 is inserted further into the HCDC, the valve stem 707 is pushed upwards against the return spring 719 and lifts the power fluid seal 710 out of the power fluid seat 711. This causes the top of the valve stem 707 to enter the power fluid chamber and allow power fluid to flow through the power fluid valve port 709 into the power fluid outlet 708. This allows power fluid to flow between the power fluid chamber 705 and the power fluid outlet 708.

Figure 8A:
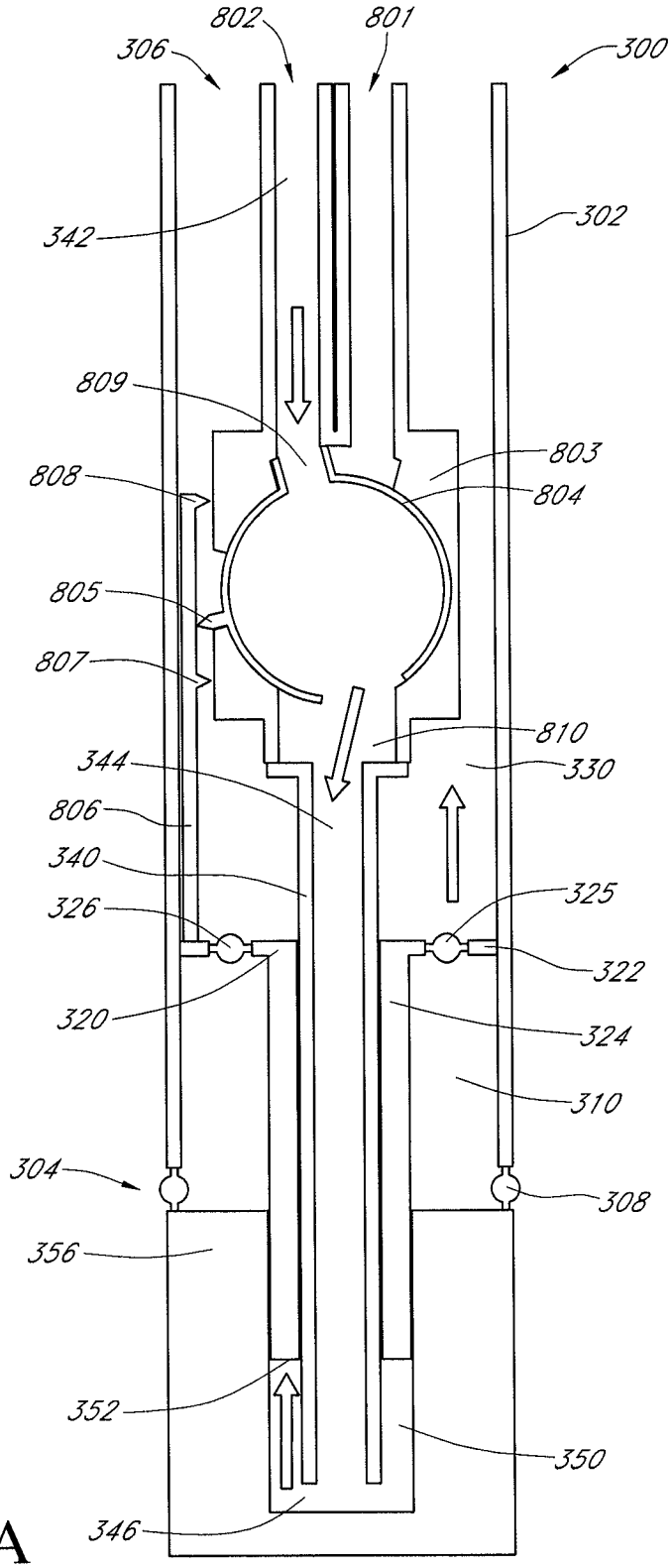
FIG. 8A provides a cross-sectional view of a subterranean switch pump during a power stroke.
Figure 8B:
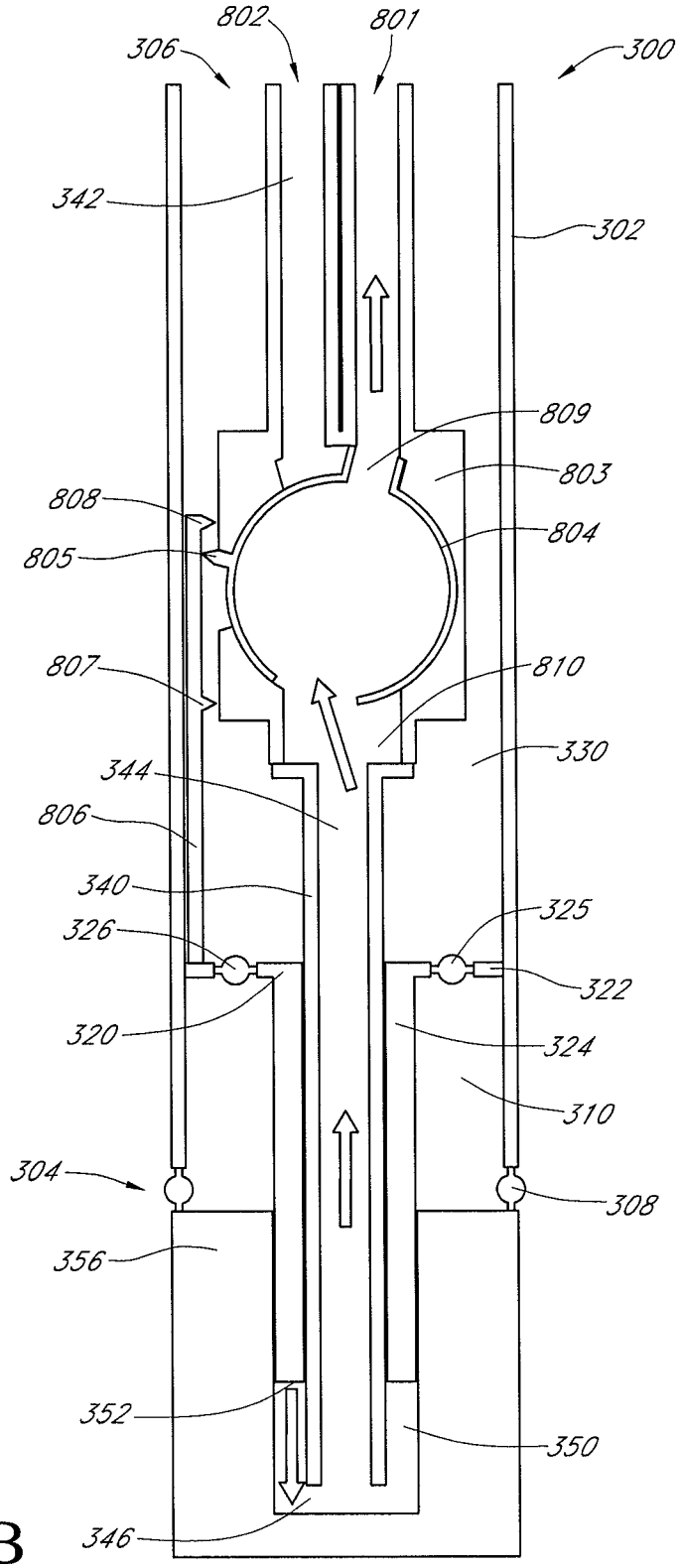
FIG. 8B provides a cross-sectional view of a subterranean switch pump during a pump recovery stroke.

FIG. 8A and FIG. 8B illustrate a subterranean switch pump. In general, a hydraulic subterranean switch (HSS) is configured to reduce the effects of hydraulic fluid compression acting on the pumps of the present disclosure (such as those described above) at well depths. In downhole well applications, the HSS is connected between coaxial tubing, which is installed down the well casing, and the coaxial pump, which is located at the bottom of the well.

In one illustrated form of the system as discussed below, the HSS is connected to a coaxial downhole tubing set which consists of an outer product water tube within which are located two hydraulic power tubes. One of these tubes is pressurized to the required hydraulic pressure necessary to drive a piston on its power stroke (as described above). The other hydraulic tube is pressurized to the required hydraulic pressure necessary to drive the piston on its recovery stroke (as described above).

FIG. 8A illustrates one embodiment of an HSS 803. The HSS 803 includes a power hydraulic line 802, which provides fluid pressure required to drive the piston on its power stroke. A recovery hydraulic line 801 provides fluid pressure required to drive the piston on its recovery stroke. A diverter valve stem 804 is configured to control a fluid connection of the pump power fluid column 344 to either the power or recovery pressure fluid flows through the HSS 803. In some embodiments a HSS valve stem cam 805 is actuated by a pump piston follower 806 to switch between either power or recovery strokes.

Near the end of the power stroke, a pump piston follower 806 is raised by a pump piston 320, which causes a recovery stroke cam lobe 807 to raise an HSS valve stem cam 805. This causes the valve stem 804 to switch the position of a valve stem inlet 809 to complete the hydraulic connection of a pump power fluid column 344 from the power hydraulic line 802 to the recovery hydraulic line 801 via the HSS valve stem outlet 810. This initiates the recovery stroke of the pump.

FIG. 8B illustrates the pump recovery stroke. Near the end of the pump recovery stroke, the pump piston follower 806 is lowered by the pump piston 320, which causes the power stroke cam lobe 808 to lower the HSS valve stem cam 805. This causes the valve stem 804 to switch the position of the valve stem inlet 809 to complete the hydraulic connection of the pump power fluid column 344 from the recovery hydraulic line 801 to the power hydraulic line 802 via the HSS valve stem outlet 810. This initiates the power stroke of the pump.

Figure 9:
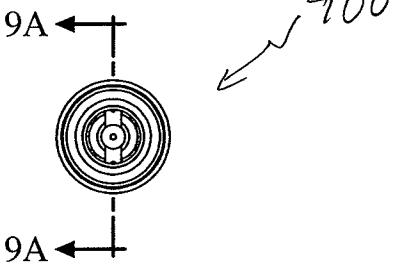
FIG. 9 provides a cross-section view of one embodiment of a downhole pump.
Figure 9A:
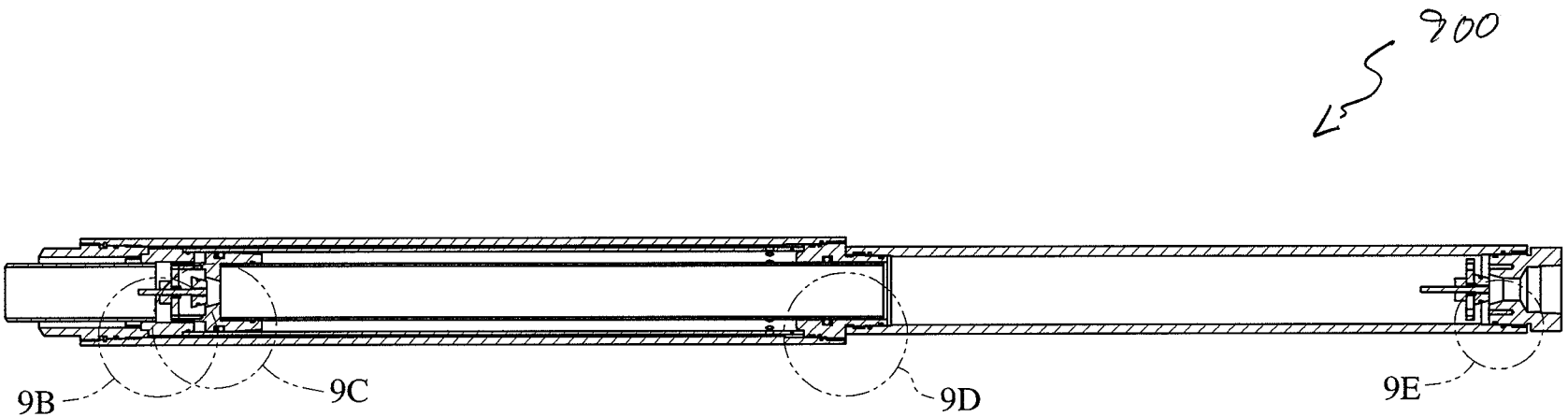
FIG. 9A provides a cross-section view of one embodiment of a 3.5" downhole pump.
Figure 9D:
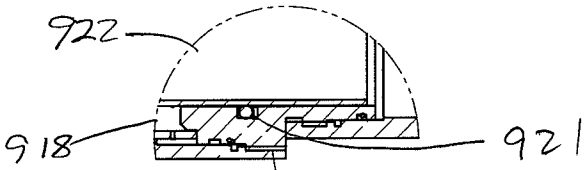
FIG. 9D provides a cross-section view of the embodiment of FIG. 9A including the seal between a power fluid chamber and a transfer chamber.
Figure 9E:
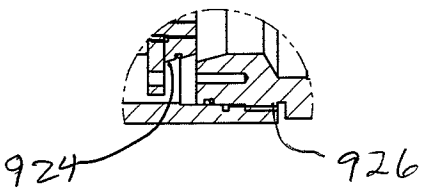
FIG. 9E provides a cross-section view of the embodiment of FIG. 9A including the intake valve located within the bottom of the pump.
Figure 9B:
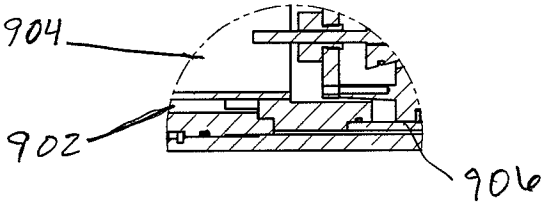
FIG. 9B provides a cross-section view of a connection location for the power fluid tube and the product fluid coaxial tube.
Figure 9C:
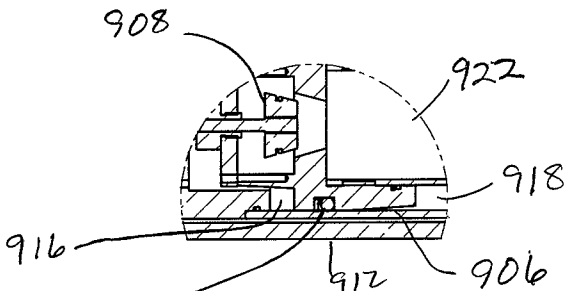
FIG. 9C provides a cross-section view of the embodiment of FIG. 9A including the main piston seal.

FIG. 9 illustrates one embodiment of a downhole pump 900. FIG. 9A shows a cross section of an embodiment of a 3.5" version of the pump 900. FIG. 9B illustrates a detail of the connection locations for both the power fluid 902 and product fluid 904 coaxial tubes. FIG. 9C illustrates a detail of the transfer piston 906 and the transfer valve 908 within the piston tube and pump casing 912. FIG. 9C also illustrates the main piston seal 914 which separates the product fluid chamber 916 and the power fluid chamber 918. FIG. 9D illustrates the main block 920, which locates the main seal 921 between the power fluid chamber 918 and the transfer chamber 922. FIG. 9E illustrates the arrangement of the intake valve 924 located within the bottom cap 926 of the pump assembly.

Figure 10:
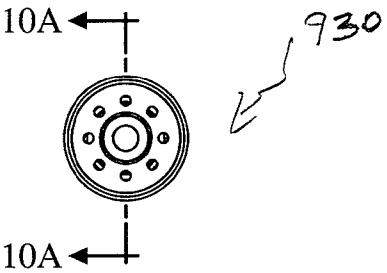
FIG. 10 provides another embodiment of a downhole pump.
Figure 10A:
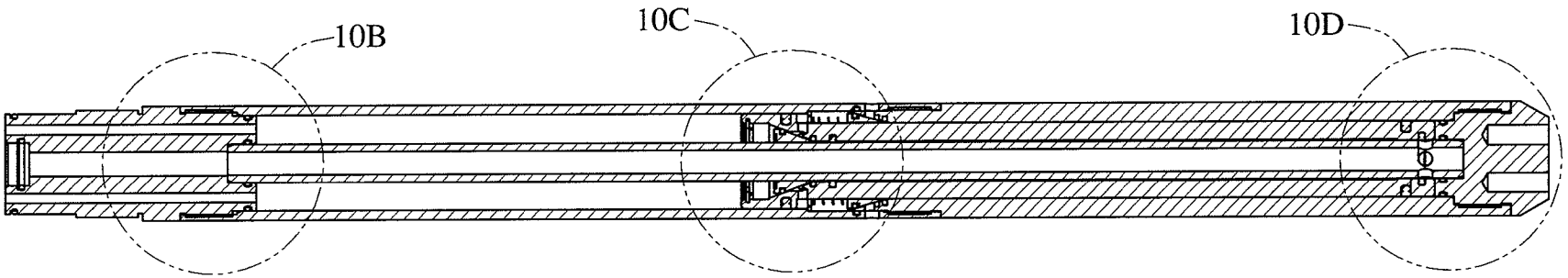
FIG. 10A provides a cross-sectional view of a 1.5" stacked downhole pump.
Figure 10D:
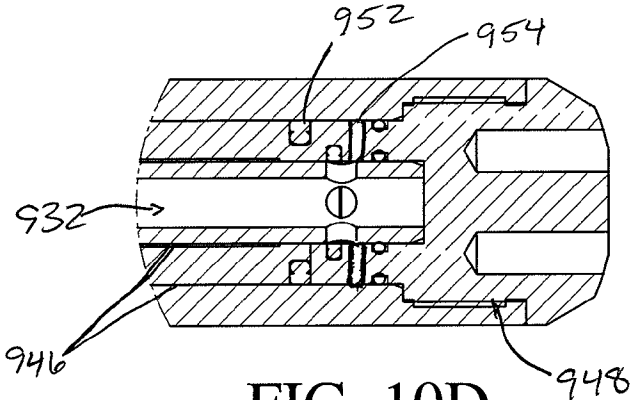
FIG. 10D provides a cross-sectional view of the embodiment of FIG. 10A including a bottom piston seal.
Figure 10B:
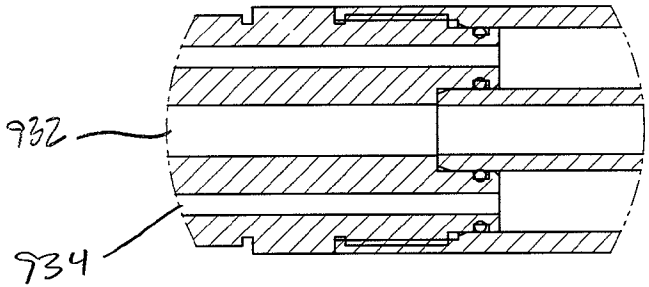
FIG. 10B provides a cross-sectional view of the embodiment of FIG. 10A including the power fluid and product fluid coaxial tubes.
Figure 10C:
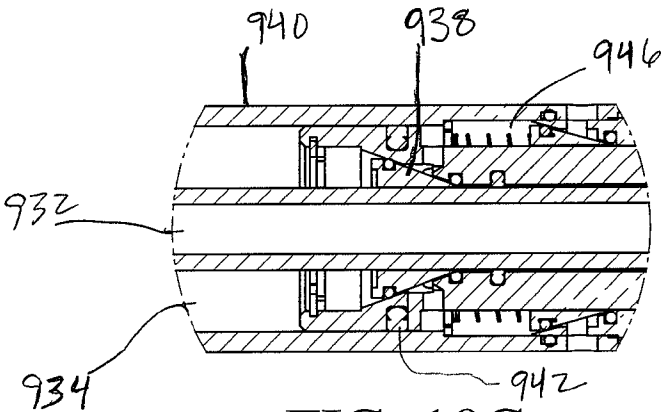
FIG. 10C provides a cross-sectional view of the embodiment of FIG. 10A including a main piston seal.

FIG. 10 illustrates another embodiment of a downhole pump 930. The downhole pump 930 has a configuration different than that of the embodiment of FIG. 9. In particular, the location of the power fluid and the product fluid (and related chambers for such power fluid and product fluid) are switched from outside to inside and from inside to outside for the coaxial pumps illustrated in FIG. 9 and FIG. 10. FIG. 10A shows a cross section of an embodiment of a 1.5" stacked version of the pump 930 similar to the embodiment illustrated in FIG. 3. FIG. 10B illustrates a detail of the connection and static seal locations for both the power fluid (internal) 932 and product fluid (external) 934 coaxial tubes. FIG. 10C illustrates a detail of the upper portion of the transfer piston 936 and the transfer valve 938 within the pump casing 940. FIG. 10C also illustrates the main piston seal 942, which separates the product fluid chamber 944 and the transfer fluid chamber 946. FIG. 10D illustrates the bottom cap 948, which locates the power fluid tube 932 within the pump. FIG. 10D also illustrates the bottom piston seal 952, which separates the power fluid chamber 954 from the transfer fluid chamber 946.

Figure 11:
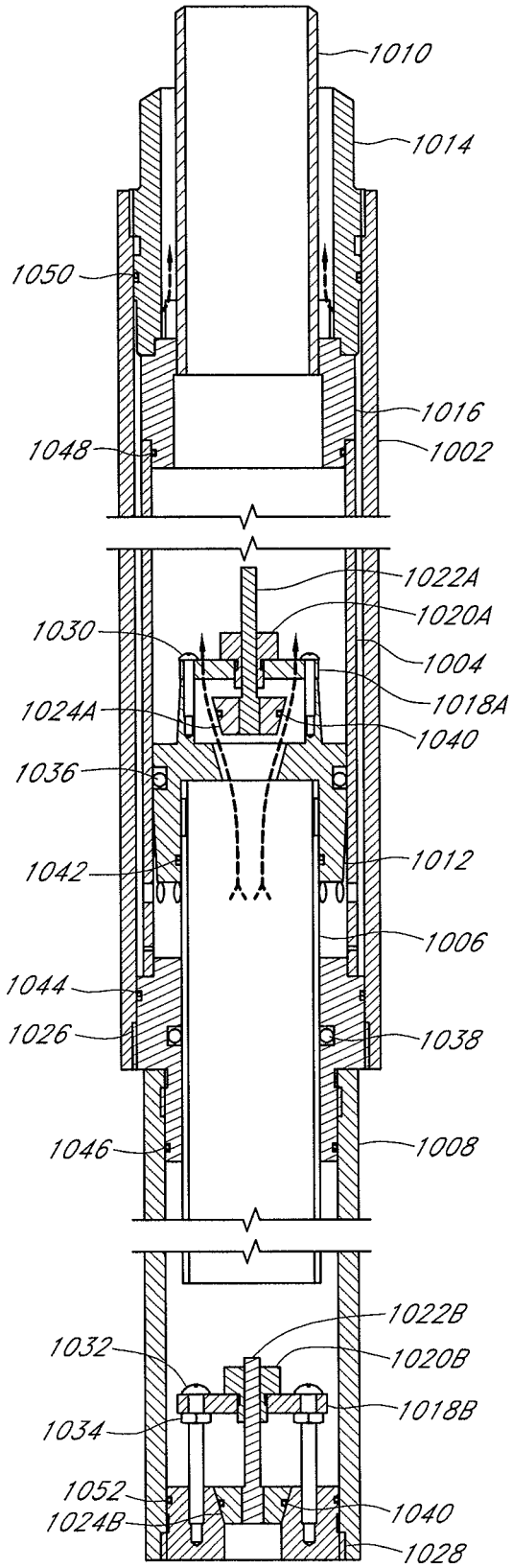
FIG. 11 provides another embodiment of a downhole pump.

FIG. 11 illustrates an embodiment of a downhole pump. The illustrated pump comprises an outer cylinder 1002 and a main cylinder 1004, which surrounds a piston rod 1006. A lower cylinder 1008 is present below the main cylinder 1004. A discharge stub 1010 is present extending from the outer cylinder 1002. A piston 1012 is present within the main cylinder 1004. An outer top cap 1014 is attached to the outer cylinder 1002 and surrounding the discharge stub 1010. An inner top cap 1016 is located below the outer top cap 1014 and entirely within the outer cylinder 1002.

A piston check valve guide bar 1018A and a lower check valve guide bar 1018B are attached to check valve guides 1020A and 1020B and check valve pins 1022A and 1022B respectively. The check valve pins 1022A and 1022B attach to check valves 1024A and 1024B respectively. When in an open position, check valve 1024A allows liquid to flow around it. When in a closed position, check valve 1024B prevents liquid flow.

In some embodiments the downhole pump includes a main block 1026 surrounding the lower portion of the piston rod 1006. The downhole pump also includes a lower plate 1028, which contacts the check valve 1024B when it is in a closed position and no fluid is allowed to pass therethrough. The downhole pump includes a piston check valve screw 1030 a lower plate check valve screw 1032, a lower plate check valve nut 1034 as illustrated in FIG. 11. In addition, the downhole pump can comprise a piston reciprocating o-ring 1036 as part of the piston 1012, a main seal ring 1038 as part of the main block 1026, a check valve o-ring 1040 as part of the check valves 1024A and 1024B, a piston rod o-ring 1042 as part of the piston rod 1006, a main block upper o-ring 1044 as part of the main block 1026, a main block lower o-ring 1046 as part of a lower portion of the main block 1026, an inner top seal o-ring 1048 as part of the inner top cap 1016, an outer top seal o-ring 1050 as part of the outer top cap 1014 and a bottom seal o-ring 1052 as part of the lower plate 1028.

Figure 12:
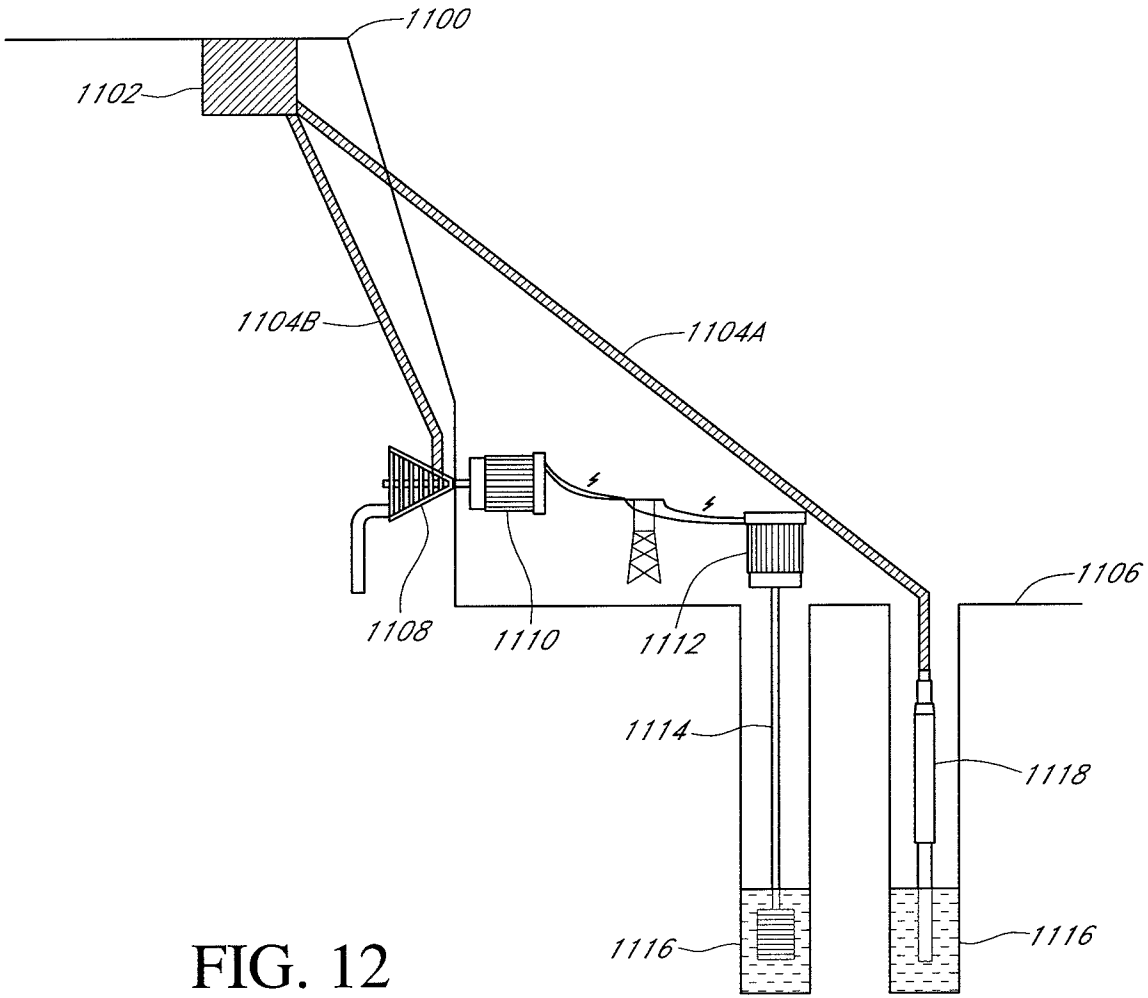
FIG. 12 provides a figure illustrating an efficiency comparison between a conventional electric pump and a pump of a preferred embodiment.

FIG. 12 illustrates energy conversion for a conventional pump system and a pump system of the present disclosure. Both systems utilize the potential energy of a fluid 1102 at an elevation 1100 greater than ground level 1106. The fluid 1102 flows through pipes 1104A and 1104B. In the illustrated electrically-driven pump system, the fluid in pipe 1104B flows through a typical conventional system comprising a water turbine 1108 which drives an electrical generator 1110. The generated electricity is routed through a typical electrical transmission system to an electrically-driven fluid pump 1112 to extract fluid 1116 from a deep well through a pipe 1114. Due to energy conversion and transmission losses throughout this system, the conventional pump system with a high head thus achieves an efficiency of not greater than about 60%. In the illustrated direct fluid-driven pump system, the fluid 1102 flows from a pipe 1104A to the pump of the present disclosure 1118 used to extract water 1116 from a deep well. This process uses a high-head water source and a pump of the present disclosure to achieve a measured efficiency of up to about 96%. The high-head direct fluid-driven pump system increases efficiency by reducing the conversion and transmission losses inherent in the electrically-driven pump system.

Figure 13:
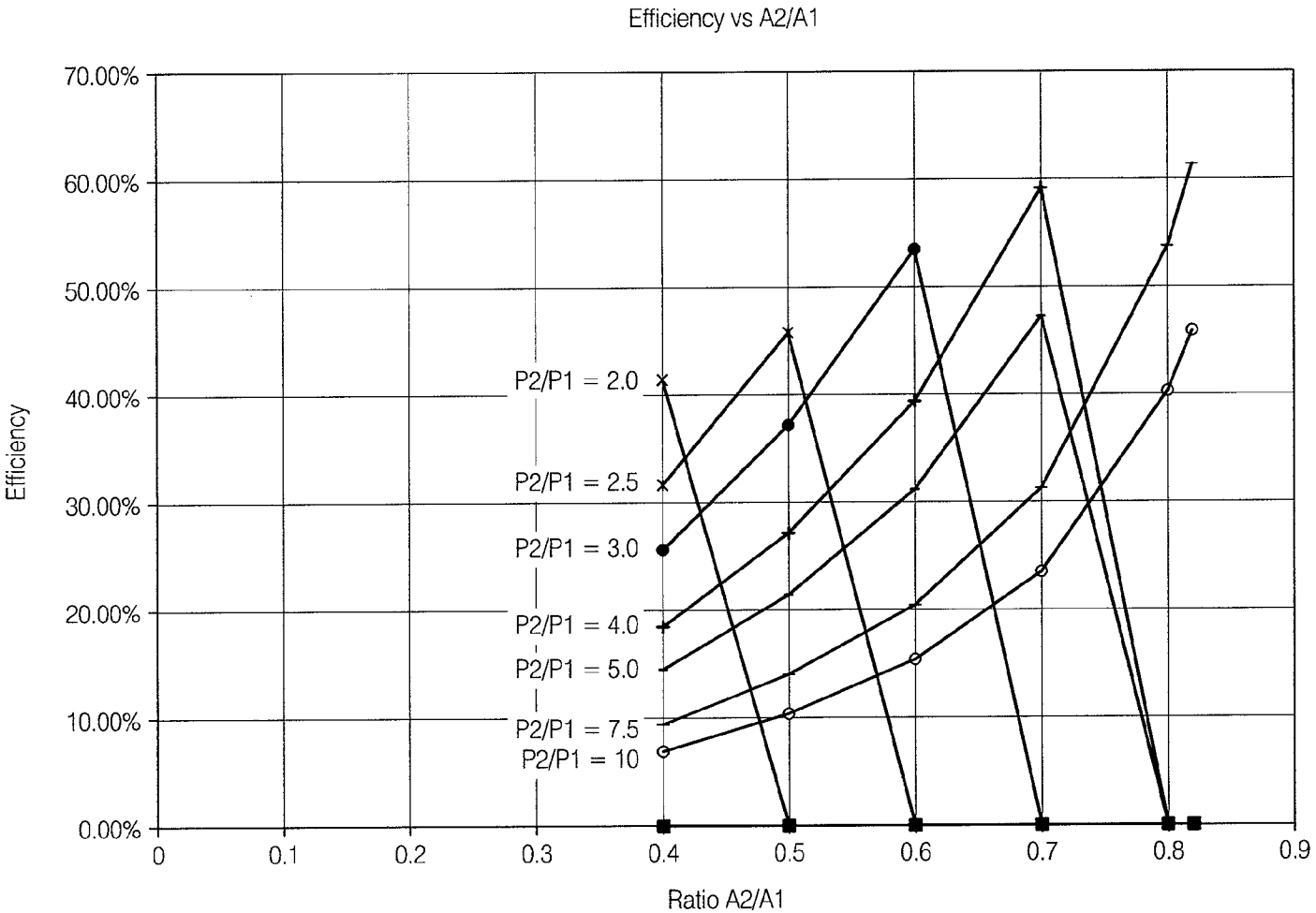
FIG. 13 provides a graph illustrating efficiency of various pumps based upon a ratio of two areas on a piston.

FIG. 13 is a graph illustrating dynamic performance of a piston pump, such as the piston pump described in U.S. Pat. No. 6,193,476 to Sweeney, which is hereby incorporated by reference in its entirety. The analysis has various applications including the need to accelerate the power column fluid as well as the standing column fluid.

The piston pump includes a transfer piston sliding in the bore of a pipe. The transfer piston, and a standing column of water, are raised by pressurizing an annular space ($A_1$–$A_2$) using either a source of water at a higher elevation (pressurehead concept) or a power piston in a power cylinder (power cylinder concept). Some embodiments are hybrid types of pumps.

In order to reset the transfer piston at the end of the power stroke the pressure in the annular space must reduced by:

releasing the water in the pressurehead concept or reversing the power cylinder.

During the power stroke, it is obvious that the pressure created by the power column ($P_2$) must be greater than the pressure at the bottom of the standing column ($P_1$); the area that the standing column acts on ($A_1$) is larger than the area that the power column acts on ($A_1-A_2$). This means that for the pressurehead concept the height of the power column ($H_2$) must be greater than the height of the standing column ($H_1$). For both the pressurehead concept and the power cylinder concept, as the power column pressure decreases, the annular space must increase relative to $A_1$. As the annular space increases the transfer area ($A_2$) decreases, decreasing the amount of water lifted per stroke.

During the recovery stroke the pressure in the annular space ($P_5$) must be less than $P_1$: in a pressurehead concept pump the point of release for the power water ($H_5$) must be below the top of the standing column; in the power cylinder concept pump the negative pressure created in the power cylinder is limited to −14.7 psig, this becomes very significant if the power cylinder is located at or above the top of the standing column. The standing column follows the transfer piston down the standing column pipe during the recovery stroke and must be lifted again before any water can be discharged. The distance that the standing column retreats is less than the stroke of the transfer piston because some water comes up through the transfer piston during the recovery stroke. If the transfer area ($A_2$) is large compared to $A_1$, the standing column retreats only a short distance.

For purposes of the following discussion, term definitions are provided: RotR is Run-of-the-River Hydro, a pump used to boost water into a reservoir to support a small hydro power development; $H_1$ is height of the standing column; $P_1$ is pressure at the bottom of the standing column; $H_2$ is height of the primary power column; $P_2$ is pressure created by the primary power column; $P_3$ is pressure in the intake chamber; $P_4$ is pressure during power stroke; $P_1$ is pressure during the recovery stroke; $P_4$ is pressure in the pool of working fluid; $H_5$ is height of the power column discharge; $P_5$ is pressure created by the power column while discharging; $P_c$ is pressure in the power cylinder; $A_1$ is area of the transfer piston; $A_2$ is area of the transfer space of the transfer piston; $A_2-A_1$ is area of the annular space that the power fluid pressure acts on; $A_2/A_1$ is ratio of the transfer space area to the total transfer piston area ($A_2/A_1=r<1$); r is $A_2/A_1<1$; a is acceleration as a multiple of 'g'; g is acceleration of gravity=32.2 ft/sec$^2$; d is density of the working fluid: 0.036 lbs/in$^3$ for water; $F_d$ is force down or resisting upward motion; $F_u$ is force up or resisting downward motion; $F_n$ is net force in the direction of intended travel; R is total seal resistance to motion; W is weight of the Transfer Piston; M is mass; S is stroke length; Eff is efficiency (work out/work in expressed as a percentage); $W_o$ is work output; and $W_i$ is work input.

Power water from a source at an elevation $H_2$ well above the top of the standing column $H_1$ is used to pressurize the annular space and raise the transfer piston and the standing column of water. The power water must be released at an elevation $H_5$ below $H_1$.

The force attempting to move the transfer piston up is:

$$F_u=P_2(A_1-A_2)+P_3(A_2)$$

For most applications $P_3=P_4$ and can be taken to 0 (W is much less than the other forces and is ignored for this analysis).

The force resisting the attempted upward motion is:

$$F_d=P_1A_1+R+W$$

The net force acting on the transfer piston is:

$$F_n=P_2(A_1-A_2)-(P_1A_1+R)$$

The mass to be accelerated is:

$$M=H_1A_1d+H_2(A_1-A_2)d+W$$

wherein the mass of the standing column is $H_1A_1d$; the mass of the power column is $H_2(A_1-A_2)d$; and the mass of the piston is W (the piston mass is usually small enough relative to the water columns to be ignored). Because P is HAd/A, therefore PA is HAd and P is Hd.

The masses of the water columns can be rewritten:

$$M=P_1A_1+P_2(A_1-A_2)$$

The net force is equal to the mass times the acceleration expressed as a fraction of g.

$$F_n=Ma$$

$$P_2(A_1-A_2)-(P_1A_1+R)=a\{P_1A_1+P_2(A_1-A_2)\}$$

$$P_2A_1-P_2A_2-P_1A_1-R=aP_1A_1+aP_2A_1-aP_2A_2$$

Separate $P_2$ $$P_2A_1-P_2A_2-aP_2A_1+aP_2A_2=aP_1A_1+P_1A_1+R$$

$$P_2(A_1-A_2-aA_1+aA_2)=P_1A_1(a+1)+R$$

$$r=A_2/A_1,\text{ then } A_2=rA_1,$$

$$P_2(A_1-rA_1-aA_1+arA_1)=P_1A_1(a+1)+R$$

$$P_2=\frac{P_1A_1(a+1)}{(A_1-rA_1-aA_1+arA_1)}+\frac{R}{(A_1-rA_1-aA_1+arA_1)},$$

$$P_2=\frac{P_1A_1(a+1)}{A_1(1-r-a+ar)}+\frac{R}{A_1(1-r-a+ar)},$$

$$P_2=\frac{P_1(1+a)}{\{1-r+a(r-1)\}}+\frac{R}{A_1\{1-r+a(r-1)\}},$$

However: $\{1-r+a(r-1)\}=\{(1-r)-a(1-r)\}=(1-a)(1-r)$ $$P_2=\frac{P_1(1+a)}{(1-a)(1-r)}+\frac{R}{A_1(1-a)(1-r)},$$

Neglecting $R$.

$$\frac{P_2}{P_1}=\frac{(1+a)}{(1-a)(1-r)}$$

or $$P_2=\frac{P_1(1+a)}{(1-a)(1-r)}$$

Setting $A_2/A_1=r=0.8$: $1-r=0.2$ $$\frac{P_2}{P_1}=\frac{(1+a)}{(1-a)0.2},$$

for $H_1$=100', the following relationships hold:

| a | $P_2/P_1$ | $H_2$ |
|---|---|---|
| 0.1 | 6.11 | 611' |
| 0.25 | 8.33 | 833' |
| 0.5 | 15 | 1500' |
| 1.0 | infinite | |

Making the transfer area ($A_2$) smaller makes the annular area ($A_1-A_2$) bigger:

Setting $A_2/A_1=r=0.5$: $1-r=0.5$ $$\frac{P_2}{P_1}=\frac{(1+a)}{(1-a)0.5}$$

for $H_1=100'$, the following relationships hold:

| a | $P_2/P_1$ | $H_2$ |
|---|---|---|
| 0.1 | 2.44 | 244' |
| 0.25 | 3.33 | 333' |
| 0.5 | 6.00 | 600' |
| 1.0 | infinite | |

The force trying to push the transfer piston down as part of a recovery stroke is:

$$F_d=P_1A_1+W$$

wherein W<< less than other forces and is ignored.

The force resisting the attempted downward motion is:

$$F_u=P_5(A_1-A_2)+P_3A_2+R$$

In this case $P_3=P_1$ and the valve in the transfer piston is open.

$$F_n=F_d-F_u=P_1A_1-(P_5(A_1-A_2)+P_1A_2+R)$$

The mass to be accelerated is:

$$M=H_1A_1d+H_5(A_1-A_2)d=P_1A_1+P_5(A_1-A_2)$$

$$F_n=Ma$$

$$P_1A_1-P_5(A_1-A_2)-P_1A_2-R=a\{P_1A_1+P_5(A_1-A_2)\}$$

$$P_1A_1-P_1A_2-P_5A_1+P_5A_2-R=aP_1A_1+aP_5A_1-aP_5A_2$$

Separate $P_5$:

$$P_5A_2-P_5A_1+aP_5A_2-aP_5A_1=aP_1A_1-P_1A_1+P_1A_2+R$$

$$A_2/A_1=r\text{: therefore } A_2=rA_1,$$

$$P_5(rA_1-A_1+arA_1-aA_1)=P_1(aA_1-A_1+rA_1)+R$$

$$P_5=\frac{P_1A_1(a-1+r)}{A_1(r-1+ar-a)}+\frac{R}{A_1(r-1+ar-a)},$$

$$P_5=\frac{P_1(a-1+r)}{(r-1+ar-a)}+\frac{R}{A_1(r-1+ar-a)},$$

However $(r-1+ar-a)=r-1+a(r-1)=(1+a)(r-1)$ and $a-1+r=a-(1-r)$ $$P_5=\frac{P_1(a-(1-r))}{(1+a)(r-1)}+\frac{R}{A_1(1+a)(r-1)},$$

Neglecting $R$.

$$P_5=\frac{P_1(a-(1-r))}{(1+a)(r-1)}$$

Setting $A_2/A_1=r=0.8$: $(1-r)=0.2$: $(r-1)=-0.2$ $$\frac{P_5}{P_1}=\frac{(a-0.2)}{-0.2(1+a)}$$

For $H_1=100'$, the following relationships hold:

| a | $P_5/P_1$ | $H_5$ |
|---|---|---|
| 0.1 | 0.455 | 45.5' |
| 0.15 | 0.217 | 21.7' |
| 0.2 | 0 | 0' |
| 0.25 | −0.2 | −20'* |

*i.e. the discharge must be below the level of the pump and create a suction

Decreasing the Transfer Area relative to the Standing Column Area:

Setting $A_2/A_1=r=0.5$: $(1-r)=0.5$: $(r-1)=-0.5$ $$\frac{P_2}{P_1}=\frac{(a-0.5)}{-0.5(1+a)}$$

For $H_1=100'$, the following relationships hold:

| a | $P_5/P_1$ | $H_5$ |
|---|---|---|
| 0.1 | 0.73 | 73' |
| 0.15 | 0.61 | 61' |
| 0.2 | 0.40 | 40' |
| 0.5 | 0.00 | 0' |

Work out=weight moved per stroke×$H_1$ $W_o=A_2SdH_1$

Work in=the weight of water used per stroke×total height lost $W_i=(A_1-A_2)Sd(H_2-H_5)$ $$Eff=100W_o/W_i=\frac{A_2SdH_1}{(A_1-A_2)Sd(H_2-H_5)},$$

$$A_2/A_1=r\text{: } A_2=rA_1,$$

$$Eff=\frac{100rA_1H_1}{A_1(1-r)(H_2-H_5)},$$

$$Eff=\frac{100rH_1}{(1-r)(H_2-H_5)},$$

As an example $$A_2/A_1=r=0.8\text{: } 1-r=0.2\text{: and } a=0.1\text{ g: } H_1=100\text{ ft},$$

$$H_2=611'\text{: } H_5=45.5'$$

$$Eff=\frac{100(0.8)100}{0.2(611-45.5)}=70.7\%$$

In order to de-water a mine the equations discussed above can be used, but the power water can be released at $H_5=0$. However, the pressure required to operate the power stroke is not reduced and the water is released at the bottom of the standing column reducing the efficiency (to 65.5% in one situation above). The released power water then has to be re-lifted resulting in a further efficiency loss (to 52.4% in one situation investigated above).

The placement of the pump does not change the basic formulas but does affect how the formulas may be simplified.

The force attempting to move the transfer piston up is $F_u$:

$$F_u=P_2(A_1-A_2)+P_3(A_2)$$

$P_3=P_4$ is nearly 0 in most cases and is ignored.

The force resisting the attempted upward motion is $F_d$ (W is much less than the other forces and is ignored for this analysis):

$$F_d=P_1A_1+R+W$$

$$F_n=F_u-F_d=P_2(A_1-A_2)-(P_1A_1+R)$$

Where the mass of the Standing Column $H_1A_1d$, the mass of the power column $H_2(A_1-A_2)d$; and the mass of the piston W, the mass to be accelerated is (the piston mass is usually small enough relative to the water columns to be ignored):

$$H_2=H_1: HAd=Pd$$

$$Mass=H_1A_1d+H_1(A_1-A_2)d+W=2H_1A_1d-H_1A_2d=2P_1A_1-P_1A_2$$

$$F_n=Ma$$

$$P_2(A_1-A_2)-(P_1A_1+R)=(2P_1A_1-P_1A_2)a$$

$$P_2=P_1+P_c\text{: and } A_2=rA_1\text{:}$$

$$(P_1+P_c)(A_1-rA_1)-P_1A_1-R=(2P_1A_1-P_1rA_1)a$$

$$P_1A_1+P_cA_1-P_1rA_1-P_crA_1-P_1A_1-R=aP_1A_1(2-r)$$

Separate $P_c$, $$P_cA_1-P_crA_1=aP_1A_1(2-r)+P_1rA_1+R$$

$$P_cA_1(1-r)=P_1A_1(a(2-r)+r)+R$$

$$P_c=\frac{P_1A_1(a(2-r)+r)}{A_1(1-r)}+\frac{R}{A_1(1-r)},$$

$$P_c=\frac{P_1(a(2-r)+r)}{(1-r)}+\frac{R}{A_1(1-r)},$$

Neglecting $R$.

$$P_c=\frac{P_1(a(2-r)+r)}{(1-r)};$$

Set $r=0.8$: $(1-r)=0.2$: $(2-r)=1.2$ $$P_c=\frac{P_1(1.2a+0.8)}{0.2}$$

Where $H_1$=100 ft and $P_1$=43.3 psig, the following relationships apply:

| a | $P_c/P_1$ | $P_c$ | $P_2$ |
|---|---|---|---|
| 0.0 | 4.0 | | |
| 0.1 | 4.6 | 199' | 242' |
| 0.25 | 5.5 | | |
| 0.5 | 7.0 | | |
| 1.0 | 10.0 | | |

Decrease the transfer area so that:

$$A_2/A_1=r=0.5;$$

$$1-r=0.5:\ 2-r=1.5$$

$$P_c=\frac{P_1(1.5a+0.5)}{0.5}$$

Where $H_1$=100 ft and $P_1$=43.3 psig, the following relationships apply:

| a | $P_c/P_1$ | $P_c$ | $P_2$ |
|---|---|---|---|
| 0.0 | 1.0 | | |
| 0.1 | 1.3 | 56.3' | 100' |
| 0.25 | 1.75 | | |
| 0.5 | 2.5 | | |

The force attempting to push the transfer piston down is (W is much less than other forces and is ignored):

$$F_d=P_1A_1+W$$

The force resisting the attempted downward motion is:

$$F_u=P_5(A_1-A_2)+P_3A_2+R$$

In this case $P_3=P_1$: the transfer valve is open, $$F_n=F_d-F_u=P_1A_1-(P_5(A_1-A_2)+P_1A_2+R)$$

The mass to be accelerated is:

$$M=H_1A_1d+H_2(A_1-A_2)d;H_2=H_1:H_1d=P_1:M=P_1A_1+P_1(A_1-A_2)$$

$$F_n=Ma$$

$$P_1A_1-P_5(A_1-A_2)-P_1A_2-R=a(P_1A_1+P_1(A_1-A_2))$$

$$A_2=rA_1: P_5=P_1+P_c(P_c\text{ is negative})$$

$$P_1A_1-(P_1+P_c)(A_1-rA_1)-P_1rA_1-R=aP_1A_1+aP_1A_1-aP_1rA_1$$

$$P_1A_1-(P_1A_1+P_cA_1-P_1rA_1-P_crA_1)-rP_1A_1=aP_1A_1(2-r)+R$$

$$P_1A_1-P_1A_1-P_cA_1+rP_1A_1+P_crA_1-rP_1A_1=aP_1A_1(2-r)+R$$

$$P_crA_1-P_cA_1=aP_1A_1(2-r)+R$$

$$P_cA_1(r-1)=aP_1A_1(2-r)+R$$

$$P_c=\frac{aP_1A_1(2-r)}{A_1(r-1)}+\frac{R}{A_1(r-1)},$$

$$P_c=\frac{aP_1(2-r)}{(r-1)}+\frac{R}{A_1(r-1)},$$

Neglecting R.

$$P_c=\frac{aP_1(2-r)}{(r-1)}$$

Setting $A_2/A_1=r=0.8$;

$(2-r)=1.2$;

-continued $$(r-1)=-0.2;$$

$$(2-r)/(r-1)=-6$$

$$P_c=-6aP_1$$

If $H_1$=100 ft and $P_1$=43.3 psig, the following relationships apply:

| a | $P_c=-6aP_1$ |
|---|---|
| 0.1 | −26 psig (not possible) |
| 0.05 | −13 psig (limiting case) |

To have $P_c$=−14.7, for a=0.1, $P_1$=(−14.7)/(−0.6)=24.5 psig: $H_1$=56.6 ft.

Making the transfer area smaller:

Setting $A_2/A_1$=r=0.5; (2−r)=1.5; (r−1)=−0.5; (2−r)/(r−1)=−3

$P_c$=−3a$P_1$:

For $P_1$=43.3 psig (100 ft of water), a is 0.1 and $P_c$ is −13 psig.

Work out=weight moved per stroke×$H_1$ $W_o=A_2SdH_1$

Work in =$W_i=P_c(A_1-A_2)S$ $$P_c=P_c(\text{power})-P_c(\text{recovery})$$

The volume moved by the power cylinder must equal the volume received by the power side of the transfer cylinder; $(A_1-A_2)S$.

$$Eff=100W_o/W_i=\frac{100A_2SdH_1}{P_c(A_1-A_2)S}$$

$$A_2/A_1=r:\ A_2=rA_1:\ \text{and}$$

$$HAd=PA:\ Hd=P$$

$$Eff=\frac{100rA_1P_1}{P_cA_1(1-r)}$$

$$Eff=\frac{100rP_1}{P_c(1-r)}$$

$$A_2/A_1=r=0.8:\ (1-r)=0.2:\ \text{and}$$

$$H_1=100\text{ ft}':\ P_1=43.3\text{ psig}$$

Power stroke acceleration of 0.1 g and accepting a recovery acceleration of 0.05 g, Power Stroke $P_c$=199

Recovery Stroke $P_c$=−13

$P_c$=212 psig $$Eff=\frac{100(0.8)43.3}{212(0.2)}=81.7\%$$

In a pump placed at the bottom of a standing column $H_2$=0 (RotR Hydro Style 1), (for mine dewatering and booster applications), the force attempting to move the transfer piston up is $F_u$:

$$F_u=P_2(A_1-A_2)+P_4(A_2)$$

$P_4=P_3$ is nearly 0 in most cases and is ignored.

The force resisting the attempted upward motion is $F_d$ (wherein W is much smaller than the other forces and is ignored for this analysis):

$$F_d=P_1A_1+R+W$$

$$F_n=F_u-F_d=P_2(A_1-A_2)-(P_1A_1+R)$$

Where the mass of the Standing Column is $H_1A_1d$; the mass of the power column is $H_2(A_1-A_2)d=0$; and the mass of the piston W (the piston mass is usually small enough relative to the water columns to be ignored), the mass to be accelerated is:

$$:HAd=PA$$

$$\text{Mass}=H_1A_1d+W=P_1A_1$$

$$F_n=Ma$$

$$P_2(A_1-A_2)-(P_1A_1+R)=P_1A_1a$$

$$P_2=P_c:\ A_2=rA_1$$

$$P_c(A_1-rA_1)-P_1A_1+R=P_1A_1a$$

$$P_cA_1(1-r)=P_1A_1a+P_1A_1+R$$

$$P_c=\frac{P_1A_1(a+1)}{A_1(1-r)}+\frac{R}{A_1(1-r)},$$

$$P_c=\frac{P_1(a+1)}{(1-r)}+\frac{R}{A_1(1-r)},$$

Neglecting $R$.

$$P_c=\frac{P_1(a+1)}{(1-r)}$$

$$\text{Set } r=0.8:\ (1-r)=0.2$$

For $H_1$=100' ($P_1$=43.3 psig), the following relationships apply:

| a | $P_c/P_1$ | $P_c$ |
|---|---|---|
| 0.1 | 5.5 | 238 psig |
| 0.25 | 6.25 | 271 psig |

$$F_d=P_1A_1+W$$

(wherein W is much less than other forces and is ignored)

The force resisting the attempted downward motion is $F_u$:

$$F_u=P_5(A_1-A_2)+P_3A_2+R$$

In this case $P_3=P_1$: the Transfer Valve is open.

$$F_n=F_d-F_u=P_1A_1-(P_5(A_1-A_2)+P_1A_2+R)$$

The mass to be accelerated is:

$$M=H_1A_1d+H_5(A_1-A_2)d;$$

$$H_5=0:\ H_1d=P_1:$$

$$M=P_1A_1$$

$$F_n=Ma$$

$$P_1A_1-P_5(A_1-A_2)-P_1A_2-R=aP_1A_1$$

$$A_2=rA_1:\ P_5=P_c(P_c\text{ is negative})$$

$$P_1A_1-P_c(A_1-rA_1)-P_1rA_1=aP_1A_1+R-$$

-continued $$P_cA_1(1-r)=aP_1A_1-P_1A_1+P_1rA_1+R$$

$$P_cA_1(r-1)=aP_1A_1-P_1A_1+P_1rA_1+R$$

$$P_c=\frac{P_1A_1(a-1+r)}{A_1(r-1)}+\frac{R}{A_1(r-1)},$$

$$P_c=\frac{P_1(a-1+r)}{(r-1)}+\frac{R}{A_1(r-1)},$$

Neglecting $R$.

$$P_c=\frac{P_1(a-1+r)}{(r-1)}=\frac{P_1(a+(r-1))}{(r-1)}$$

$$Set\ A_2/A_1=r=0.8:\ r-1=-0.2$$

$$P_c=\frac{P_1(a-0.2)}{-0.2}$$

For $H_1$=100' (P1=43.3 psig), the following relationships apply:

| a | $P_c/P_1$ | $P_c$ |
|---|---|---|
| 0.1 | 0.5 | 21.65 psig |
| 0.2 | 0 | 0 psig |
| 0.25 | −0.25 | −10.8 psig |

If the Recovery Stroke work can be recovered $$W_o=A_2SdH_1$$

Work in=$W_i=P_c(A_1-A_2)S$ $P_c=P_c$(power)−$P_c$(recovery)

The volume moved by the power cylinder must equal the volume received by the annular space of the transfer cylinder; $(A_1-A_2)S$.

$$Eff=100W_o/W_i=\frac{100A_2SdH_1}{P_c(A_1A_2)S}$$

$$A_2/A_1=r:\ A_2=rA_1:\ \text{and}$$

$$HAd=PA:\ Hd=P$$

$$Eff=\frac{100rA_1P_1}{P_cA_1(1-r)}$$

$$Eff=\frac{100rP_1}{P_c(1-r)}$$

$$A_2A_1=r=0.8:\ 1-r=0.2:\ \text{and}$$

$$H_1=100\ \text{ft}':\ P_1=43.3psig$$

Power and Recovery Stroke acceleration of 0.1 g

Power Stroke $P_c$=238

Recovery Stroke $P_c$=22

$P_c$=216 psig $$Eff=\frac{100(0.8)43.3}{216(0.2)}=81.7\%$$

If the recovery stroke work can not be salvaged:

$$Eff=\frac{100rP_1}{P_c(1-r)}$$

Power Stroke $P_c$=238

Recovery Stroke $P_c$=0

$P_c$=238 psig $$Eff=\frac{100(0.8)43.3}{238(0.2)}=72.7\%$$

Although the above analysis works in the general case, several principles put forth above can have a more nuanced analysis. Repeating below a portion of the equations mentioned above:

Work out=weight moved per stroke×$H_1$ $W_o=A_2SdH_1$

Work in =the weight of water used per stroke×total height lost $W_i=(A_1-A_2)Sd(H_2-H_5)$ $$Eff=100W_oW_i=\frac{100A_2SdH_1}{(A_1-A_2)Sd(H_2-H_5)},$$

Bold terms cancel $$A_2/A_1=r:\ A_2=rA_1,$$

$$Eff=\frac{100rA_1H_1}{A_1(1-r)(H_2-H_5)},$$

$$Eff=\frac{100rH_1}{(1-r)(H_2-H_5},$$

In the first analysis, efficiency increases with increasing "r" because the upper term increases with "r" and the first factor in the lower term decreases with increasing "r": both trends act to increase the efficiency with increasing "r". However, the second factor in the lower term decreases with increasing "r", i.e. the pump is easier to drive with smaller "r"; and therefore $H_2$ (the height of the required power fluid column) decreases and $H_5$ (the allowable height of the power fluid release) increases. Other work supported the trend of increasing efficiency with increasing "r".

Nevertheless, certain formulae (in bold) are reproduced below to clarify the general case.

From Power Stroke Considerations:

$$P_2=\frac{P_1(1+a)}{(1-a)(1-r)}+\frac{R}{A_1(1-a)(1-r)},$$

Neglecting $R$.

$$P_2=\frac{P_1(1+a)}{(1-a)(1-r)}$$

From Recovery Stroke Considerations:

$$P_5 = \frac{P_1(a-(1-r))}{(1+a)(r-1)} + \frac{R}{A_1(1+a)(r-1)},$$

Neglecting $R$.

$$P_5 = \frac{P_1(a-(1-r))}{(1+a)(r-1)}$$

For pressurehead style pumps $P_1$, $P_2$ and $P_5$ can be used in place of $H_1$, $H_2$ and $H_5$.

The efficiency equation can be rewritten as:

$$Eff = \frac{100rA_1P_1}{A_1(1-r)(P_2-P_5)}, = \frac{100rP_1}{(1-r)P_2-(1-r)P_5},$$

$$Eff \frac{100rP_1}{\frac{(1-r)(P_1(1+a)}{(1-a)(1-r)} - \frac{(1-r)P_1(a-(1-r))}{(1+a)(r-1)}}, -$$

$(1-r)$ can be rewritten as $+(r-1)$ $$Eff = \frac{100r}{\frac{(1-r)(1+a)}{(1-a)(1-r)} + \frac{(r-1)(a-(1-r))}{(1+a)(r-1)}},$$

$$Eff = \frac{100r}{\frac{(1+a)}{(1-a)} + \frac{(a-(1-r))}{(1+a)}},$$

Note: as "r" increases, the top term increases. The first term in the bottom is independent of "r": the second term on the bottom increases as "r" increases, tending to reduce the efficiency with increasing "r"; however the bottom doesn't increase as quickly as the top so that over all the efficiency increases with increasing "r".

The equation is solved for four examples to demonstrate that the efficiency increases with increasing "r" for accelerations of 0.1 g and 0.01 g.

Example 1 for a=0.1; and r=0.8

$$Eff = \frac{100r}{\frac{(1+a)}{(1-a)} + \frac{(a-(1-r))}{(1+a)}},$$

$$= \frac{80}{\frac{1.1}{0.9} + \frac{(0.1-0.2)}{1.1}},$$

$$= \frac{80}{1.22 - \frac{0.1}{1.1}},$$

$$= \frac{80}{1.22-0.091},$$

$$Eff = 70.9\%$$

Example 2 for a=0.1; and r=0.5

$$Eff = \frac{100r}{\frac{(1+a)}{(1-a)} + \frac{(a-(1-r))}{(1+a)}}$$

$$= \frac{50}{\frac{1.1}{0.9} + \frac{(0.1-0.5)}{1.1}}$$

$$= \frac{50}{1.22 - \frac{0.4}{1.1}}$$

$$= \frac{50}{1.22-0.364}$$

$$Eff = 58.4\%$$

Example 3 for a=0.01; and r=0.8

$$Eff = \frac{100r}{\frac{(1+a)}{(1-a)} + \frac{(a-(1-r))}{(1+a)}}$$

$$= \frac{80}{\frac{1.01}{0.99} + \frac{(0.01-0.2)}{1.01}}$$

$$= \frac{80}{1.22 - \frac{0.19}{1.01}}$$

$$= \frac{80}{1.22-0.188}$$

$$Eff = 71.4\%$$

Example 4 for a=0.01; and r=0.5

$$Eff = \frac{100r}{\frac{(1+a)}{(1-a)} + \frac{(a-(1-r))}{(1+a)}},$$

$$= \frac{50}{\frac{1.01}{0.99} + \frac{(0.01-0.5)}{1.01}},$$

$$= \frac{50}{1.22 - \frac{0.49}{1.01}}$$

$$= \frac{50}{1.22-0.485},$$

$$Eff = 68.0\%$$

TABLE 22a

| Output | |
|---|---|
| Cycle time | 11.99 sec |
| Cycles/min | 5.00 |

TABLE 22a-continued

| Output | | |
|---|---|---|
| per cycle | 1.78 | lbs |
| per min | 8.92 | lbs |
| | 4.05 | liters |
| | 1.07 | Gal(US) |
| | 0.89 | Gal(Imp) |
| Work Rate | 297.39 | ft-lbs/sec |
| | 0.541 | hp |
| Eff | 96.71% | |

To calculate efficiency for the Power Cylinder Option, wherein the calculation includes the mass of the power column in the calculation of the acceleration, H is height of standard column, which is 2000 ft; P1 is 864 psi; $A_1$ is the area of standing column, which is 5.45 square inches, A2/A1=0.505; A2 is 2.75225 square inches; $A_1-A_2$ is the area that the pressure differential operates on, which is 2.69775 square inches; R=k*H1*(A1)^0.5; k=0.0054; R=Sum of Seal Resistance which is 25.21 lbs; Stroke is 1.5 ft; 1 ft of water (f)=0.432 psi; Density of water 0.036 lbs/in3.

TABLE 22b

| Recovery Stroke ($P_e$ = −12 psig) Ratio of Hp/H1 | Power column height Hp | P5 psi | Net force lbs | Accel ft/sec2 | Recovery stroke sec | Ei1 Work in lbs |
|---|---|---|---|---|---|---|
| 1 | 2000 | 852 | 7 | 0.049 | 7.788 | 582.71 |
| 0.99 | 1980 | 843.36 | 30 | 0.212 | 3.766 | 582.71 |
| 0.975 | 1950 | 830.4 | 65 | 0.458 | 2.560 | 582.71 |
| 0.95 | 1900 | 808.8 | 124 | 0.876 | 1.850 | 582.71 |
| 0.925 | 1850 | 787.2 | 182 | 1.306 | 1.516 | 582.71 |
| 0.9 | 1800 | 765.6 | 240 | 1.747 | 1.311 | 582.71 |
| 0.85 | 1700 | 722.4 | 357 | 2.664 | 1.061 | 582.71 |
| 0.8 | 1600 | 679.2 | 473 | 3.633 | 0.909 | 582.71 |
| 0.75 | 1500 | 636 | 590 | 4.657 | 0.803 | 582.71 |
| 0.7 | 1400 | 592.8 | 706 | 5.741 | 0.723 | 582.71 |
| 0.5 | 1000 | 420 | 1173 | 10.799 | 0.527 | 582.71 |
| 0.998 | 1996 | 850.272 | 12 | 0.082 | 6.058 | 582.71 |

Power Stroke Water Energy Gained Per Stroke=Eo=12SA2dH1

Eo=42803 in lbs

Recovery Work=583 in lbs

Hp=0.998×H1=1996 ft: Ph=862.272 psi

TABLE 22c

| Ratio of P2/P1 required psi | Height of working column | P2 psi | Net force lbs | Accel ft/sec2 | Power stroke sec | Pc required psi | Ei2 Work in lbs | Eo/Ei |
|---|---|---|---|---|---|---|---|---|
| 1 | 1996 | 864.0 | −2403 | zero | — | 1.73 | 84 | — |
| 1.5 | 1996 | 1296.0 | −1238 | zero | — | 433.73 | 21062 | 197.76% |
| 2 | 1996 | 1728.0 | −72 | zero | — | 865.73 | 42039 | 100.42% |
| 2.1 | 1996 | 1814.4 | 161 | 0.74 | 2.019 | 952.13 | 46235 | 91.43% |
| 2.25 | 1996 | 1944.0 | 510 | 2.34 | 1.133 | 1081.73 | 52528 | 80.59% |
| 2.5 | 1996 | 2160.0 | 1093 | 5.00 | 0.774 | 1297.73 | 63017 | 67.30% |
| 2.75 | 1996 | 2376.0 | 1676 | 7.67 | 0.625 | 1513.73 | 73506 | 57.77% |
| 3 | 1996 | 2592.0 | 2259 | 10.34 | 0.539 | 1729.73 | 83995 | 50.61% |
| 2.039 | 1996 | 1761.7 | 19 | 0.09 | 5.936 | 899.42 | 43676 | 96.71% |

As illustrated above in Table 22, the A2/A1 ratio is 0.505, the recovery stroke show −12 psi as Pc, which shows that a 12 psi vacuum is created under the transfer piston as the upper cylinder is drawn back. Further, only 582.71 lbs. of energy is needed to draw the transfer piston down in the cylinder because the area on the upper side of the transfer piston with the force on it from the weight of the discharge column easily overcomes the energy resisting the transfer piston from the lower area of the transfer piston in the transfer chamber.

Examining the power stroke, at 96.71% efficiency at an acceleration of 0.09 ft/sec$^2$ 43,676 lbs. of force is needed to make the transfer piston move back up. The acceleration is 0.09/32=0.0028 g (gravity) as opposed to the 1.0 g used in some of the equations reproduced above and that described how the particular pump was to operate. Pipelines are designed at a nominal 2 ft/sec velocity with a maximum design velocity of 5 ft/sec, which are standard numbers. Such numbers may be changed, but are those often used. At 1 g (32 ft/sec$^2$) the acceleration creates a velocity, which is too fast too quickly for optimal use.

Table 22 above shows the efficiency of one 3.5" pump at just over 35 Barrels per day. The data indicate that the 3.5" pump functions just as well if it were 3.5°. The above 3.5" pump has useful application in stripper oil wells in the United States. Currently, of the more than 400,000 stripper oil wells in the United States, many average approximately 2.2 Barrels per day of oil and simultaneously produce 9 Barrels of water. Thus, the average production of a stripper oil well is approximately 20 Barrels per day. Smaller stripper oil wells use 10 HP or larger pump jacks. As illustrated in the data of Table 22, a pump of the present disclosure can perform the same work as one of the commonly used stripper oil well pumps for less than 1 HP.

TABLE 23

| Efficiency vs A2/A1 | | | | | | |
|---|---|---|---|---|---|---|
| A2/A1 = P2/P1 | 0.4 | 0.5 | 0.6 | 0.7 | 0.8 | 0.82 |
| 1.5 | 0.0% | 0.0% | 0.0% | 0.0% | 0.0% | 0.0% |
| 1.8 | 0.0% | 0.0% | 0.0% | 0.0% | 0.0% | 0.0% |
| 2.0 | 41.4% | 0.0% | 0.0% | 0.0% | 0.0% | 0.0% |
| 2.5 | 31.6% | 45.7% | 0.0% | 0.0% | 0.0% | 0.0% |
| 3.0 | 25.5% | 37.2% | 53.3% | 0.0% | 0.0% | 0.0% |
| 4.0 | 18.5% | 27.1% | 39.3% | 59.1% | 0.0% | 0.0% |
| 5.0 | 14.5% | 21.3% | 31.2% | 47.1% | 0.0% | 0.0% |

TABLE 23-continued

| Efficiency vs A2/A1 | | | | | | |
|---|---|---|---|---|---|---|
| A2/A1 = P2/P1 | 0.4 | 0.5 | 0.6 | 0.7 | 0.8 | 0.82 |
| 7.5 | 9.4% | 13.9% | 20.5% | 31.3% | 53.7% | 61.1% |
| 10.0 | 6.9% | 10.3% | 15.3% | 23.5% | 40.2% | 45.8% |
| optimum | 26.6% | 31.5% | 36.0% | 40.7% | 46.3% | 47.5% |
| P5/P1, req | 0.39 | 0.31 | 0.185 | 0.05 | 0.05 | 0.05 |
| Rec Acc ft/sec2 | 8.04 | 8.01 | 8.04 | 7.21 | 4.21 | 3.61 |
| P2/P1 opt | 2.9 | 3.48 | 4.35 | 5.79 | 8.69 | 9.65 |

The data from Table 23 above are reproduced in the graph of FIG. 13. As illustrated, the efficiency of the pump is graphed as a function of the ratio of A2/A1 for several different values of P2/P1. Lines have been added connecting the points on the graph of each value of P2/P1 as the ratio of A2/A1 changed. Generally, for each P2/P1 the efficiency increased as the ratio of A2/A1 increased up until a point when efficiency fell to zero and remained there for further increases in the ratio of A2/A1.

More accurately, the piston pump illustrated in Table 23 and FIG. 13 is more efficient as the ratio of A2/A1 increases. There are two opposing trends in operation: (1) as the transfer area A2 increase for a fixed overall area A1, more fluid is lifted per stroke and less working fluid is used per stroke; and (2) the opposing trend is that the driving pressure must increase as the transfer area increases for a fixed over-all area. As illustrated in the equations above, the increase in lifted fluid and the reduction in power fluid are more important that the increase in the driving pressure. The amount of fluid lifted per stroke is the transfer area times the stroke length (A2S). The amount of power fluid used per stroke is the power fluid area times the stroke length. The power fluid area is the annular area equal to the over-all area minus the transfer area (A1−A2), as A2 increases for a fixed A1, the power fluid area decreases.

The present application discloses a pump having increased energy efficiency. The pumps disclosed reduce maintenance costs by reducing the number of moving parts and/or reducing the damage caused by suspended particles. In addition, in many pumping applications, a motor must be placed downhole in order to pump the fluid to the surface and such motors often require a downhole cooling system. One advantage of some of the embodiments disclosed herein is the elimination of the requirement of a downhole cooling system.

All references cited herein are incorporated herein by reference in their entirety. To the extent publications and patents or patent applications incorporated by reference contradict the disclosure contained in the specification, the specification is intended to supersede and/or take precedence over any such contradictory material.

The term "comprising" as used herein is synonymous with "including," "containing," or "characterized by," and is inclusive or open-ended and does not exclude additional, unrecited elements or method steps.

All numbers expressing sizes, rates, quantities of ingredients, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A pumping apparatus, comprising:

a housing;

a first inlet disposed within the housing, the first inlet having an inlet valve;

an outlet disposed within the housing;

an internal power fluid column disposed within the housing, the internal power fluid column having a second inlet; and a transfer piston reciprocatingly mounted about the power fluid column, the transfer piston slidably and sealingly extending between the power fluid column and an interior wall of the housing;

a product fluid chamber positioned above the transfer piston and at least partially defined by the interior wall of the housing;

a transfer chamber positioned below the transfer piston and at least partially defined by the interior wall of the housing;

a sealable channel in the transfer piston fluidly connecting the product fluid chamber and the transfer chamber, the sealable channel having a transfer piston valve; and at least one passageway fluidly connecting the power fluid column with a power fluid chamber.

2. The pumping apparatus of claim 1, wherein the apparatus is configured to pressurize fluid inside the power fluid column and the power fluid chamber.

3. The pumping apparatus of claim 2, wherein the transfer piston is configured such that the fluid acts against a first area comprising at least a portion of the transfer piston in a direction of transfer piston movement.

4. The pumping apparatus of claim 3, wherein the first area is greater than a second area comprising at least a portion of the transfer piston in the power fluid chamber, and wherein the transfer piston is configured such that the fluid in the power fluid chamber acts against the second area in the direction of transfer piston movement.

5. The pumping apparatus of claim 1, further comprising a first valve stop configured to prevent closing of the inlet valve and a second valve stop configured to prevent closing of the transfer piston valve.

6. The pumping apparatus of claim 5, wherein at least one of the first valve stop and the second valve stop comprises an extended portion on a rod portion of the transfer piston.

7. The pumping apparatus of claim 5, wherein at least one of the first valve stop and the second valve stop comprises a v-shaped member configured to prevent the transfer piston valve from closing.

8. The pumping apparatus of claim 7, wherein the v-shaped member is configured to prevent the transfer piston valve from closing when the v-shaped member contacts an activator.

9. The pumping apparatus of claim 1, wherein the power fluid column is internal and the power fluid chamber, the transfer chamber and the product chamber are situated coaxially about the power fluid column.

10. The pumping apparatus of claim 1, configured for use in a deep well.

11. The pumping apparatus of claim 10, further comprising a power fluid comprising water in the power fluid column.

12. The pumping apparatus of claim 10, further comprising a power fluid comprising a hydraulic fluid in the power fluid column.

13. The pumping apparatus of claim 10, wherein at least one of the power fluid chamber and the power fluid column comprises stainless steel.

14. The pumping apparatus of claim 10, wherein at least one of the power fluid chamber and the power fluid column comprises titanium.

15. The pumping apparatus of claim 1, further comprising a valve configured to control oscillation of a high head, whereby oscillating pressure to the power fluid is delivered.

16. The pumping apparatus of claim 1, further comprising a fluid inlet screen configured to filter fluid entering the first inlet.

17. The pumping apparatus of claim 1, further comprising a coaxial disconnect.

18. The pumping apparatus of claim 1, further comprising a subterranean switch pump.

19. The pumping apparatus of claim 18, wherein the subterranean switch pump comprises a power hydraulic line and a recovery hydraulic line.

20. A system for pumping fluid in a deep well, the system comprising:

the pumping apparatus of claim 1; and a power fluid within the power fluid column and the power fluid chamber.

21. The system of claim 20, further comprising a coaxial disconnecting device, wherein the coaxial disconnecting device is separately sealed to the power fluid column and the product fluid chamber, whereby fluid communication between the power fluid column and the coaxial disconnecting device is provided, and whereby fluid communication between the product fluid chamber and the coaxial disconnecting device is provided.

* * * * *

UNITED STATES PATENT AND TRADEMARK OFFICE

CERTIFICATE OF CORRECTION

PATENT NO. : 8,454,325 B2
APPLICATION NO. : 12/023016
DATED : June 4, 2013
INVENTOR(S) : Fisher et al.

It is certified that error appears in the above-identified patent and that said Letters Patent is hereby corrected as shown below:

In the Specification

In column 13 at line 16, Change " $F_{net}=F_{up}=F_{down}=P_{pf}A3-P_1A_1-R$ " to -- $F_{net} = F_{up} - F_{down} = P_{pf}A3 - P_1A_1 - R$ --.

In column 64 at line 22, Change " $P_c(A_1 - rA_1) - P_1A_1 + R = P_1A_1a$ " to -- $P_c(A_1 - rA_1) - P_1A_1 - R = P_1A_1a$ --.

In column 65 at line 43 (approx.), Change " $Eff = 100W_o / W_i = \frac{100A_2SdH_1}{P_c(A_1A_2)S}$ " to -- $Eff = 100W_o/W_i = \frac{100A_2SdH_1}{P_c(A_1 - A_2)S}$ --.

In column 65 at line 52 (approx.), Change "$A_2A_1$" to --$A_2/A_1$--.

In column 70 at line 23, Change "3.5°." to --3.5'.--.

Signed and Sealed this
Nineteenth Day of November, 2013

Teresa Stanek Rea

Teresa Stanek Rea
*Deputy Director of the United States Patent and Trademark Office*